US012290220B2

(12) United States Patent
Lampard et al.

(10) Patent No.: US 12,290,220 B2
(45) Date of Patent: May 6, 2025

(54) CLEANING APPARATUS

(71) Applicant: SHARKNINJA OPERATING LLC, Needham, MA (US)

(72) Inventors: Bartholomew Lampard, London (GB); Jennifer Andrews, Cambridge, MA (US); Fariha Ahmed, Brighton, MA (US); Jay Castro, Brookline, MA (US); Oliver G. Holmes, London (GB); Joe Baxter, London (GB); Wil McArdle, Needham, MA (US); Ognjen Vrdoljak, Laval (CA); Lois Jones, London (GB); Joshua Kingsbury, Canterbury (GB); David T. Barker, Goole (GB); Jemima L. C. Meil, Lancaster (GB); Shiqi Mu, Suzhou (CN); Heliang Chen, Suzhou (CN); Dawei Liu, Suzhou (CN); Xiang Zhou, Suzhou (CN); Cong Su, Suzhou (CN); Mingliang Qin, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/737,436

(22) Filed: Jun. 7, 2024

(65) Prior Publication Data

US 2024/0389818 A1 Nov. 28, 2024

Related U.S. Application Data

(63) Continuation of application No. PCT/CN2024/073318, filed on Jan. 19, 2024.
(Continued)

(51) Int. Cl.
*A47L 11/40* (2006.01)
*A47L 11/22* (2006.01)
(Continued)

(52) U.S. Cl.
CPC ..... *A47L 11/4016* (2013.01); *A47L 11/22* (2013.01); *A47L 11/24* (2013.01); *A47L 11/282* (2013.01);
(Continued)

(58) Field of Classification Search
CPC ..... A47L 11/14; A47L 11/18; A47L 11/185; A47L 11/24; A47L 11/28; A47L 11/282;
(Continued)

(56) References Cited

U.S. PATENT DOCUMENTS 1,770,643 A 7/1930 Giambertoni
3,172,138 A 3/1965 Price
(Continued)

FOREIGN PATENT DOCUMENTS

CN 102843944 12/2012
CN 104717912 A 6/2015
(Continued)

OTHER PUBLICATIONS

English translation of CN 208677291U (Year: 2019).*
(Continued)

*Primary Examiner* — David S Posigian
*Assistant Examiner* — Sukwoo James Chang
(74) *Attorney, Agent, or Firm* — Mintz, Levin, Cohn, Ferris, Glovsky and Popeo, P.C.

(57) ABSTRACT

A surface cleaning head may include a fluid distributor configured to distribute a cleaning fluid, an agitator configured to absorb at least a portion of the distributed cleaning fluid and to agitate debris on the surface to be cleaned, a fluid stripper configured to remove, from the agitator, at least a portion of the distributed cleaning fluid absorbed by the agitator, a debris container, and a removable cover. The debris container may include a solid debris chamber and a fluid debris chamber. The removable cover may include a
(Continued)

fluid catch plate configured to transfer at least a portion of the cleaning fluid removed from the agitator by the fluid stripper to the fluid debris chamber, the fluid catch plate being configured to selectively transition between an in-use position and a cleaning position when the removable cover is removed from the surface cleaning head.

20 Claims, 49 Drawing Sheets

Related U.S. Application Data

(60) Provisional application No. 63/535,207, filed on Aug. 29, 2023, provisional application No. 63/503,766, filed on May 23, 2023.

(51) Int. Cl.
*A47L 11/24* (2006.01)
*A47L 11/282* (2006.01)

(52) U.S. Cl.
CPC ..... *A47L 11/4025* (2013.01); *A47L 11/4041* (2013.01); *A47L 11/4075* (2013.01); *A47L 11/4088* (2013.01); *A47L 11/4008* (2013.01); *A47L 11/4083* (2013.01); *A47L 11/4086* (2013.01)

(58) Field of Classification Search
CPC .... A47L 11/29; A47L 11/292; A47L 11/4016; A47L 11/4041; A47L 11/0477; A47L 11/302; A47L 11/125; A47L 11/2025; A47L 9/0477
See application file for complete search history.

(56) References Cited

U.S. PATENT DOCUMENTS 3,225,374 A 12/1965 Daley
3,619,948 A 11/1971 Burns
3,907,257 A 9/1975 Drzewiecki
6,134,745 A 10/2000 Worwag
6,256,832 B1 7/2001 Dyson
6,323,570 B1 11/2001 Nishimura
6,345,411 B1 2/2002 Kato
6,351,872 B1 3/2002 McCormick
6,400,048 B1 6/2002 Nishimura
6,437,465 B1 8/2002 Nishimura
6,463,626 B1 10/2002 Ferrari
6,684,451 B2 2/2004 Kato
6,757,934 B2 7/2004 Park
6,772,476 B2 8/2004 Park
6,785,933 B2 9/2004 Kim
6,848,147 B2 2/2005 Syverson
7,022,003 B1 4/2006 Hughes
7,079,923 B2 7/2006 Abramson
7,237,298 B2 7/2007 Reindle
7,451,857 B2 11/2008 Hasegawa
7,665,172 B1 2/2010 Tran
7,718,593 B2 5/2010 Micciche
7,805,795 B2 10/2010 Stein
7,814,613 B1 10/2010 Whittaker
7,987,546 B2 8/2011 Poch
8,037,571 B2 10/2011 Butts
8,042,222 B2 10/2011 Behrenswerth
8,214,960 B1 7/2012 Rupp
8,316,503 B2 11/2012 Follows
8,353,074 B2 1/2013 Krebs
8,402,600 B2 3/2013 Beskow
8,438,694 B2 5/2013 Kim
8,458,850 B2 6/2013 Kasper
8,495,781 B2 7/2013 Dingert
8,549,697 B1 10/2013 Moyher, Jr.
8,572,799 B2 11/2013 Won
8,601,643 B2 12/2013 Eriksson
8,607,404 B2 12/2013 Krebs
8,607,405 B2 12/2013 Reed
8,627,543 B2 1/2014 Vrdoljak
8,650,703 B2 2/2014 Kim
8,677,552 B2 3/2014 Krebs
8,726,441 B1 5/2014 Colasanti
8,739,361 B2 6/2014 McLeod
8,745,818 B2 6/2014 Iles
8,776,310 B2 7/2014 Genn
8,776,311 B2 7/2014 Genn
8,800,107 B2 8/2014 Blouin
8,806,710 B2 8/2014 Follows
8,819,882 B2 9/2014 De Wit
8,850,654 B2 10/2014 Nolan
8,898,858 B2 12/2014 Dyson
8,927,480 B2 1/2015 Williams
9,015,897 B2 4/2015 Jonsson
9,021,655 B2 5/2015 Owen
9,042,222 B2 5/2015 Kwan
9,066,640 B2 6/2015 Iles
9,072,415 B2 7/2015 Krebs
9,095,244 B2 8/2015 Jonsson
9,125,540 B2 9/2015 Tran
9,289,105 B2 3/2016 Moes
9,301,665 B2 4/2016 Clothier
9,320,399 B2 4/2016 Ventress
9,433,335 B2 9/2016 Nolan
9,451,857 B2 9/2016 Stein
9,504,366 B2 11/2016 Kasper
9,521,940 B2 12/2016 Johnson
9,572,469 B2 2/2017 Goff
9,635,991 B2 5/2017 Luo
9,661,976 B2 5/2017 Barrocas
9,700,184 B2 7/2017 Stein
9,713,411 B2 7/2017 Gardner
9,737,187 B2 8/2017 Bantum
9,750,380 B2 9/2017 Mcvey
9,750,383 B2 9/2017 Janzen
9,775,477 B2 10/2017 Eriksson
9,780,380 B2 10/2017 Chae
9,801,516 B2 10/2017 Zheng
9,826,869 B2 11/2017 Kettle Aiers
9,848,746 B2 12/2017 Feng
9,867,515 B2 1/2018 Ventress
9,918,606 B2 3/2018 Tran
9,949,605 B2 4/2018 Isley
10,004,370 B2 6/2018 Isley
10,016,108 B2 7/2018 Barrett
10,039,431 B1 8/2018 Li
10,045,672 B2 8/2018 Eriksson
10,052,002 B2 8/2018 Andrews
10,071,454 B2 9/2018 Forlong
10,092,150 B2 10/2018 Isley
10,117,554 B2 11/2018 Williamson
10,213,077 B2 2/2019 Genn
10,226,157 B2 3/2019 Xu
10,258,212 B2 4/2019 Nam
10,292,556 B2 5/2019 Isley
10,307,033 B2 6/2019 Krebs
10,314,449 B2 6/2019 Blouin
10,321,795 B2 6/2019 Fan
10,327,619 B2 6/2019 Moser
10,362,920 B2 7/2019 Moser
10,376,124 B2 8/2019 McDowell
10,398,274 B2 9/2019 Kasper
10,398,280 B2 9/2019 Krebs
10,426,306 B2 10/2019 Isley
10,555,650 B2 2/2020 Genn
10,595,624 B2 3/2020 Blouin
10,631,702 B2 4/2020 Xia
10,638,901 B2 5/2020 Yang
10,667,660 B2 6/2020 McIntosh
10,667,662 B2 6/2020 Carswell
10,702,108 B2 7/2020 Udy
10,702,117 B2 7/2020 Hansen
10,729,303 B2 8/2020 Li
10,758,102 B2 9/2020 Lindenbeck

(56) References Cited

U.S. PATENT DOCUMENTS

| | | | | |
|---|---|---|---|---|
| 10,765,283 | B2 | 9/2020 | Li | |
| 10,786,127 | B2 | 9/2020 | Isley | |
| 10,786,130 | B2 | 9/2020 | Braendle | |
| 10,791,903 | B2 | 10/2020 | Krebs | |
| 10,842,338 | B2 | 11/2020 | Weis | |
| 10,905,296 | B2 | 2/2021 | Windmeisser | |
| 10,912,436 | B2 | 2/2021 | Li | |
| 10,912,438 | B2 | 2/2021 | Li | |
| 10,918,253 | B2 | 2/2021 | Li | |
| 10,925,454 | B2 | 2/2021 | Yang | |
| 10,945,572 | B2 | 3/2021 | Andrews | |
| 10,959,590 | B2 | 3/2021 | Moser | |
| 10,959,593 | B2 | 3/2021 | Du | |
| 11,058,271 | B2 | 7/2021 | Blouin | |
| 11,058,274 | B2 | 7/2021 | Mueller | |
| 11,083,351 | B2 | 8/2021 | Mallon | |
| 11,109,735 | B2 | 9/2021 | Gunter | |
| 11,122,946 | B2 | 9/2021 | Nguyen | |
| 11,141,035 | B2 | 10/2021 | Zhang | |
| 11,174,607 | B2 | 11/2021 | Vetrucci | |
| 11,202,541 | B2 | 12/2021 | Keil | |
| 11,202,546 | B2 | 12/2021 | Kasper | |
| 11,202,549 | B2 | 12/2021 | Krebs | |
| 11,241,082 | B2 | 2/2022 | Blouin | |
| 11,266,285 | B2 | 3/2022 | Pruiett | |
| 11,297,985 | B2 | 4/2022 | Thorne | |
| 11,304,584 | B2 | 4/2022 | Krebs | |
| 11,344,172 | B2 | 5/2022 | Xu | |
| 11,345,010 | B2 | 5/2022 | Chan | |
| 11,357,378 | B2 | 6/2022 | Li | |
| 11,369,242 | B2 | 6/2022 | Chow | |
| 11,399,677 | B2 | 8/2022 | Sun | |
| 11,432,699 | B2 | 9/2022 | Krebs | |
| 11,457,781 | B2 | 10/2022 | Shin | |
| 11,457,790 | B2 | 10/2022 | Braendle | |
| 11,471,020 | B2 | 10/2022 | Gilbert, Jr. | |
| 11,503,975 | B2 | 11/2022 | Wang | |
| 11,523,724 | B2 | 12/2022 | Meisenbacher | |
| 11,534,046 | B2 | 12/2022 | Jang | |
| 11,540,689 | B2 | 1/2023 | Johnson | |
| 11,641,999 | B2 | 5/2023 | Lee | |
| 11,707,170 | B2 | 7/2023 | Conrad | |
| 2005/0160555 | A1 | 7/2005 | Mayes | |
| 2006/0150363 | A1 | 7/2006 | Choi | |
| 2010/0107357 | A1 | 5/2010 | Odachi | |
| 2010/0306958 | A1 | 12/2010 | Follows | |
| 2010/0306959 | A1 | 12/2010 | Follows | |
| 2014/0041136 | A1 | 2/2014 | Kerr | |
| 2017/0119225 | A1 | 5/2017 | Xia | |
| 2017/0273523 | A1 | 9/2017 | Kasper | |
| 2018/0132684 | A1 | 5/2018 | Keil | |
| 2019/0008349 | A1 | 1/2019 | Strutt | |
| 2019/0269289 | A1 | 9/2019 | Xu | |
| 2020/0046183 | A1 | 2/2020 | Choi | |
| 2020/0196818 | A1 | 6/2020 | Verhasselt | |
| 2020/0253447 | A1 | 8/2020 | Wang | |
| 2020/0315415 | A1 | 10/2020 | Carswell | |
| 2020/0397203 | A1 | 12/2020 | Yang | |
| 2020/0405105 | A1 | 12/2020 | Mockridge | |
| 2021/0015327 | A1 | 1/2021 | Taylor | |
| 2021/0036578 | A1 | 2/2021 | Worker | |
| 2021/0045598 | A1 | 2/2021 | Krebs | |
| 2021/0068602 | A1 | 3/2021 | Carter | |
| 2021/0113047 | A1 | 4/2021 | Zhao | |
| 2021/0127938 | A1 | 5/2021 | Mallon | |
| 2021/0169294 | A1* | 6/2021 | Pruiett | A47L 11/4016 |
| 2021/0186290 | A1 | 6/2021 | Feng | |
| 2021/0251443 | A1 | 8/2021 | Perry | |
| 2021/0386256 | A1 | 12/2021 | Blouin | |
| 2021/0393024 | A1 | 12/2021 | Forbes | |
| 2022/0022720 | A1 | 1/2022 | Moser | |
| 2022/0047131 | A1 | 2/2022 | Burbank | |
| 2022/0079402 | A1 | 3/2022 | Isaacs | |
| 2022/0142440 | A1 | 5/2022 | Conrad | |
| 2022/0151372 | A1 | 5/2022 | Blouin | |
| 2022/0211232 | A1 | 7/2022 | Goncalves | |
| 2022/0225852 | A1 | 7/2022 | Moser | |
| 2022/0233038 | A1 | 7/2022 | Goncalves | |
| 2022/0240736 | A1 | 8/2022 | Fan | |
| 2022/0304528 | A1 | 9/2022 | Zhang | |
| 2022/0313037 | A1 | 10/2022 | Chow | |
| 2022/0346610 | A1 | 11/2022 | Lubbers | |
| 2022/0346612 | A1 | 11/2022 | Oldfield | |
| 2022/0378258 | A1 | 12/2022 | Perry et al. | |
| 2022/0386839 | A1 | 12/2022 | Moser | |
| 2022/0395153 | A1 | 12/2022 | Koch | |
| 2023/0058126 | A1 | 2/2023 | Zhou | |
| 2023/0063470 | A1 | 3/2023 | Grab | |
| 2023/0080846 | A1 | 3/2023 | Zhou | |
| 2023/0157496 | A1 | 5/2023 | Lee | |
| 2023/0157502 | A1 | 5/2023 | Hahn | |
| 2023/0190067 | A1 | 6/2023 | Liu | |
| 2023/0263355 | A1 | 8/2023 | Camplani | |
| 2023/0264885 | A1 | 8/2023 | Conrad et al. | |
| 2024/0057831 | A1 | 2/2024 | Conrad | |
| 2024/0115097 | A1 | 4/2024 | Lee | |

FOREIGN PATENT DOCUMENTS

| | | | | |
|---|---|---|---|---|
| CN | 204931569 | | 1/2016 | |
| CN | 105392595 | | 3/2016 | |
| CN | 105979842 | | 9/2016 | |
| CN | 106466149 | A | 3/2017 | |
| CN | 107713903 | A | 2/2018 | |
| CN | 108283459 | | 7/2018 | |
| CN | 108420365 | A | 8/2018 | |
| CN | 108478105 | A | 9/2018 | |
| CN | 108553035 | A | 9/2018 | |
| CN | 108606730 | A | 10/2018 | |
| CN | 109008766 | A | 12/2018 | |
| CN | 109044210 | A | 12/2018 | |
| CN | 109199223 | A | 1/2019 | |
| CN | 109419448 | | 3/2019 | |
| CN | 109691933 | A | 4/2019 | |
| CN | 208677291 | U * | 4/2019 | A47L 13/256 |
| CN | 110250995 | | 9/2019 | |
| CN | 110292329 | A | 10/2019 | |
| CN | 209826554 | | 12/2019 | |
| CN | 110897560 | A | 3/2020 | |
| CN | 111150339 | A | 5/2020 | |
| CN | 111150341 | A | 5/2020 | |
| CN | 111166252 | A | 5/2020 | |
| CN | 111166257 | A | 5/2020 | |
| CN | 111434299 | A | 7/2020 | |
| CN | 111434300 | A | 7/2020 | |
| CN | 111434301 | | 7/2020 | |
| CN | 112022009 | A | 12/2020 | |
| CN | 112294199 | A | 2/2021 | |
| CN | 112369974 | A | 2/2021 | |
| CN | 112533520 | | 3/2021 | |
| CN | 112754375 | A | 5/2021 | |
| CN | 112773286 | A * | 5/2021 | A47L 13/58 |
| CN | 112790683 | A | 5/2021 | |
| CN | 112826386 | | 5/2021 | |
| CN | 112842133 | A | 5/2021 | |
| CN | 112842135 | A | 5/2021 | |
| CN | 112869628 | A | 6/2021 | |
| CN | 112932325 | | 6/2021 | |
| CN | 113017488 | | 6/2021 | |
| CN | 113243846 | A | 8/2021 | |
| CN | 113273937 | A | 8/2021 | |
| CN | 113455968 | A | 10/2021 | |
| CN | 113455973 | A | 10/2021 | |
| CN | 113455974 | | 10/2021 | |
| CN | 113545699 | A | 10/2021 | |
| CN | 113545700 | A | 10/2021 | |
| CN | 113545701 | A | 10/2021 | |
| CN | 113545712 | A | 10/2021 | |
| CN | 113573621 | | 10/2021 | |
| CN | 113598664 | A | 11/2021 | |
| CN | 113693512 | A | 11/2021 | |
| CN | 113693520 | A | 11/2021 | |
| CN | 113796793 | A | 12/2021 | |
| CN | 113876261 | A | 1/2022 | |

(56) References Cited

FOREIGN PATENT DOCUMENTS

| | | | |
|---|---|---|---|
| CN | 114246521 | A | 3/2022 |
| CN | 113180553 | | 4/2022 |
| CN | 114343501 | A | 4/2022 |
| CN | 114451806 | A | 5/2022 |
| CN | 114631757 | A | 6/2022 |
| CN | 114680747 | A | 7/2022 |
| CN | 114699025 | A | 7/2022 |
| CN | 114869178 | A | 8/2022 |
| CN | 114931336 | A | 8/2022 |
| CN | 217471875 | | 9/2022 |
| CN | 115251780 | A | 11/2022 |
| CN | 115349783 | A | 11/2022 |
| CN | 115413972 | A | 12/2022 |
| CN | 116098532 | A | 5/2023 |
| CN | 116369793 | A | 7/2023 |
| EP | 1244377 | A1 | 10/2002 |
| EP | 3777632 | A1 | 2/2021 |
| EP | 3900594 | A1 | 10/2021 |
| EP | 3900595 | A1 | 10/2021 |
| EP | 3900597 | A1 | 10/2021 |
| EP | 4129145 | A1 | 2/2023 |
| EP | 4201284 | A1 | 6/2023 |
| GB | 2622848 | | 4/2024 |
| GB | 2622849 | | 4/2024 |
| GB | 2622852 | | 4/2024 |
| GB | 2622853 | | 4/2024 |
| GB | 2622854 | | 4/2024 |
| GB | 2622855 | | 4/2024 |
| GB | 2622856 | | 4/2024 |
| GB | 2622857 | | 4/2024 |
| GB | 2622858 | | 4/2024 |
| GB | 2622859 | | 4/2024 |
| GB | 2622860 | | 4/2024 |
| JP | H07303587 | | 11/1995 |
| JP | 2004337499 | A | 12/2004 |
| JP | 2005312589 | A | 11/2005 |
| JP | 2009268684 | A | 11/2009 |
| JP | 4985804 | B2 | 7/2012 |
| JP | 5129996 | B2 | 1/2013 |
| JP | 5429374 | B2 | 2/2014 |
| JP | 5465611 | B2 | 4/2014 |
| JP | 5668629 | B2 | 2/2015 |
| JP | 5810449 | B2 | 11/2015 |
| JP | 6047824 | B2 | 12/2016 |
| JP | 6075466 | B2 | 2/2017 |
| JP | 6248668 | B2 | 12/2017 |
| JP | 6845924 | B2 | 3/2021 |
| WO | 2021069860 | A1 | 4/2021 |
| WO | 2021069862 | A1 | 4/2021 |
| WO | 2021069863 | A1 | 4/2021 |
| WO | 2022129849 | | 6/2022 |
| WO | 2022129850 | | 6/2022 |
| WO | 2022129851 | | 6/2022 |
| WO | 2022180387 | | 9/2022 |
| WO | 2024069399 | | 4/2024 |

OTHER PUBLICATIONS

English translation of CN 113573621A (Year: 2021).*
English translation of CN 112773286A (Year: 2021).*
PCT Search Report and Written Opinion mailed May 6, 2024 received in PCT Application No. PCT/CN24/073318, 11 pages.

* cited by examiner

CLEANING APPARATUS

CROSS-REFERENCE TO RELATED APPLICATIONS

The present application is a continuation of PCT/CN2024/073318 filed on Jan. 19, 2024 which claims the benefit of U.S. Provisional Application Ser. No. 63/503,766 filed on May 23, 2023, entitled Water or Steam Cleaning Apparatus, and U.S. Provisional Application Ser. No. 63/535,207 filed on Aug. 29, 2023, entitled Water or Steam Cleaning Apparatus and Accessory for Vacuum Cleaner, each of which are fully incorporated herein by reference.

TECHNICAL FIELD

The present disclosure generally relates to surface cleaning devices and more specifically to powered surface sweepers.

BACKGROUND INFORMATION

Surface treatment apparatuses can be configured to clean one or more surfaces (e.g., a floor). Surface treatment apparatuses may include, for example, a vacuum cleaner, a mop, a steam cleaning apparatus, a sweeper (e.g., a powered sweeper), and/or any other surface treatment apparatus. Powered sweepers may include one or more agitators (e.g., a brush roll), an agitator motor to drive (e.g., rotate) the one or more agitators, and a debris container to collect debris agitated from a surface to be cleaned using the one or more agitators. A powered sweeper is configured to collect debris without the use of suction.

BRIEF DESCRIPTION OF THE DRAWINGS

These and other features and advantages will be better understood by reading the following detailed description, taken together with the drawings wherein.

DETAILED DESCRIPTION

The present disclosure is generally directed to a surface cleaning device configured to clean a surface to be cleaned (e.g., a floor) without the use of suction. The surface cleaning device may include an upright section pivotally coupled to a surface cleaning head. The surface cleaning head may include a fluid distributor configured to distribute a cleaning fluid and a debris container configured to collect liquid and solid debris. The debris container may include a fluid debris chamber configured to collect fluid debris and a solid debris chamber configured to collect solid debris.

Figure 1:
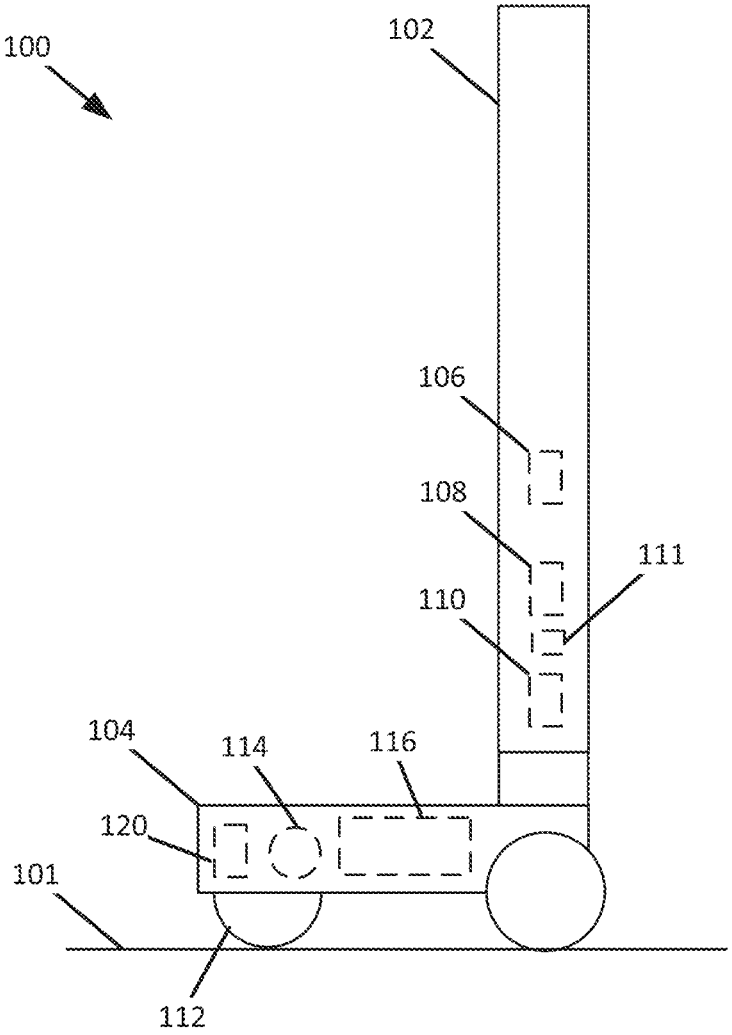
FIG. 1 shows a schematic example of a surface cleaning device, consistent with embodiments of the present disclosure.

FIG. 1 shows a schematic example of a surface cleaning device 100 configured to clean a surface to be cleaned 101 (e.g., a floor) without the use of suction. As shown, the surface cleaning device 100 includes an upright section 102 and a surface cleaning head 104. The upright section 102 is pivotally coupled to the surface cleaning head 104 and may include, for example, a power supply 106. In some instances, the upright section 102 may include a fluid reservoir 108 configured to receive a cleaning fluid (e.g., water, a mixture of water and a cleaning chemical, and/or any other cleaning fluid) and a boiler 110 fluidly coupled to the fluid reservoir 108. The boiler 110 is configured to heat fluid from the fluid reservoir 108 (e.g., to generate steam). A pump 111 for urging cleaning fluid from the fluid reservoir 108 may be provided in the upright section 102 and/or in the surface cleaning head 104.

The surface cleaning head 104 includes one or more agitators 112 (e.g., a brush roll), at least one agitator motor 114 configure to drive (e.g., rotate) the one or more agitators 112, and a debris container 116 configured to collect at least a portion of the debris agitated from a surface to be cleaned 101 by the one or more agitators 112. The surface cleaning head 104 further includes a fluid distributor 120 that is fluidly coupled to the fluid reservoir 108. The fluid distributor 120 is configured to distribute fluid to one or more of the one or more agitators 112 and/or the surface to be cleaned 101. For example, the fluid distributor 120 may include a nozzle configured to apply a cleaning fluid directly to the surface to be cleaned 101 (e.g., at a location forward of the surface cleaning head 104, relative to a direction of forward travel). By way of further example, the fluid distributor 120 may include a steam manifold (e.g., having a plurality of steam delivery apertures) configured to deliver steam directly to the one or more agitators 112. By way of still further example, the fluid distributor 120 may include a nozzle configured to apply steam directly to the surface to be cleaned 101. By way of still further example, the fluid distributor 120 may include a manifold configured to deliver cleaning fluid directly to the one or more agitators 112.

In some instances, the surface cleaning head 104 may include one or more of the power supply 106, the fluid reservoir 108, and/or the boiler 110. Such a configuration may allow the surface cleaning head 104 to be used interchangeably with other devices while being able to apply the cleaning fluid to the surface to be cleaned 101. For example, the surface cleaning head 104 may be configured to removably couple with an upright section of a vacuum cleaner, wherein a suction source of the vacuum cleaner is disabled while the surface cleaning head 104 is attached thereto. In this example, the surface cleaning head 104 may function as a vacuum cleaning accessory configured to provide a wet sweeping or a steam sweeping functionality to the vacuum cleaner, wherein, in some instances, a power supply of the vacuum cleaner may be configured to provide power to the surface cleaning head 104.

Figure 2:
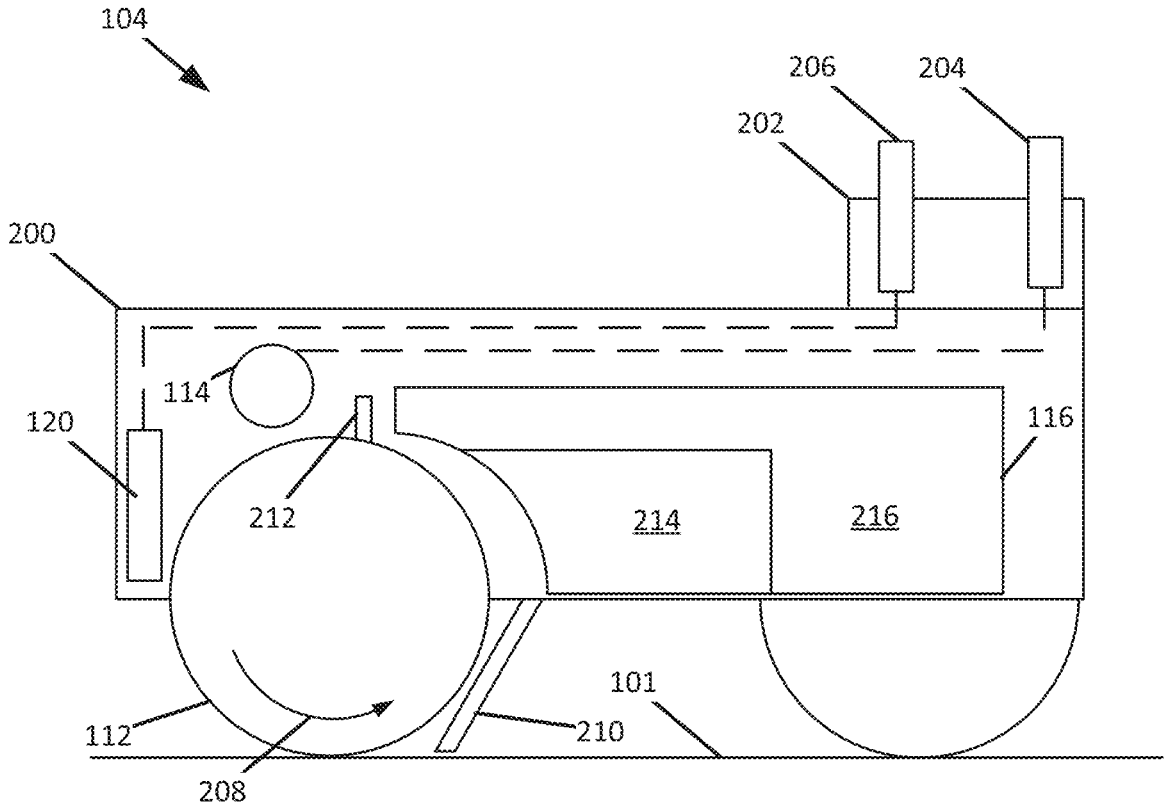
FIG. 2 shows a schematic cross-section view of a surface cleaning head of the surface cleaning device of FIG. 1, consistent with embodiments of the present disclosure.

FIG. 2 shows a schematic cross-sectional view of the surface cleaning head 104 of FIG. 1. As shown, the surface cleaning head 104 includes a head body 200 and a neck 202 pivotally coupled to the head body 200 such that the neck 202 is configured to pivot about one or more pivot axes. The neck 202 is configured to receive a portion of the upright section 102 to pivotally couple the upright section 102 to the surface cleaning head 104. The neck 202 may include one or more of electrical connectors 204 and/or fluid couplings 206. The one or more electrical connectors 204 may be configured to electrically couple the power supply 106 (FIG. 1) to the surface cleaning head 104 (e.g., to provide power to the agitator motor 114). The fluid couplings 206 may be configured to fluidly couple the fluid distributor 120 with the fluid reservoir 108 (FIG. 1) and/or the boiler 110 (FIG. 1). In some instances, one or more of the fluid reservoir 108 and/or the boiler 110 may be coupled to the neck 202.

The agitator motor 114 is configured to cause the one or more agitators 112 to rotate in a forward direction of rotation 208, wherein the forward direction of rotation 208 is configured to propel debris on the surface to be cleaned 101 in a direction of the debris container 116. A squeegee 210 may be configured to cooperate with at least one of the one or more agitators 112 to deliver debris into the debris container 116. For example, the squeegee 210 may be shaped and/or positioned such that the agitator 112 urges debris to move along the squeegee 210 and into the debris container 116. As such, at least a portion of the squeegee 210 extends between the surface to be cleaned 101 and the head body 200 and between at least a portion of the one or more agitators 112 and at least a portion of the debris container 116.

At least a portion of fluid distributed by the fluid distributor 120 may become absorbed within the one or more agitators 112. The absorbed fluid may have debris from the surface to be cleaned 101 entrained therein (which may be generally described as a dirty fluid). As such, it may be desirable to strip the absorbed fluid from the one or more agitators 112 periodically (e.g., with each complete rotation) in order to maintain a substantially consistent cleaning performance. For example, a fluid stripper 212 may be configured to cooperate with the one or more agitators 112 to transfer fluid from the one or more agitators 112 and into the debris container 116. In other words, the fluid stripper 212 may generally be described as being configured to remove at least a portion of the fluid absorbed in the one or more agitators 112.

As shown, the debris container 116 may include a solid debris chamber 214 configured to collect at least a portion of the solid debris (e.g., debris not capable of being entrained within the cleaning fluid) agitated from the surface to be cleaned 101 and a fluid debris chamber 216 configured to collect at least a portion of the fluid transferred from the one or more agitators 112 and into the debris container 116 (e.g., dirty fluid having debris entrained therein). Collection of solid debris separately from dirty fluid may allow solid debris to be emptied from the debris container 116 separately from collected dirty fluid. Such a configuration may make emptying the debris container 116 easier, potentially improving a user experience.

Figure 3A:
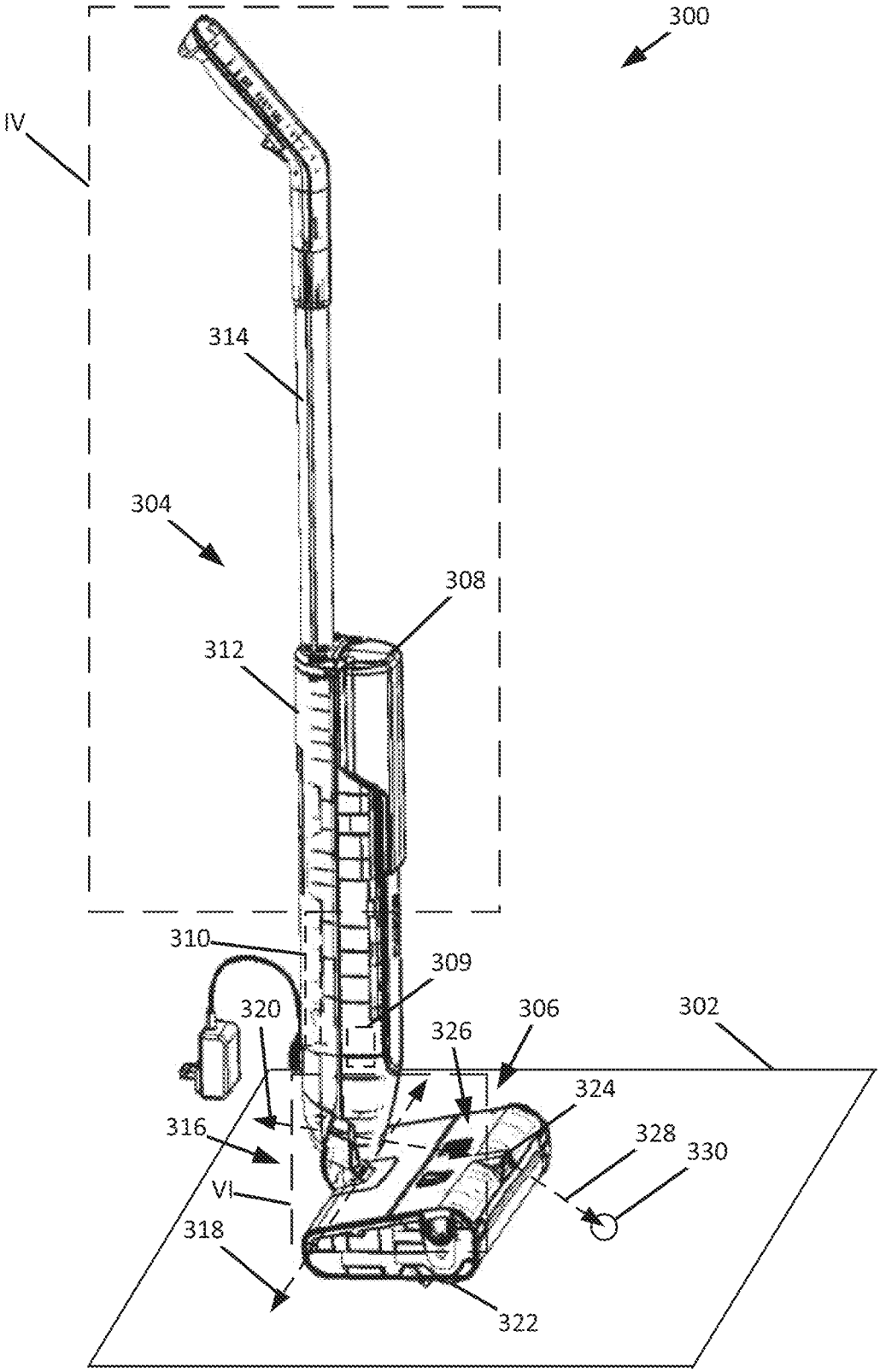
FIG. 3A shows a perspective view of a surface cleaning device, consistent with embodiments of the present disclosure.

FIG. 3A shows a perspective view of a surface cleaning device 300, which is an example of the surface cleaning device 100 of FIG. 1. The surface cleaning device 300 is configured to deliver cleaning fluid directly to the surface to be cleaned 302 and to collect debris and dirty fluid from the surface to be cleaned 302 without the use of suction.

As shown, the surface cleaning device 300 includes an upright section 304 and a surface cleaning head 306. The upright section 304 includes a fluid reservoir 308 configured to receive a cleaning fluid (e.g., water, a mixture of water and a cleaning chemical, and/or any other cleaning fluid), a power supply 310 (shown schematically in hidden lines), such as, for example, one or more batteries, an upright body 312, and a handle 314 removably coupled to the upright body 312. The fluid reservoir 308 may be removably coupled to the upright body 312 such that the fluid reservoir 308 may be more easily refilled by a user. Alternatively, the fluid reservoir 308 may be non-removably coupled to the upright body 312. A pump 309 (shown schematically in hidden lines) is fluidly coupled to the fluid reservoir 308 and configured to urge cleaning fluid from the fluid reservoir 308. The pump 309 may be disposed within the upright body 312.

The upright section 304 is pivotally coupled to the surface cleaning head 306 via a multi-axis pivot joint 316. The multi-axis pivot joint 316 is configured such that the upright section 304 pivots about at least a recline axis 318 and a side-to-side pivot axis 320, wherein the recline axis 318 extends substantially (e.g., within 1° of, 2° of, 3° of, 4° of, or 5° of) perpendicular to the side-to-side pivot axis 320. The upright section 304 is configured to pivot about the recline axis 318 to transition between a storage (or upright) position and an in-use (or reclined) position and the upright section 304 is configured to pivot about the side-to-side pivot axis 320 between a central position, a first side (e.g., leftward) position, and a second side (e.g., rightward) position (e.g., for purposes of maneuvering the surface cleaning device 300 along the surface to be cleaned 302).

The surface cleaning head 306 includes an agitator 322 (e.g., a brush roll) configured to agitate the surface to be cleaned 302, a spray nozzle 324 configured to distribute cleaning fluid to the surface to be cleaned 302, and a debris collection assembly 326. The spray nozzle 324 is configured to emit cleaning fluid along an emission axis 328 that intersects the surface to be cleaned 302 at an intersection point 330. The agitator 322 is disposed between the intersection point 330 and at least a portion of the debris collection assembly 326. In other words, the spray nozzle 324 is configured to emit cleaning fluid forward of the agitator 322.

Figure 3B:
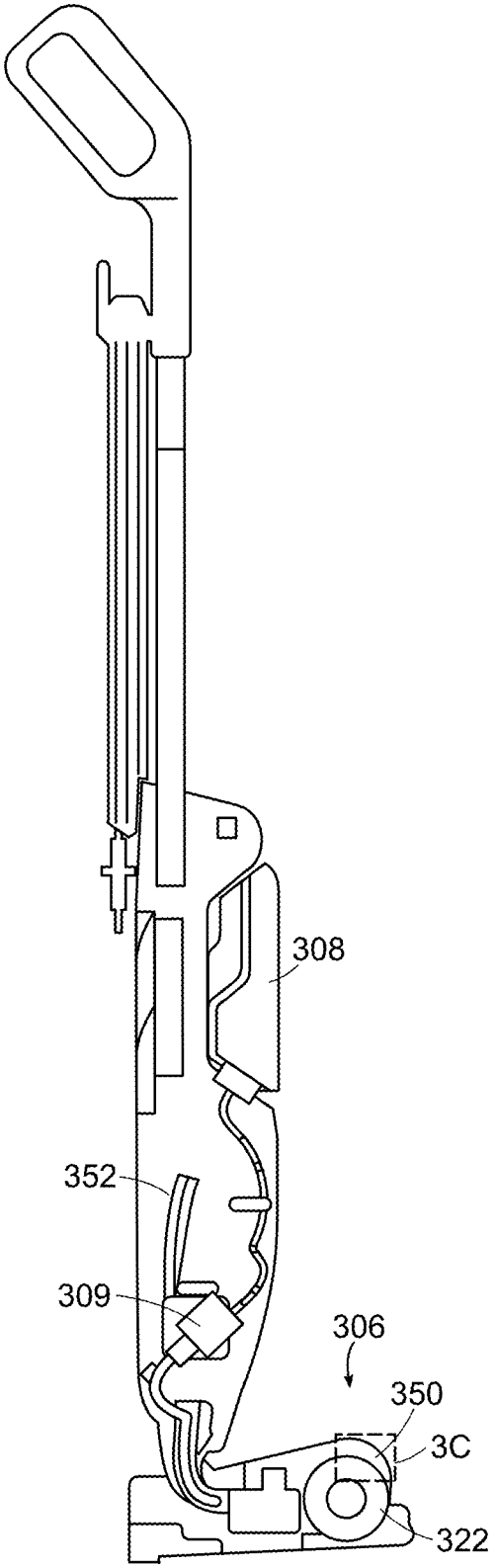
FIG. 3B shows a perspective cross-sectional view of an example of the surface cleaning device of FIG. 3A having a steam manifold, consistent with embodiments of the present disclosure.
Figure 3C:
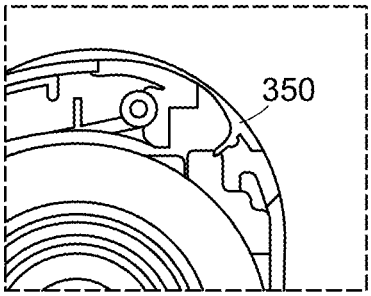
FIG. 3C shows magnified view of the surface cleaning device of FIG. 3B corresponding to region 3B, consistent with embodiments of the present disclosure.
Figure 3D:
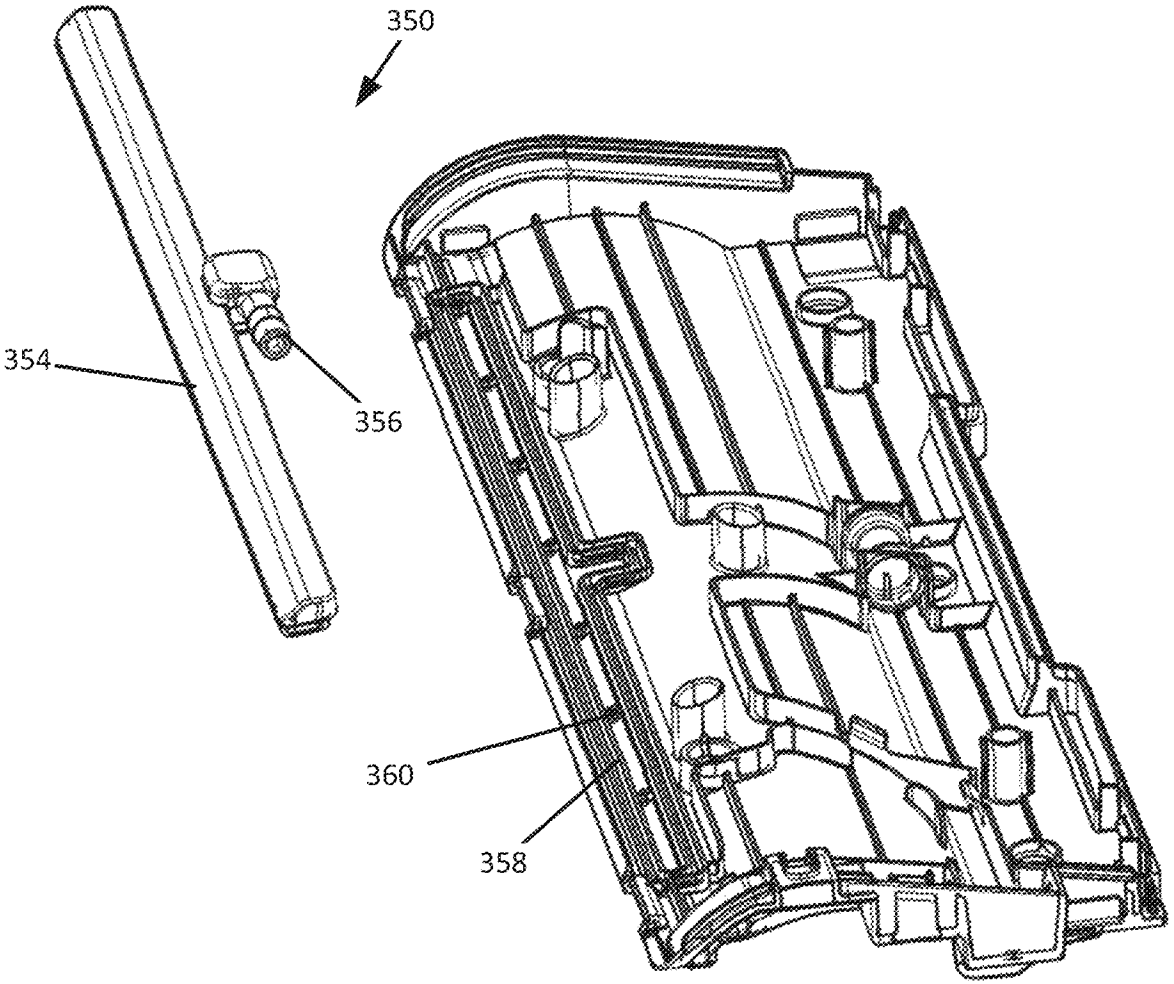
FIG. 3D shows an exploded view of the steam manifold of FIG. 3B, consistent with embodiments of the present disclosure.

In addition to, or in the alternative to, the spray nozzle 324 the surface cleaning head 306 may include a steam manifold. For example, and as shown in FIGS. 3B-3D, the surface cleaning head 306 includes a steam manifold 350 fluidly coupled to a boiler 352, the pump 309, and the fluid reservoir 308, wherein the steam manifold 350 delivers steam directly to the agitator 322 (e.g., at a location between a rotation axis of the agitator 322 and a forward most portion of the surface cleaning head 306). With reference to FIG. 3D, the steam manifold 350 may include a manifold cover 354 having a flow-path connector 356 configured to couple to, for example, a flexible tube and a steam delivery channel 358 having a plurality of delivery apertures 360 through which steam is able to pass.

Figure 4:
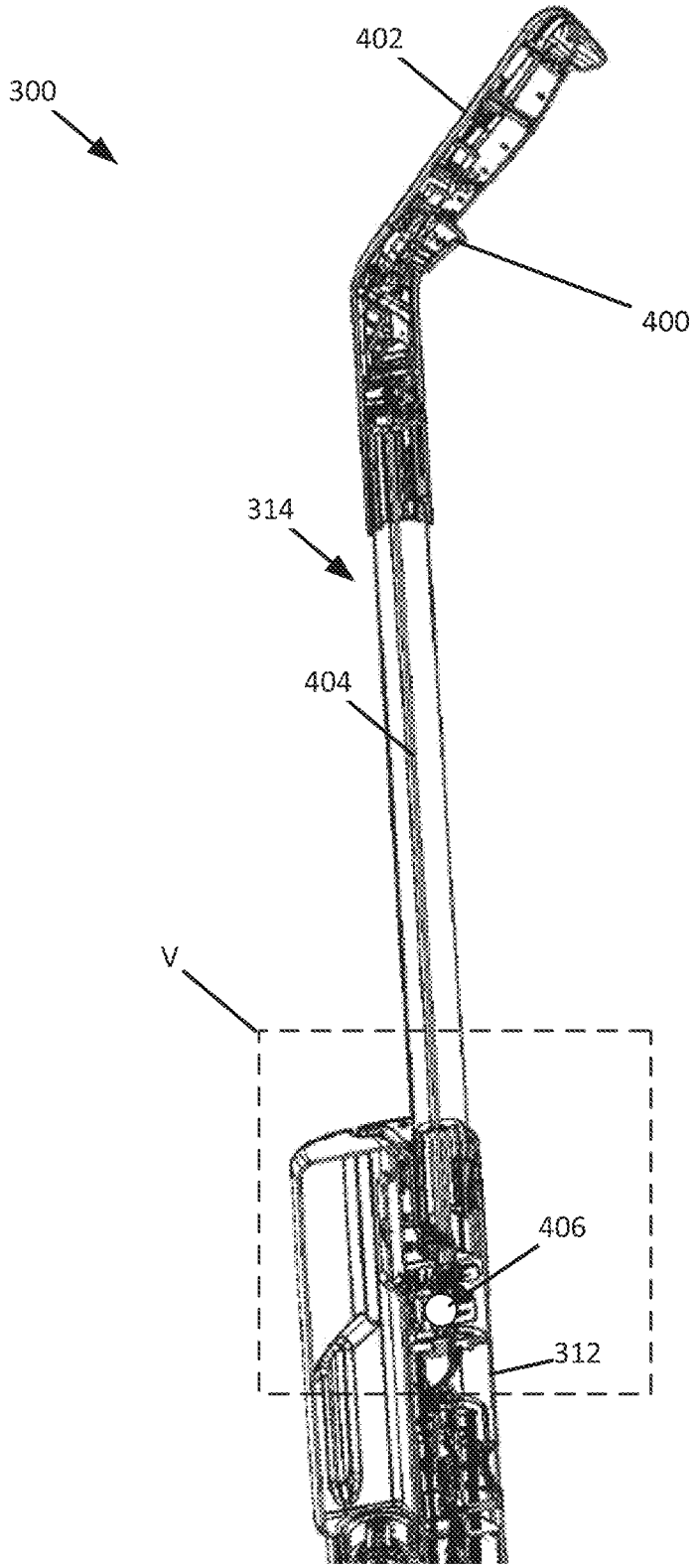
FIG. 4 shows a cross-sectional view of the surface cleaning device of FIG. 3A corresponding to region IV of FIG. 3, consistent with embodiments of the present disclosure.

FIG. 4 shows a cross-sectional view of the surface cleaning device 300 generally corresponding to region IV of FIG. 3. As shown, the handle 314 includes an actuator 400 pivotally coupled to the handle 314 at a hand grip 402. Pivotal movement of the actuator 400 (e.g., in response to a pulling motion of a user's finger) causes a drive shaft 404 to move (e.g., linearly). The drive shaft 404 is configured to actuate an electronic switch 406, shown schematically, (e.g., a push button, an optical break beam switch, a toggle switch, and/or any other electronic switch 406) disposed within the upright body 312. In other words, the actuator 400 and the drive shaft 404 may be generally described as providing a mechanical interface disposed within the removable handle 314 for actuating the electronic switch 406 within the upright body 312. The electronic switch 406 and the actuator 400 are disposed at opposing ends of the handle 314.

Actuation of the electronic switch 406 may cause the surface cleaning device 300 to operate according to one or more cleaning behaviors. For example, the electronic switch 406 may be configured such that actuation causes the cleaning fluid to be emitted from the spray nozzle 324 (FIG. 3A). In this example, the electronic switch 406 may cause the pump 309 (FIG. 3A) to be activated.

Figure 5B:
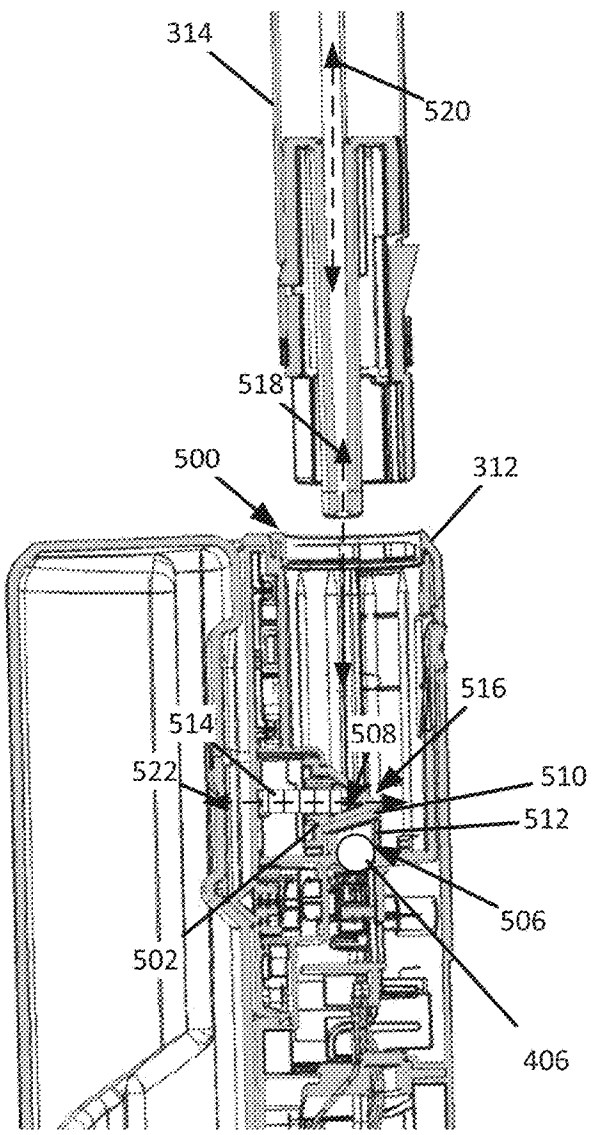
FIG. 5B shows another cross-sectional view of the surface cleaning device of FIG. 3A corresponding to region V of FIG. 4, consistent with embodiments of the present disclosure.
Figure 5A:
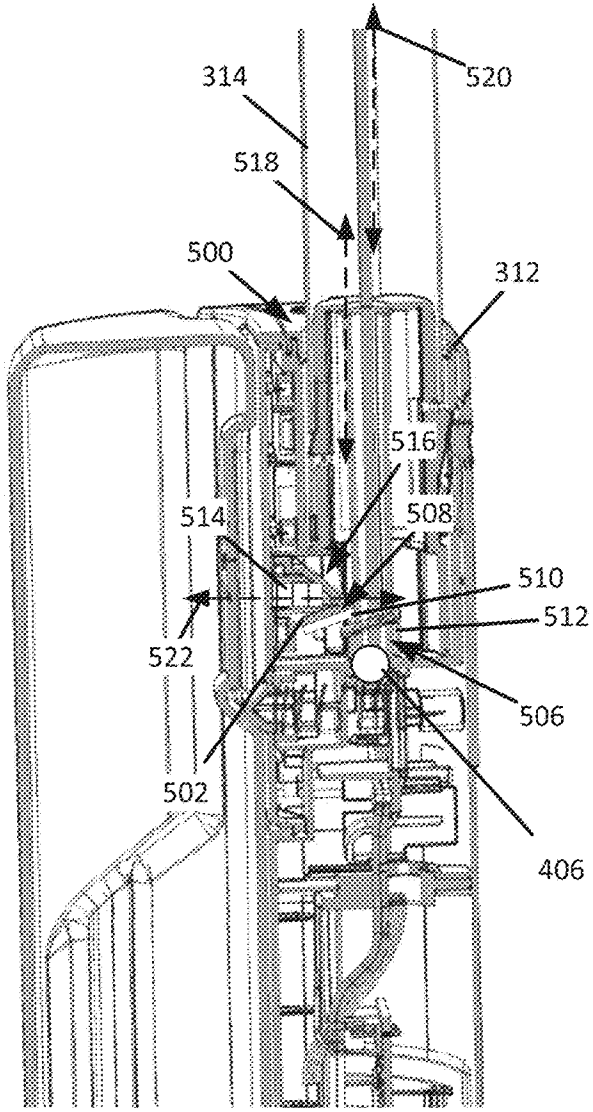
FIG. 5A shows a cross-sectional view of the surface cleaning device of FIG. 3A corresponding to region V of FIG. 4, consistent with embodiments of the present disclosure.

FIG. 5A shows a cross-sectional view generally corresponding to region V of FIG. 4 having the handle 314 coupled to the upright body 312 and FIG. 5B shows a cross-sectional view generally corresponding to region V of FIG. 4 having the handle 314 decoupled from the upright body 312.

As shown, the upright body 312 includes a handle receptacle 500 configured to selectively receive a portion of the handle 314. A depressible handle plunger 502 may be disposed within the handle receptacle 500, wherein the handle plunger 502 is configured to transition between a retracted state (FIG. 5A) and an extended state (FIG. 5B). The handle plunger 502 is configured to be transitioned to the retracted state in response to the handle 314 engaging the handle plunger 502 when the handle 314 is inserted into the handle receptacle 500. The handle plunger 502 is configured to be transitioned to the extended state in response to the handle 314 being removed from the handle receptacle 500. In other words, when the handle 314 is coupled to the upright body 312, the handle plunger 502 is in retracted state and, when the handle 314 is decoupled from the upright body 312, the handle plunger 502 is in the extended state.

When in the extended state, the handle plunger 502 may be configured to extend over at least a portion of a switch cavity 506, wherein the switch cavity 506 includes the electronic switch 406. In some instances, the handle plunger 502 may be configured to enclose (e.g., sealingly enclose) the switch cavity 506 when the handle plunger 502 is in the extended position. Such a configuration may mitigate (or prevent) an ingress of debris and/or fluid into the switch cavity 506 when the handle 314 is decoupled from the upright body 312, which may protect the electronic switch 406 from damage. In some instances, a cavity facing surface 508 of the handle plunger 502 may include a sealing material 510 (e.g., an elastomeric material) configured to form a seal with one or more sidewalls 512 forming the switch cavity 506. The sealing material 510 may be configured to form a seal that mitigates (e.g., prevents) the ingress of fluid and/or dust.

The handle plunger 502 may be biased towards the extended position such that, when the handle 314 is decoupled from the upright body 312, the handle plunger 502 automatically moves to the extended position. For example, a spring 514 (shown schematically) may be configured to urge the handle plunger 502 towards the extended position. Biasing the handle plunger 502 towards the extended position may also increase the stability of the handle 314 within the handle receptacle 500 as a result of the handle plunger 502 exerting a compressive force on a portion of the handle 314.

The handle plunger 502 may further include a handle engagement surface 516 that is generally opposite the cavity facing surface 508. The handle engagement surface 516 is configured to engage with the handle 314 as the handle 314 is being inserted into the handle receptacle 500. For example, the handle engagement surface 516 may extend transverse, at a non-perpendicular angle, to an insertion axis 518 of the handle receptacle. The insertion axis 518 extends substantially parallel to a longitudinal axis 520 of the handle 314. An actuation axis 522 along which the handle plunger 502 moves when transitioning between the retracted and extended states may extend substantially perpendicular to the insertion axis 518.

Figure 6:
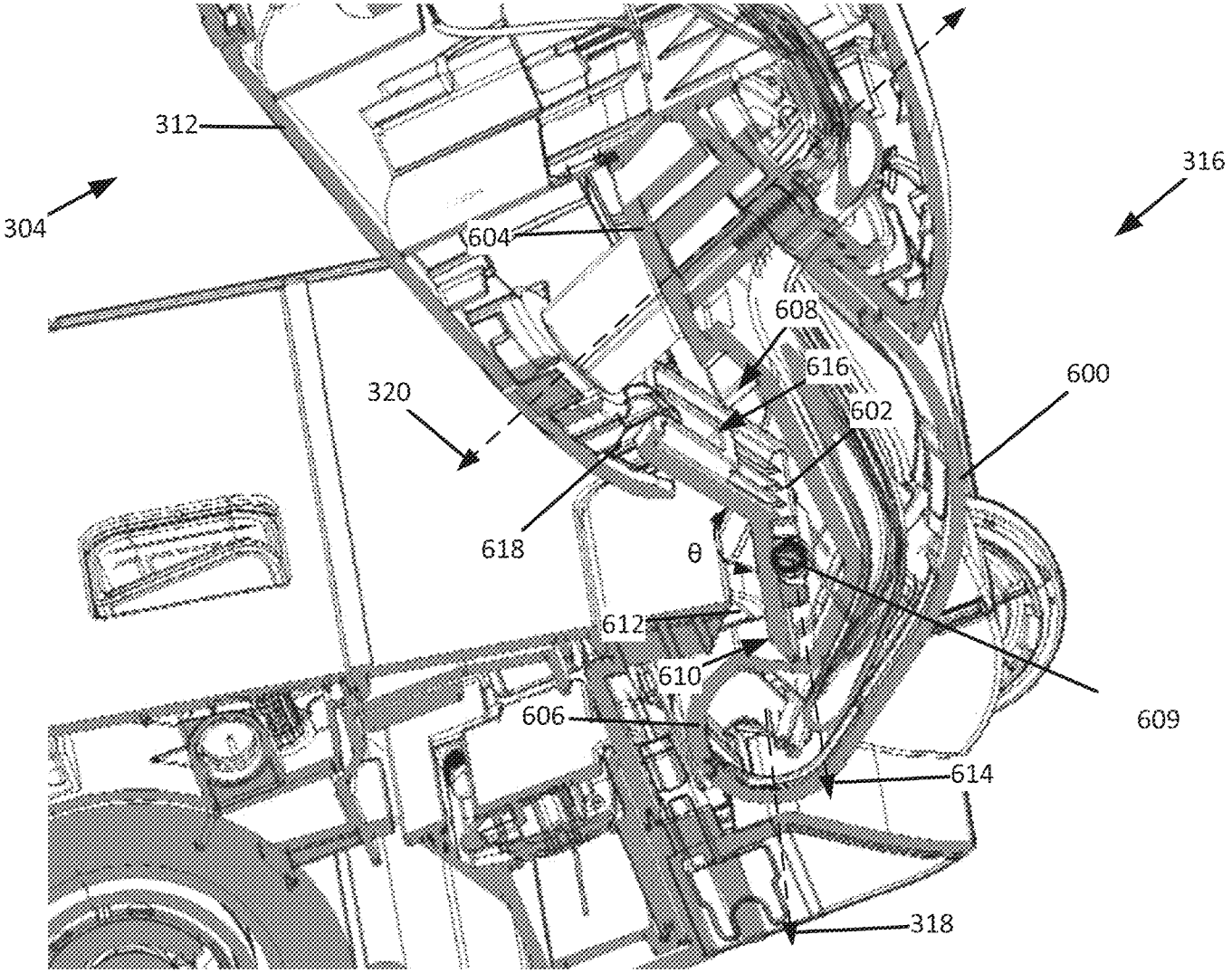
FIG. 6 shows a cross-section view of the surface cleaning device of FIG. 3A corresponding to region VI of FIG. 3, consistent with embodiments of the present disclosure.

FIG. 6 shows a cross-sectional view generally corresponding to region VI of FIG. 3A and shows a cross-section of the multi-axis pivot joint 316. As shown, the multi-axis pivot joint 316 includes a pivot body 600 and a paddle 602 pivotally coupled to the pivot body 600. The pivot body 600 includes a body pivot 604 and a head pivot 606 vertically spaced apart from the body pivot 604. The body pivot 604 pivotally couples to the upright body 312 such that the side-to-side pivot axis 320 extends through the body pivot 604. The head pivot 606 pivotally couples to the surface cleaning head 306 such that the recline axis 318 extends through the head pivot 606.

The paddle 602 is configured to pivot between a locked position and an unlocked position. When the paddle 602 is in the locked position, the upright section 304 is substantially prevented (e.g., less than 1°, less than 2°, less than 3°, less than 4°, less than 5°, or less than 10° of rotation in any one rotation direction) from pivoting about the side-to-side pivot axis 320. When the paddle 602 is in the unlocked position, the paddle 602 does not substantially interfere with side-to-side movement of the upright section 304 about the side-to-side pivot axis 320. The paddle 602 is configured to pivot between the locked and unlocked positions based on a rotational position of the upright section 304 about the recline axis 318. For example, when the upright section 304 is in the storage (or upright) position the paddle 602 may be in the locked position and, when the upright section 304 is in the in-use (or reclined) position, the paddle 602 may be in the unlocked position. The paddle 602 may be biased towards the unlocked position using, for example, a paddle biasing mechanism 609 (e.g., a spring such as torsion spring).

Figure 7:
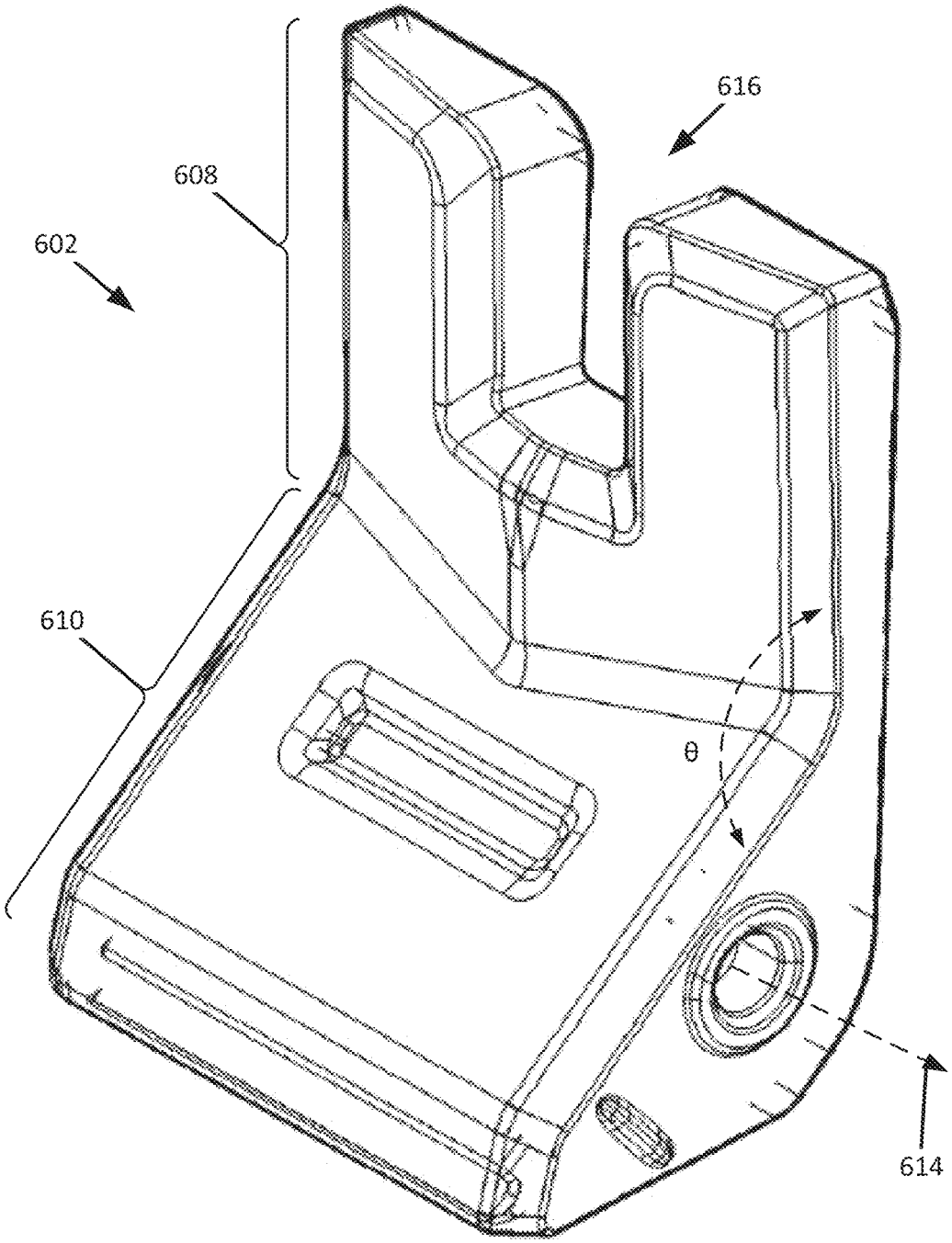
FIG. 7 shows a perspective view of a paddle of a multi-axis pivot joint of the surface cleaning device of FIG. 3, consistent with embodiments of the present disclosure.

With additional reference to FIG. 7 (which shows a perspective view of the paddle 602), the paddle 602 includes a retaining portion 608 and a triggering portion 610. The retaining portion 608 may be configured to engage with a portion of the upright body 312 and the triggering portion 610 may be configured to engage with a portion of the surface cleaning head 306. For example, the surface cleaning head 306 may include a paddle protrusion 612 configured to engage (e.g., contact) the triggering portion 610 of the paddle 602. When the upright section 304 is transitioned to the storage position, engagement between the paddle protrusion 612 and the triggering portion 610 may cause the paddle 602 to pivot about a paddle axis 614. Pivotal movement of the paddle 602 about the paddle axis 614 causes the retaining portion 608 of the paddle 602 to come into engagement with the upright body 312. As shown, the paddle 602 may include a retention cutout 616 configured to receive a retention protrusion 618 of the upright body 312. The retention cutout 616 and the retention protrusion 618 cooperate to restrict (e.g., prevent) pivotal movement of the upright section 304 about the side-to-side pivot axis 320. In other words, the retaining portion 608 may be configured to selectively engage a portion of the upright body 312 (e.g., the retention protrusion 618) to substantially prevent the upright section 304 from pivoting about the side-to-side pivot axis 320.

The retaining portion 608 and the triggering portion 610 of the paddle 602 may form a paddle angle θ that opens in a direction facing the surface cleaning head 306. The paddle angle θ may be, for example, 90° or greater.

Figure 8:
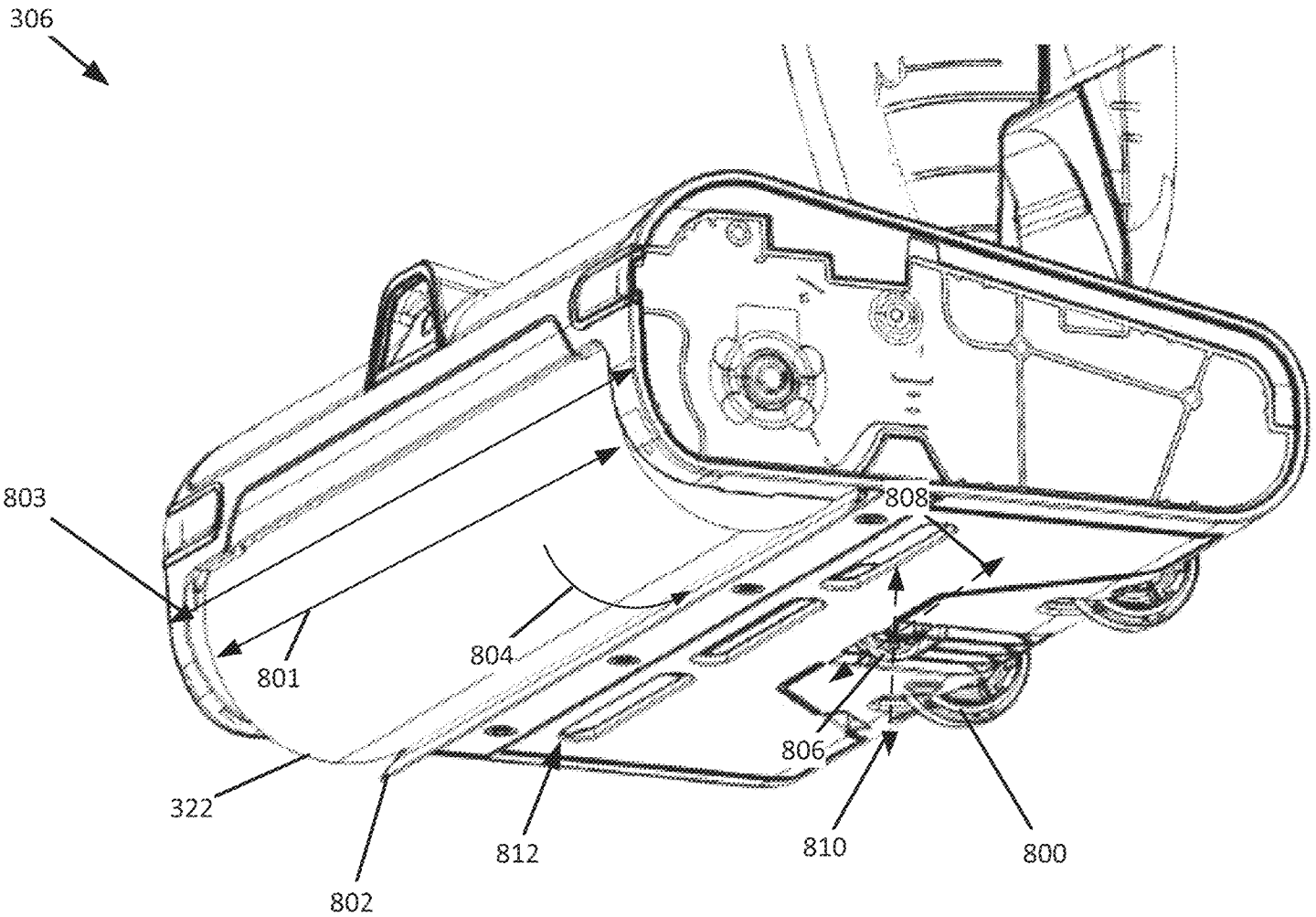
FIG. 8 shows a bottom perspective view of a surface cleaning head of the surface cleaning device of FIG. 3, consistent with embodiments of the present disclosure.

FIG. 8 shows a bottom perspective view of the surface cleaning head 306. As shown, the surface cleaning head 306 includes a plurality of support wheels 800 and a squeegee 802, wherein the squeegee 802 is disposed between at least a portion of the agitator 322 and the support wheels 800. The squeegee 802 may extend along substantially (e.g., at least 90%, at least 95%, at least 97%, at least 99%) an entire longitudinal length 801 of the agitator 322 or substantially an entire width 803 of the surface cleaning head 306.

In operation, the agitator 322 is configured to cooperate with the squeegee 802 to urge debris into the debris collection assembly 326 (FIG. 3A). For example, the agitator 322 may be configured to rotate according to a forward direction of rotation 804, wherein the forward direction of rotation 804 is configured to urge solid debris to move along the squeegee 802 and into the debris collection assembly 326. As also shown, the surface cleaning head 306 may further include an auxiliary wheel 806. The auxiliary wheel 806 may be configured to rotate about an auxiliary wheel rotation axis 808 and, in some instances, move linearly along an actuation axis 810.

As also shown in FIG. 8, the surface cleaning head 306 may include one or more drain holes 812. The drain holes 812 may be configured to drain fluid trapped within the surface cleaning head 306. For example, the drain holes 812 may be disposed generally below at least a portion of the debris collection assembly 326.

Figure 9A:
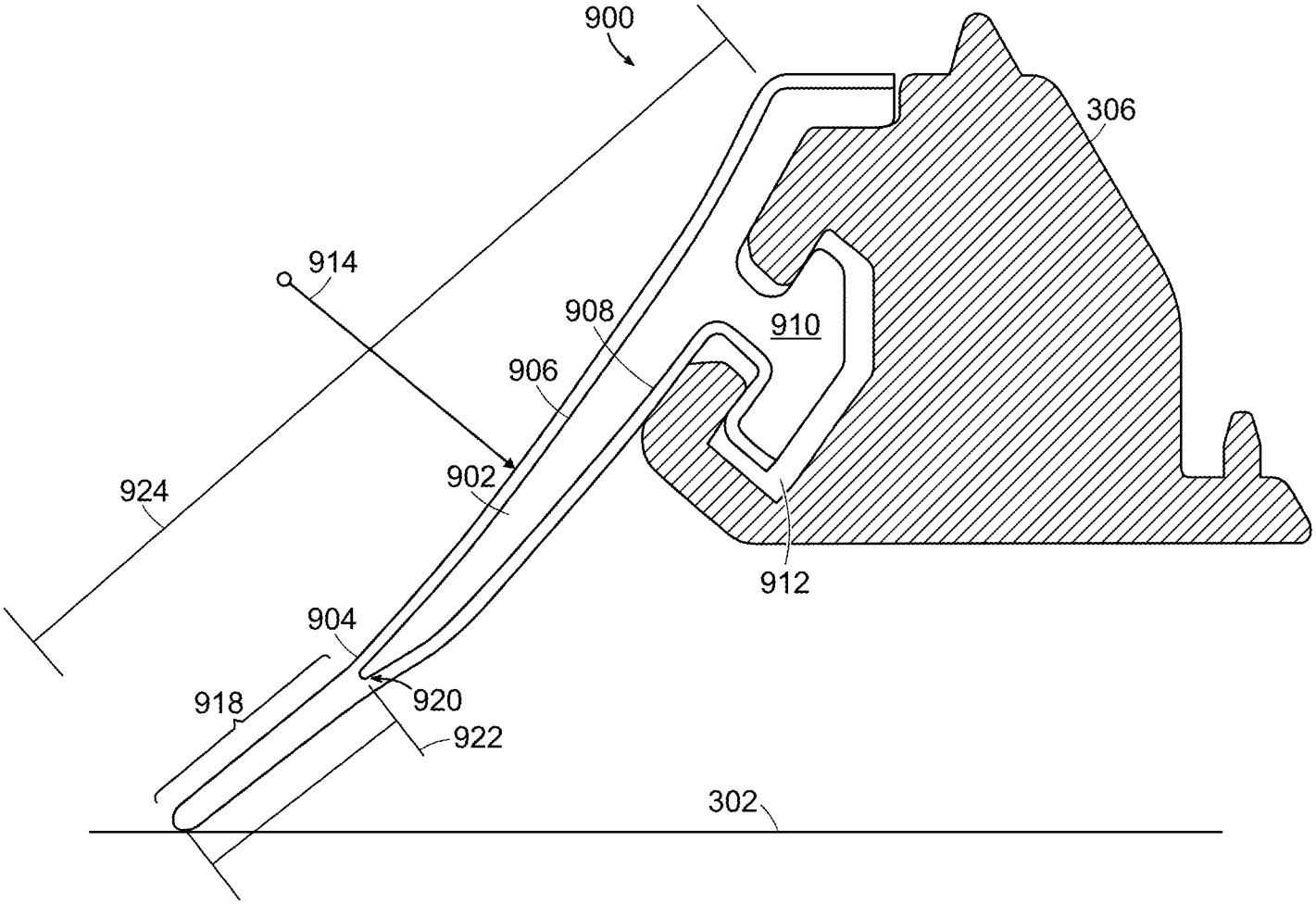
FIG. 9A shows a cross-sectional view of an example of a squeegee configured to be used with the surface cleaning head of FIG. 8, consistent with embodiments of the present disclosure.

FIG. 9A shows a cross-sectional view of a squeegee 900, which is an example of the squeegee 802 of FIG. 8. As shown, the squeegee 900 includes a squeegee core 902 and a squeegee cover 904. The squeegee core 902 includes an agitator facing side 906 and a mounting side 908 generally opposite the agitator facing side 906. The mounting side 908 may include mounting protrusion 910 configured to couple the squeegee 900 with the surface cleaning head 306. For example, the protrusion 910 may be keyed to be received within a corresponding slot 912 of the surface cleaning head 306. The squeegee cover 904 may extend along at least a portion of the squeegee core 902. For example, the squeegee cover 904 may extend along a substantial portion (e.g., at least 70%, at least 80%, at least 85%, at least 90%, at least 95%, at least 99%, or 100%) of one or more of the agitator facing side 906 and/or the mounting side 908.

Figure 9B:
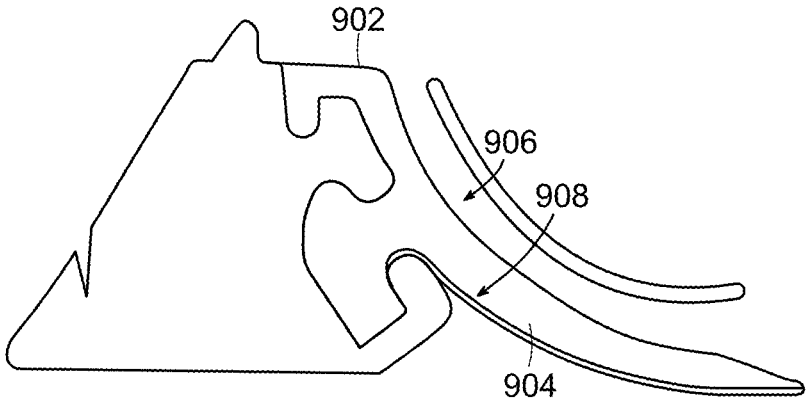
FIG. 9B shows a cross-sectional view of another example of a squeegee configured to be used with the surface cleaning head of FIG. 8, consistent with embodiments of the present disclosure.

The squeegee core 902 and the squeegee cover 904 may be made of different materials. For example, the squeegee core 902 may be made of an elastomeric material (e.g., a natural or synthetic rubber, silicone, and/or any other elastomeric material) and the squeegee cover 904 may be a fabric material (e.g., a cloth material, a carbon fiber woven material, an aramid woven material, a polyester material such as polyethylene terephthalate, and/or any other fabric material). One example fabric material may have a thickness in a range of about 0.4 millimeters (mm) to about 0.45 mm, a yarn diameter in a range of about 0.28 mm to about 0.32 mm, and/or a pull force of about 7.23 grams (g) per yarn. The squeegee cover 904 may have a lower coefficient of friction than the squeegee core 902. Such a configuration may allow the squeegee 900 to have similar mechanical properties to the material forming the squeegee core 902 while allowing the squeegee to have a lower friction coefficient. A lower friction coefficient for the surface of the squeegee 900 in contact with debris may improve debris collection (e.g., by making movement of debris along the squeegee 900 by the agitator 322, FIG. 3A, easier). Similarly, a lower friction coefficient for the surface of the squeegee 900 in contact with the surface to be cleaned 302 may improve movement of the squeegee 900 along the surface to be cleaned 302 (e.g., by reducing squeaking noises as a result of the sliding contact between the squeegee 900 and the surface to be cleaned 302). In some instances (see, e.g., FIG. 9B), the squeegee cover 904 may extend over at least a portion of the mounting side 908 of the squeegee core 902 without extending along the agitator facing side 906 of the squeegee core 902 (e.g., to mitigate an effect of friction between the squeegee 900 and the surface to be cleaned 302.

Figure 9C:
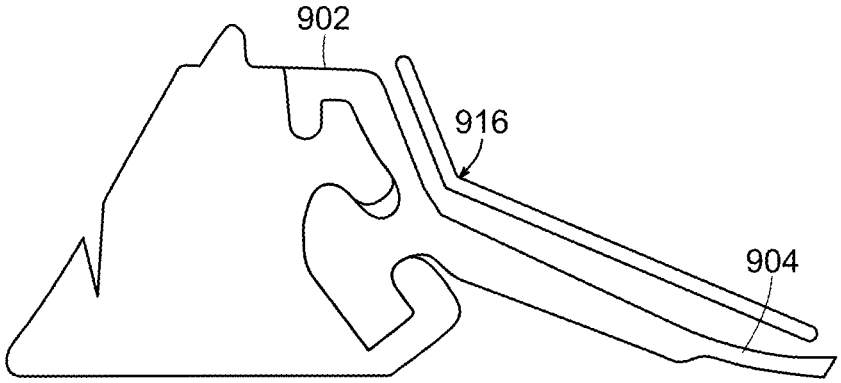
FIG. 9C shows a cross-sectional view of another example of a squeegee configured to be used with the surface cleaning head of FIG. 8, consistent with embodiments of the present disclosure.

The squeegee 900 may have an arcuate shape, a planar shape, and/or any other shape. For example, when the squeegee 900 has an arcuate shape, the squeegee 900 may have an arc radius 914 in a range of 15 millimeters (mm) to 45 mm. By way of further example, when the squeegee 900 has an arcuate shape, the arc radius 914 may be in a range of 25 mm to 35 mm. By way of still further example, when the squeegee 900 has an arcuate shape, the arc radius 914 may be about (e.g., within 1% of, 2% of, 3% of, 4% of, or 5% of) 30 mm. In some instances, the arc radius 914 may be selected to minimize a separation distance between the agitator 322 and the squeegee 900. As shown in FIG. 9C, in some instances, the squeegee 900 may have one or more planar surfaces that meet at an intersection point 916.

The squeegee cover 904 may include an engagement region 918 that extends beyond a distal end 920 of the squeegee core 902. The engagement region 918 may be configured to engage with the surface to be cleaned 302. The engagement region 918 has an engagement region extension distance 922. The engagement region extension distance 922 may be, for example, at least 5% and less than 25% of a total squeegee extension distance 924. In some instances, the engagement region 918 may be generally described as forming a selvage.

Figure 9D:
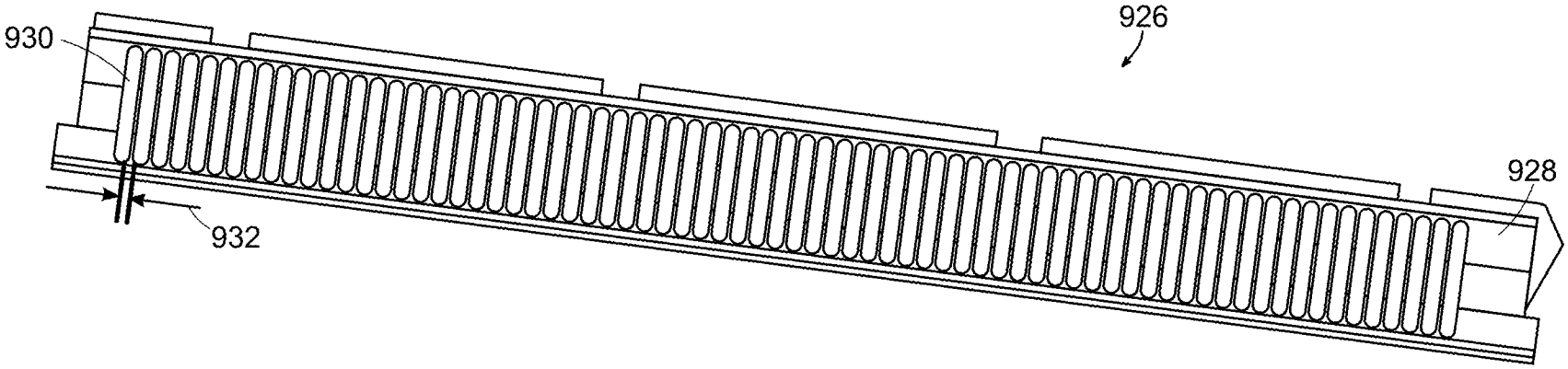
FIG. 9D shows a perspective view of another example of a squeegee configured to be used with the surface cleaning head of FIG. 8, consistent with embodiments of the present disclosure.

FIG. 9D shows a perspective view of a squeegee 926, which is another example of the squeegee 802 of FIG. 8. As shown, the squeegee 926 includes a squeegee body 928 having a plurality of spaced apart raised ribs 930 formed on an agitator facing side of the squeegee 926. The plurality of raised ribs 930 are spaced apart by a rib separation distance 932. The rib separation distance 932 may be the same or different for each set of immediately adjacent raised ribs 930. At least a portion of one or more of the raised ribs 930 may come into engagement with the agitator 322 (FIG. 3A). In operation, the ribs 930 may reduce a surface area of the squeegee 926 with which debris contacts.

Figure 9E:
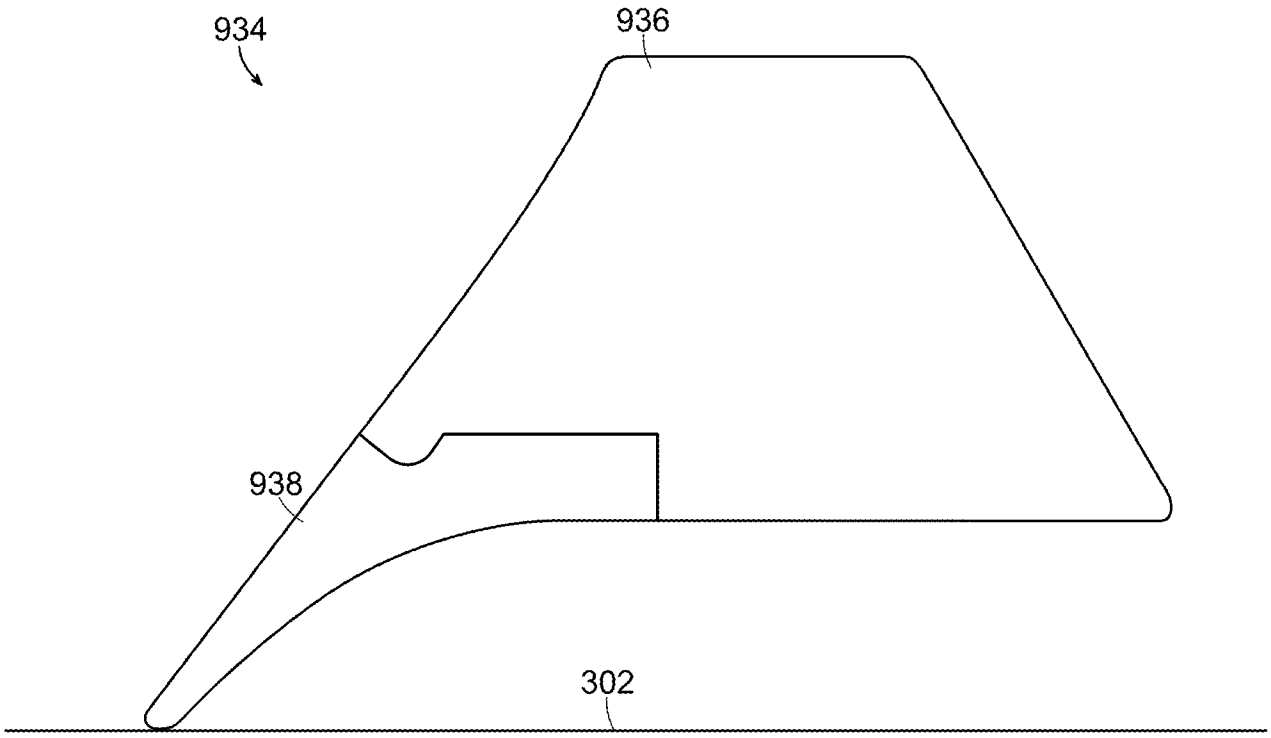
FIG. 9E shows a cross-sectional view of another example of a squeegee configured to be used with the surface cleaning head of FIG. 8, consistent with embodiments of the present disclosure.

FIG. 9E shows a perspective view of a squeegee 934, which is another example of the squeegee 802 of FIG. 8. As shown, the squeegee 934 includes a rigid portion 936 (e.g., a plastic body) and a flexible portion 938 (e.g., an elastomeric body). The rigid portion 936 may be configured to couple to the surface cleaning head 306 (FIG. 3A) and the flexible portion 938 may be configured to engage the surface to be cleaned 302. The flexible portion 938 may be overmolded onto the rigid portion 936 to form the squeegee 934.

Figure 9F:
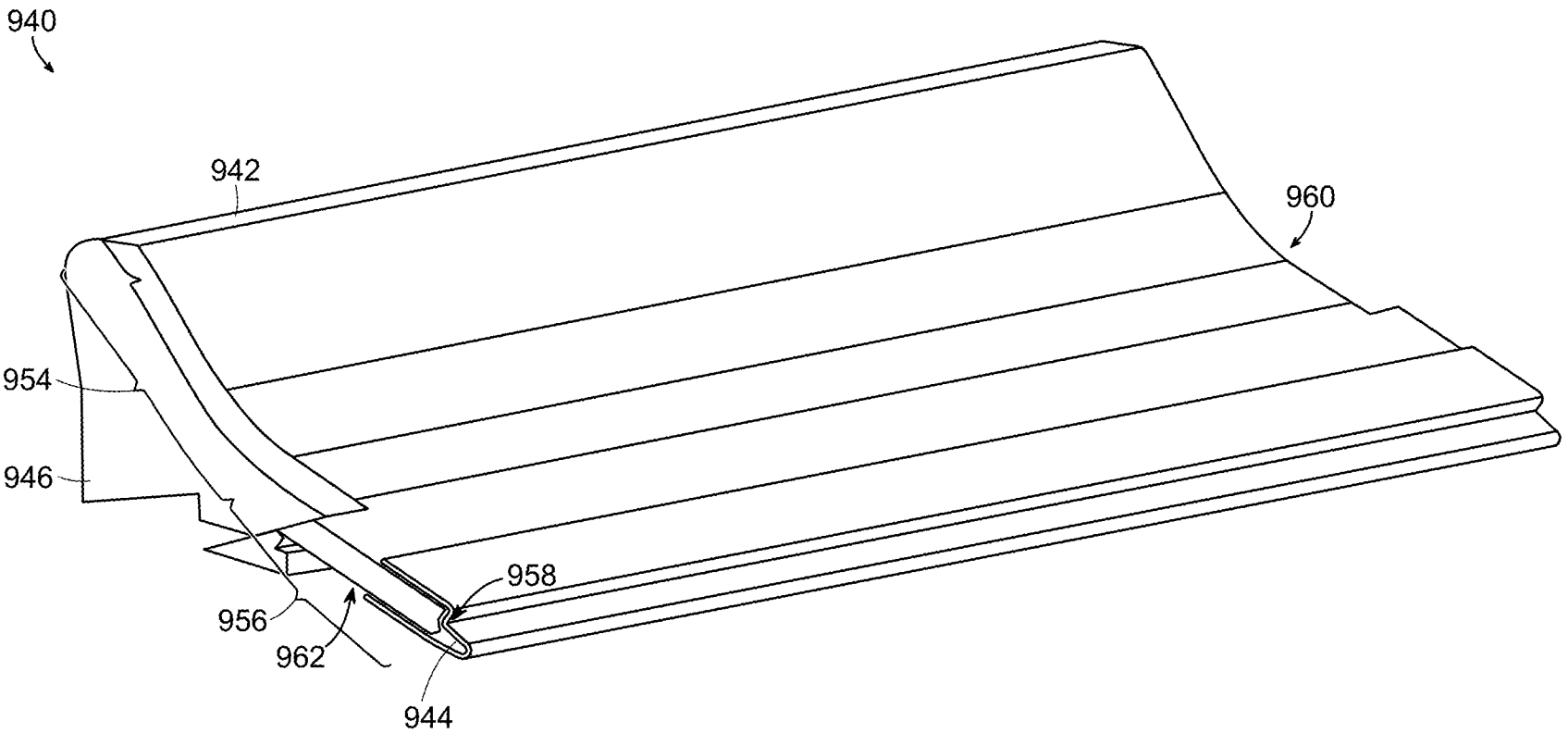
FIG. 9F shows a perspective view of another example of a squeegee configured to be used with the surface cleaning head of FIG. 8, consistent with embodiments of the present disclosure.
Figure 9I:
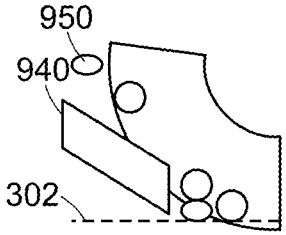
FIG. 9I shows a schematic view of the squeegee of FIG. 9G, consistent with embodiments of the present disclosure.
Figure 9G:
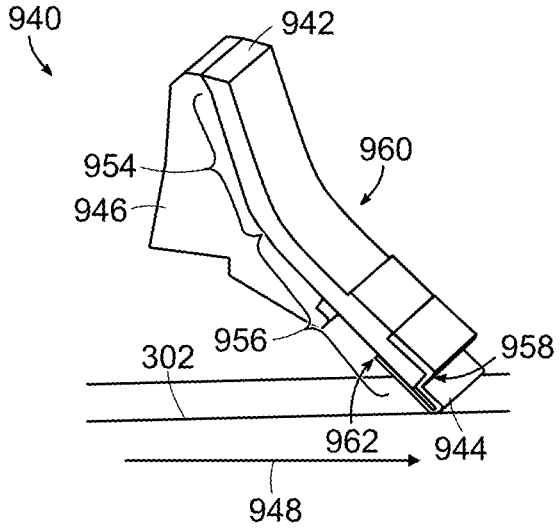
FIG. 9G shows another perspective view of the squeegee of FIG. 9F moving relative to a surface to be cleaned according to a forward stroke, consistent with embodiments of the present disclosure.
Figure 9H:
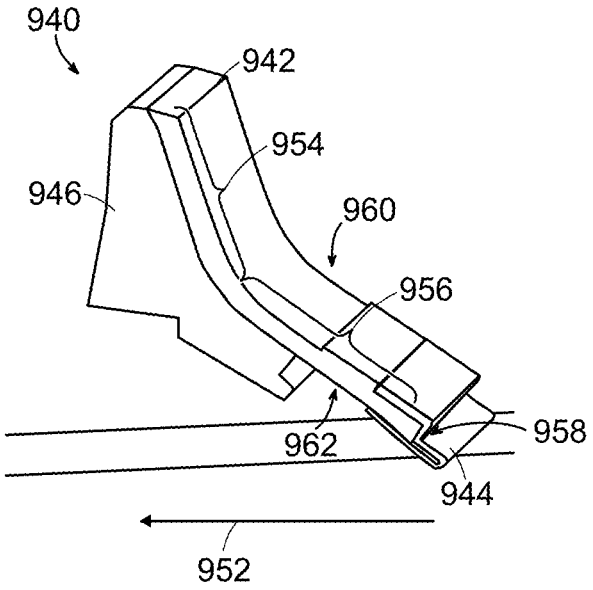
FIG. 9H shows another perspective view of the squeegee of FIG. 9F moving relative to a surface to be cleaned according to a reverse stroke, consistent with embodiments of the present disclosure.

FIGS. 9F-9H show perspective view of a squeegee 940, which is another example of the squeegee 802 of FIG. 8. As shown, the squeegee 940 includes a flexible body 942, a leading edge 944, and a frame 946. The flexible body 942 is coupled to the frame 946 and the leading edge 944 is coupled to the flexible body 942 such that the leading edge 944 comes into engagement with the surface to be cleaned 302. The frame 946 may be configured to couple the squeegee 940 to the surface cleaning head 306. The frame 946 may be constructed of a material that is more rigid than the flexible body 942, which allows the flexible body 942 to flex relative to the frame 946 as the surface cleaning head 306 moves along the surface to be cleaned 302.

Figure 9J:
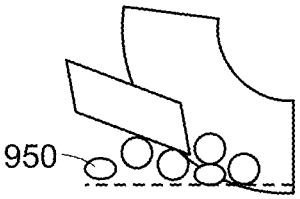
FIG. 9J shows a schematic view of the squeegee of FIG. 9H, consistent with embodiments of the present disclosure.

The leading edge 944 may include a material having a lower friction coefficient than the flexible body 942. Such a configuration may allow the squeegee 940 to move more easily along the surface to be cleaned 302. With reference to FIG. 9G, on a forward stroke (or movement direction) 948, the leading edge 944 may be configured to cooperate with the flexible body 942 to guide debris into the debris collection assembly 326 (FIG. 3A). FIG. 9I shows a schematic representation of the squeegee 940 configured to guide solid debris 950 (e.g., sand) into the debris collection assembly 326 on the forward stroke 948. With reference to FIG. 9H, on a reverse stroke (or movement direction) 952 the leading edge 944 may be configured to cooperate with the flexible body 942 such that debris passes under the squeegee 940 such that the agitator 322 (FIG. 3A) can urge the debris into the debris collection assembly 326. FIG. 9J shows a schematic representation of the squeegee 940 configured to allow the solid debris 950 to pass underneath the squeegee on the reverse stroke 952. When the leading edge 944 has a lower coefficient of friction than the flexible body 942, the leading edge 944 may encourage a bending of the flexible body 942 to encourage debris to pass under the squeegee 940 on the reverse stroke 952. Further, a lower coefficient of friction may reduce a quantity of debris that sticks to the leading edge 944.

As shown, the flexible body 942 includes an upper portion 954 configured to couple to the frame 946 and a lower portion 956, wherein at least a portion of the lower portion 956 is configured to extend (e.g., in a cantilevered fashion) from the frame 946. The leading edge 944 may be coupled to the lower portion 956 of the flexible body 942 and extend along a distal edge 958 of the lower portion 956. Such a configuration may encourage flexing of the flexible body 942 as the surface cleaning head 306 moves along the surface to be cleaned 302. In some instances, a portion of the leading edge 944 may extend along an agitator facing surface 960 and/or a surface to be cleaned facing surface 962.

The flexible body 942 may include silicone, thermoplastic elastomer (TPE), and/or any other flexible material. The leading edge 944 may include polytetrafluoroethylene (PTFE), one commercial example of which is Teflon brand PTFE, which is marketed by The Chemours Company, woven nylon, and/or any other material (e.g., having a lower coefficient of friction than the flexible body 942).

Figure 9K:
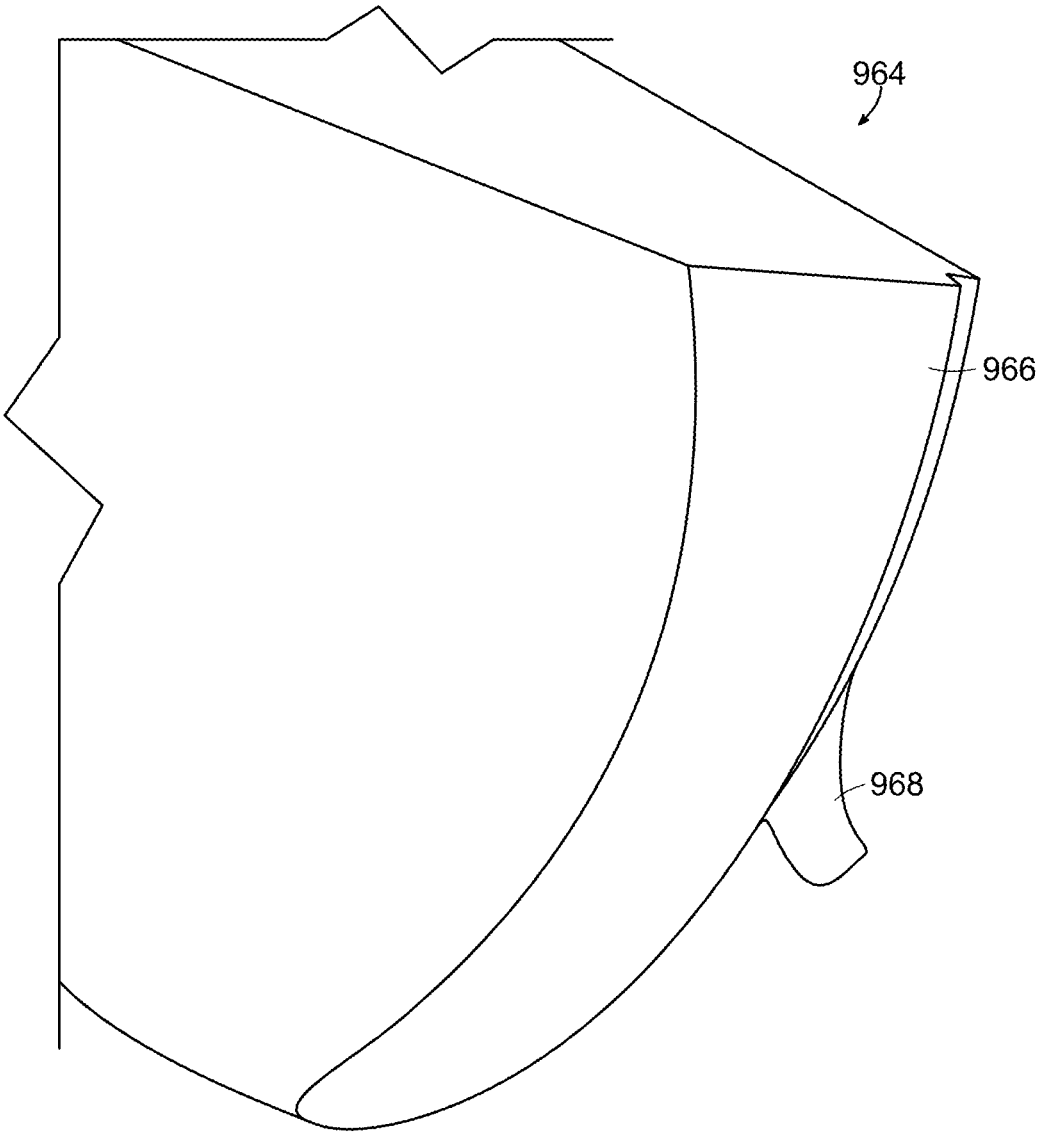
FIG. 9K shows a schematic view of another example of a squeegee, consistent with embodiments of the present disclosure.

FIG. 9K shows a schematic example a squeegee 964, which is another example of the squeegee 802 of FIG. 8. As shown, the squeegee 964 includes a squeegee ramp 966 configured to face the agitator 322 (FIG. 3A) and a surface wiper 968 configured to move along the surface to be cleaned 302 (FIG. 3A). The ramp 966 is configured to cooperate with the agitator 322 to urge debris into the debris collection assembly 326 (FIG. 3A). As shown, at least a portion of the ramp 966 is positioned between the agitator 322 and the surface wiper 968. In other words, at least a portion of the ramp 966 is positioned forward of the surface wiper 968.

Figure 10:
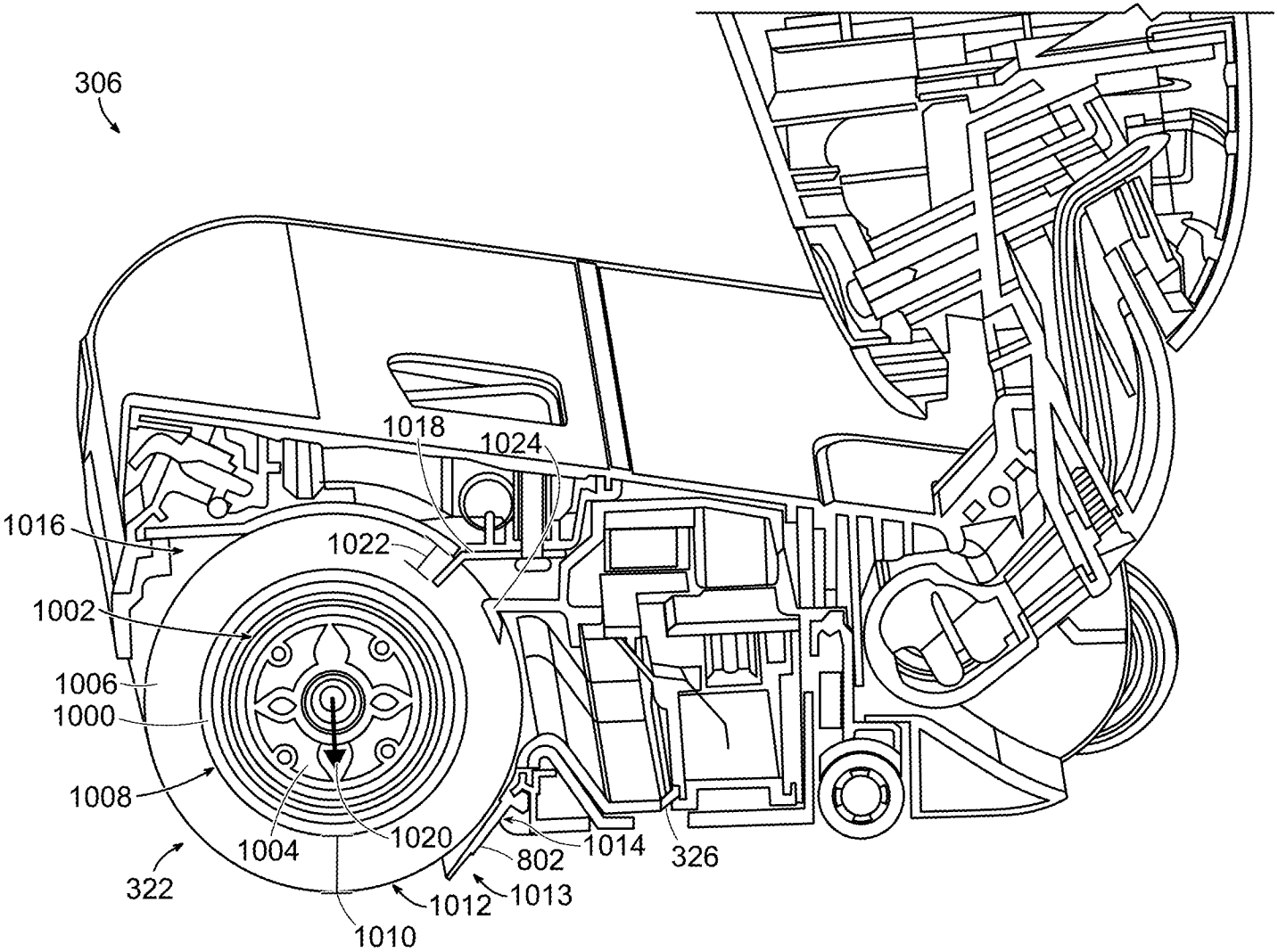
FIG. 10 shows a cross-sectional perspective view of the surface cleaning head of FIG. 8, consistent with embodiments of the present disclosure.

FIG. 10 shows a cross-sectional perspective view of the surface cleaning head 306 of FIG. 3. As shown, the agitator 322 cooperates with the squeegee 802 to encourage debris (e.g., solid debris) to be collected within the debris collection assembly 326. The agitator 322 may include an agitator body 1000, a motor cavity 1002 defined within the agitator body 1000 configured to receive at least a portion of an agitator motor 1004, and an agitation material 1006 extending from (e.g., coupled to) an outer surface 1008 of the agitator body 1000. The agitation material 1006 may have a material thickness 1010 that extends from the outer surface 1008 of the agitator body 1000 to a distal most portion 1012 of the agitation material 1006 in a range of, for example, about 10 mm to about 14 mm. By way of further example, the material thickness 1010 may be in a range of about 8 mm to about 12 mm. The material thickness 1010 may be selected based, at least in part, on an intended debris size to be collected. The agitation material 1006 may include any one or more of microfiber, bristle tufts, bristle strips, elastomeric flaps, fabric, and/or any other agitation material.

The agitator 322 may be tangent to, spaced apart from, or overlapping with the squeegee 802 when dry and/or when wet. In some instances, at least a portion of the squeegee 802 may be in contact with the agitator 322 when the surface cleaning head 306 rests on the surface to be cleaned 302 (FIG. 3A). For example, a distal end region 1013 of the squeegee 802 that is proximate (e.g., a distance within 1% of, 2% of, 3% of, 4% of, 5% of, or 10% of a maximum dimension of the squeegee 802) to the surface to be cleaned 302 may come into contact with the agitator 322 when the surface cleaning head 306 rests on the surface to be cleaned 302. By way of further example, at least a portion of a middle region 1014 of the squeegee 802 (e.g., a region extending between distal ends of the squeegee 802) may come into contact with the agitator 322 when the surface cleaning head 306 rests on the surface to be cleaned 302.

As shown, the surface cleaning head 306 further includes an agitation chamber 1016 within which the agitator 322 rotates and a fluid stripper 1018 configured to extend into the agitation material 1006. The fluid stripper 1018 is configured to contact the agitation material 1006 in order remove at least a portion of any fluid absorbed within the agitation material 1006. The removed fluid is transferred to the debris collection assembly 326. In other words, the fluid stripper 1018 may be generally described as being configured to transfer fluid from the agitator 322 to the debris collection assembly 326.

The fluid stripper 1018 may be disposed within the agitation chamber 1016 such that a rotation axis 1020 of the agitator 322 is disposed between the surface to be cleaned 302 and the fluid stripper 1018. Additionally, or alternatively, the fluid stripper 1018 may be disposed within the agitation chamber 1016 such that the fluid stripper 1018 is between the rotation axis 1020 of the agitator 322 and at least a portion of the debris collection assembly 326.

The fluid stripper 1018 may extend into the agitation material 1006 by an extension distance 1022. The extension distance 1022 may be, for example, 5% of the material thickness 1010 of the agitation material 1006 to 95% of the material thickness 1010. By way of further example, the extension distance 1022 may be in a range of 25% of the material thickness 1010 to 85% of the material thickness 1010. By way of still further example, the extension distance 1022 may be in a range of 60% of the material thickness 1010 to 95% of the material thickness 1010.

In some instances, the surface cleaning head 306 may further include a debris stripper 1024. The debris stripper 1024 is configured to strip solid debris from the agitator 322. The debris stripper 1024 may be positioned forward of the fluid stripper 1018 (relative to the forward direction of 804, FIG. 8) such that the agitator 322 rotates the agitation material 1006 into contact with the debris stripper 1024 before the fluid stripper 1018 during operation. In other words, a used (or dirty) portion of the agitator 322 contacts the debris stripper 1024 before contacting the fluid stripper 1018.

Figure 11:
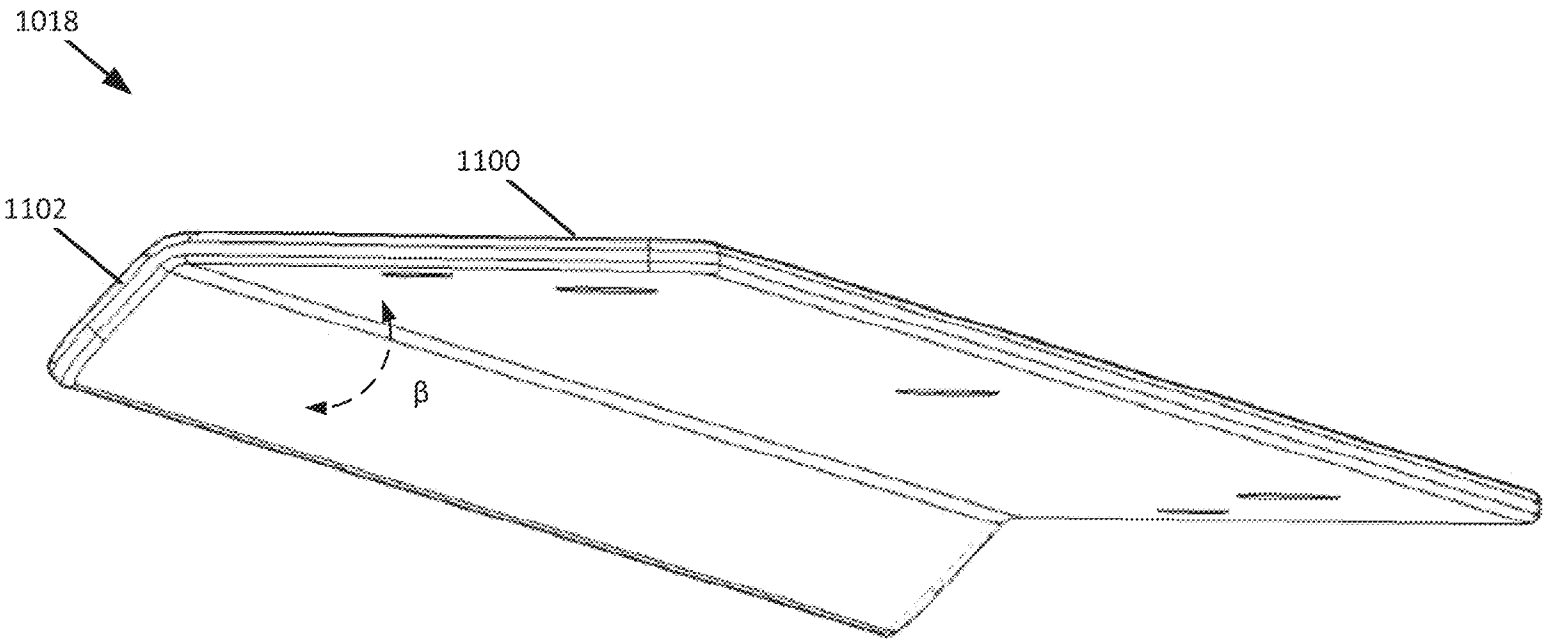
FIG. 11 shows a perspective view of a fluid stripper, consistent with embodiments of the present disclosure.

FIG. 11 shows a perspective view of the fluid stripper 1018 of FIG. 10. As shown, the fluid stripper 1018 includes a mounting region 1100 and a stripping region 1102. The stripping region 1102 may extend from the mounting region 1100 according to a fluid stripper angle β. The fluid stripper angle β may be an obtuse angle that opens in a direction of the surface to be cleaned 302 (FIG. 3A). The fluid stripper 1018 may be formed, at least partially of, a plastic (e.g., Acrylonitrile Butadiene Styrene, "ABS"), a metal (e.g., a stainless steel alloy, an aluminum alloy, and/or any other metal), and/or any other suitable material.

Figure 12:
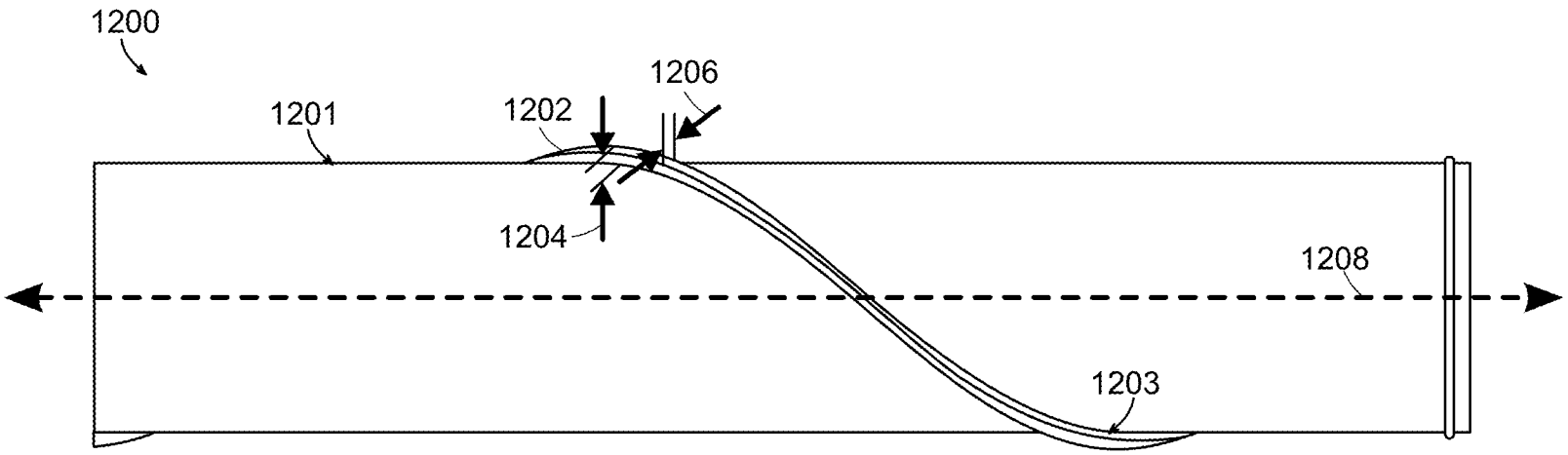
FIG. 12 shows a side view of an agitator body, consistent with embodiments of the present disclosure.
Figure 13A:
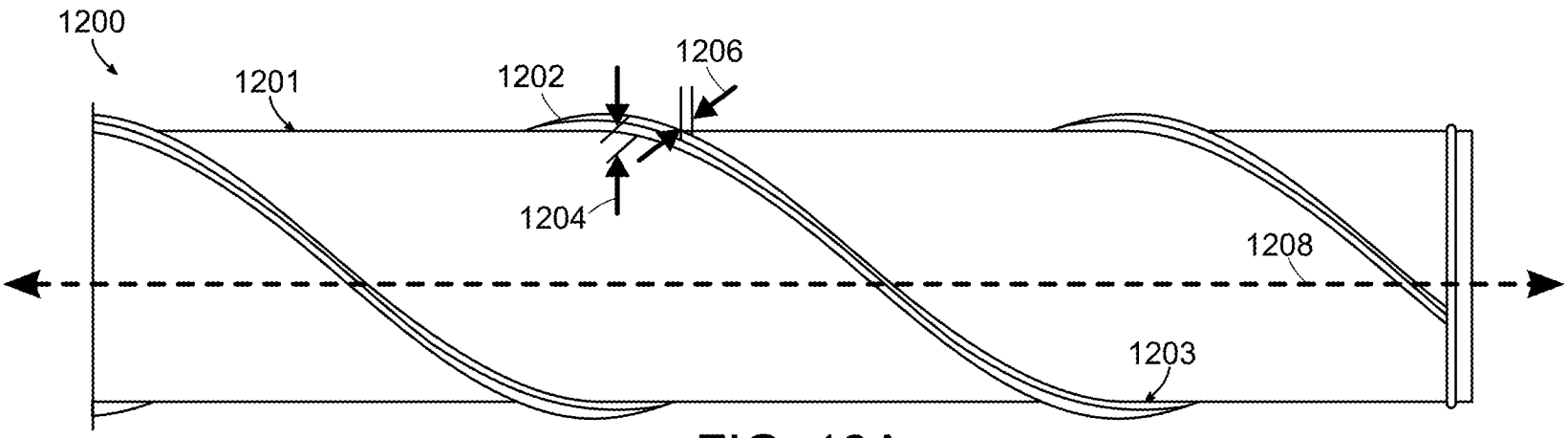
FIG. 13A shows a side view of another agitator body, consistent with embodiments of the present disclosure.

FIG. 12 shows an example of an agitator body 1200, which is an example of the agitator body 1000 of FIG. 10. As shown, the agitator body 1200 includes a helical rib 1202 extending along an outer surface 1201 of the agitator body 1000. For example, the helical rib 1202 may extend from the outer surface 1201 such that side surfaces 1203 of the helical rib 1202 form a substantially perpendicular angle with the outer surface 1201. By way of further example, one or more of the side surfaces 1203 of the helical rib 1202 may extend from the outer surface 1201 at a non-perpendicular (e.g., obtuse) angle (e.g., and forming an arcuate or planar surface). In some instances, the agitator body 1200 may include a plurality of helical ribs 1202 (see, e.g., FIG. 13A). The helical rib 1202 may be coupled to or integrally formed from the agitator body 1200. In operation, the helical rib 1202 may encourage larger and/or heavier debris into the debris collection assembly 326 (FIG. 3A). For example, the helical rib 1202 may generally be described as operating as an Archimedes screw.

In some instances, the agitation material 1006 (FIG. 10) may be disposed on opposing sides of the helical rib 1202 such that the helical rib 1202 is disposed between the agitation material 1006. For example, the agitation material 1006 may be in contact with at least one helical rib 1202. Contact with the helical rib 1202 may reduce a flexibility of a portion of the agitation material 1006 adjacent the helical rib 1202. In some instances, the agitation material 1006 may extend over the helical rib 1202. Such a configuration causes a localized ridge to be formed in the agitation material 1006 as a result of the helical rib 1202. Presence of a localized ridge in the agitation material 1006 may increase engagement with the surface to be cleaned 302 (FIG. 3A) at the localized ridge.

The helical rib 1202 may have a rib height 1204 and a rib width 1206. The rib height 1204 extends radially outward from the agitator body 1200 and the rib width 1206 extends in a direction parallel to a rotation axis 1208 of the agitator body 1200. The rib height 1204 may be less than the material thickness 1010 of the agitation material 1006. For example, the rib height 1204 may configured such that the helical rib 1202 does not come into contact with one or more of the surface to be cleaned 302, the squeegee 802 (FIG. 8), and/or the fluid stripper 1018 (FIG. 10). By way of further example, the rib height 1204 may be 10% of the material thickness 1010 of the agitation material 1006 to 30% of the material thickness 1010. By way of still further example, the rib height 1204 may be about 2.5 mm. In some instances, rib width 1206 may be about the same as the rib height 1204. The helical rib 1202 may be formed of a rigid material (e.g., a plastic material) or a flexible material (e.g., a elastomeric material). For example, the helical rib 1202 may be formed of the same material as the agitator body 1200.

Figure 13B:
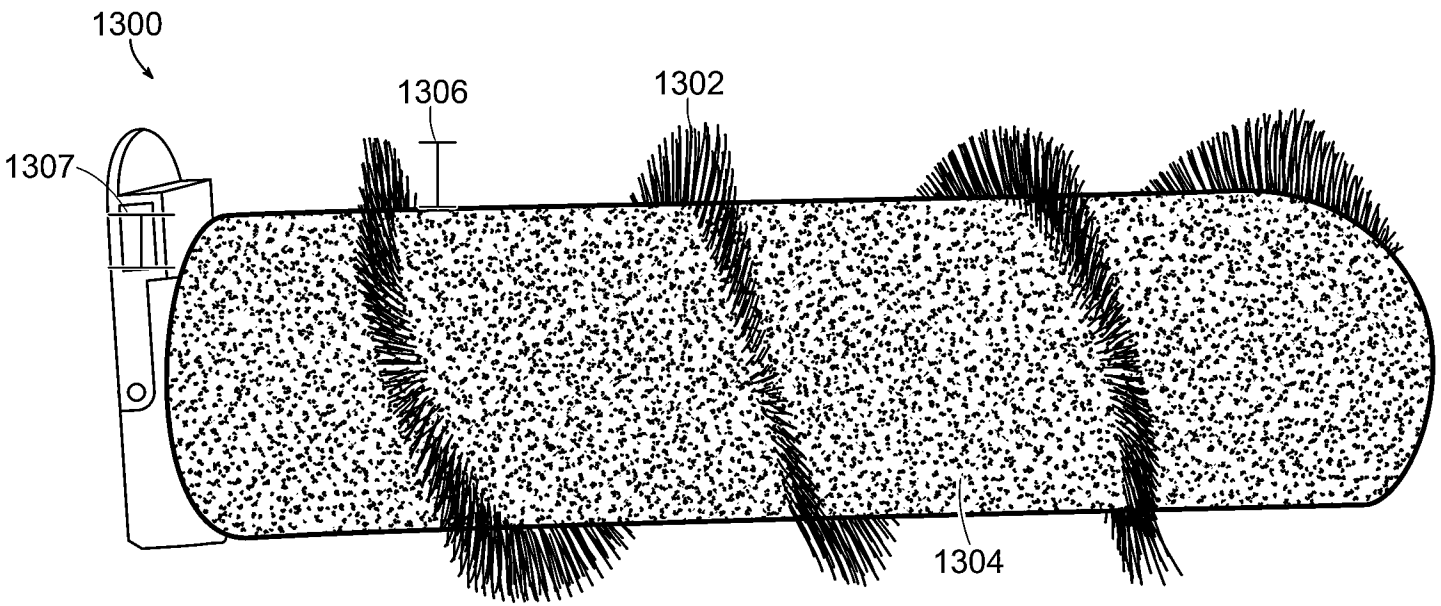
FIG. 13B shows a perspective view of an agitator having a bristle strip, consistent with embodiments of the present disclosure.

FIG. 13B shows an example of an agitator 1300 having at least one helical bristle strip 1302 extending therearound and microfiber 1304 extending on both sides of the helical bristle strip 1302. In some instances, the agitator 1300 may additionally include at least one helical rib (e.g., the helical rib 1202). A bristle strip may generally refer to a row of bristles having a linear length of at least 25% of a longitudinal length of the agitator 1300, wherein immediately adjacent bristles forming the bristle strip have bases that are spaced apart by a distance less than three-times a maximum diameter of a single bristle. The bristle strip 1302 may extend from the microfiber 1304 by a bristle extension distance 1306. The bristle extension distance 1306 may be, for example, equal to or greater than a thickness 1307 of the microfiber 1304 (e.g., when dry). By way of further example, the bristle extension distance 1306 may be about 0.1 times to about 0.9 times the thickness 1307 of the microfiber 1304 (e.g., when dry). In some instances, when a portion of the bristle strip 1302 is rotating within the surface cleaning head 306 (FIG. 3A), the bristle strip 1302 may be at least partially folded over. In these instances, as the bristle strip 1302 is rotated to extend out of the surface cleaning head 306 to engage the surface to be cleaned 302 (FIG. 3A), the elasticity of the bristles forming the bristle strip 1302 may cause the bristle strip 1302 to straighten, which may encourage debris collection.

Figure 13C:
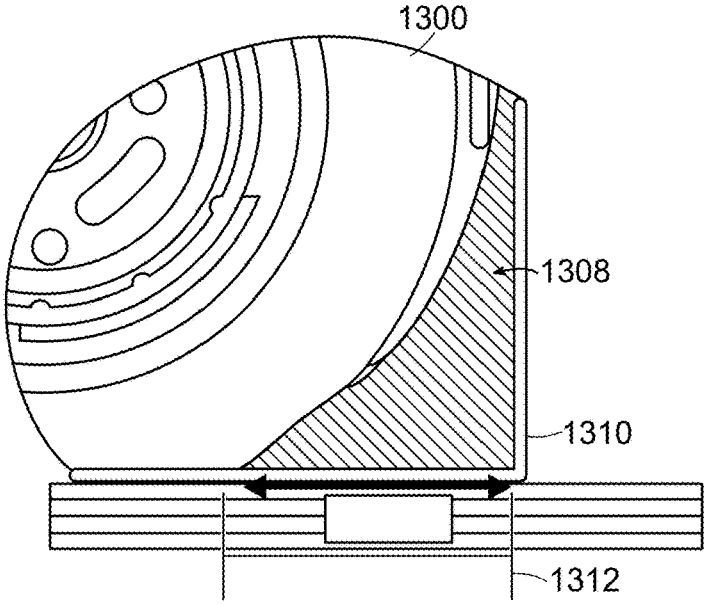
FIG. 13C shows a schematic example of the agitator of FIG. 13B, without the bristle strip, engaging a wall, consistent with embodiments of the present disclosure.

Having the bristle strip 1302 extend from the microfiber 1304 may improve edge cleaning and/or corner cleaning performance of the surface cleaning device 300 (FIG. 3A). For example, in the absence of suction, it may be difficult for the surface cleaning device 300 to collect debris adjacent a wall (e.g., as a result of a surface of the surface cleaning head 306 contacting the wall, potentially preventing a portion of the agitator 1300 from contacting the wall). In this example, the bristle extension distance 1306 may be selected such that a portion of the bristle strip 1302 contacts the wall, pulling debris towards the surface cleaning head 306 to be collected. The helical shape of the bristle strip 1302 may encourage movement of debris (e.g., as a result of an Archimedes screw effect). FIG. 13C illustrates an example of the agitator 1300 without the bristle strip 1302. As shown in FIG. 13C, without the bristle strip 1302 a dead-zone 1308 exists between the surface cleaning head 306 and a wall 1310, wherein debris within the dead-zone 1308 may not be collected. In one example, the dead-zone 1308 may have a dead-zone length 1312 of about 22 mm. As such, in some instances, the bristle extension distance 1306 may be at least about 22 mm.

Figure 14:
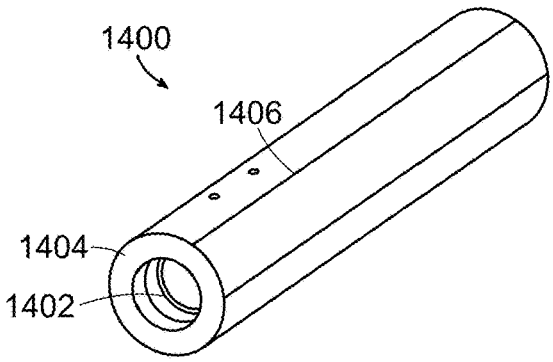
FIG. 14 shows a perspective view of an agitator, consistent with embodiments of the present disclosure.

FIG. 14 shows a perspective view of an agitator 1400, which is an example of the agitator 322 of FIG. 3. As shown, the agitator 1400 includes an agitator body 1402, an agitation material 1404, and one or more ribs 1406. The one or more ribs 1406 may be configured to cause the surface cleaning head 306 (FIG. 3A) to be briefly raised from the surface to be cleaned 302 (FIG. 3A) with each rotation (e.g., resulting a vibrating motion). Such a configuration may encourage debris to pass under the squeegee 802 (FIG. 8) on a reverse stroke, which may mitigate an amount of debris that collects behind the squeegee 802 on the reverse stroke. The one or more ribs 1406 may be formed of a rigid material (e.g., a plastic material) or a flexible material (e.g., a elastomeric material). For example, the one or more ribs 1406 may be formed of the same material as the agitator body 1402. In some instances, the one or more ribs 1406 may be integrally formed from the agitator body 1402. Alternatively, the one or more ribs 1406 may be coupled to the agitator body 1402.

Figure 15:
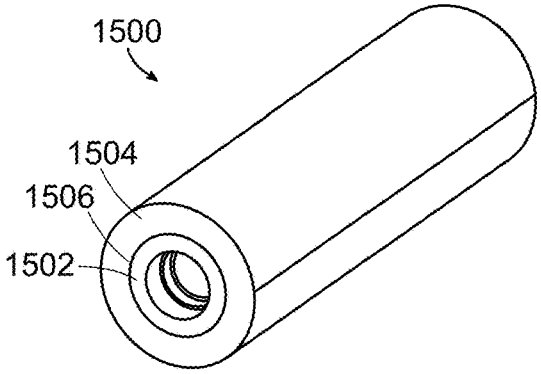
FIG. 15 shows a perspective view of an agitator, consistent with embodiments of the present disclosure.

FIG. 15 shows a perspective view of an agitator 1500, which is an example of the agitator 322 of FIG. 3. The agitator 1500 includes an agitator body 1502 and a microfiber material 1504. The microfiber material 1504 can be coupled to (e.g., adhesively coupled to) an outer surface 1506 of the agitator body 1502. In some instances, one or more additional agitation elements (e.g., bristles, flaps, and/or any other agitation element) may be interspersed within the microfiber material 1504. The one or more additional agitation elements may be interspersed according to a pattern (e.g., forming a helical pattern, a linear pattern, a chevron pattern, and/or any other pattern) or may be randomly interspersed. In some instances, the microfiber material 1504 may include a plurality of different microfiber materials (e.g., having different agitation characteristics, water absorption characteristics, and/or the like).

Figure 16A:
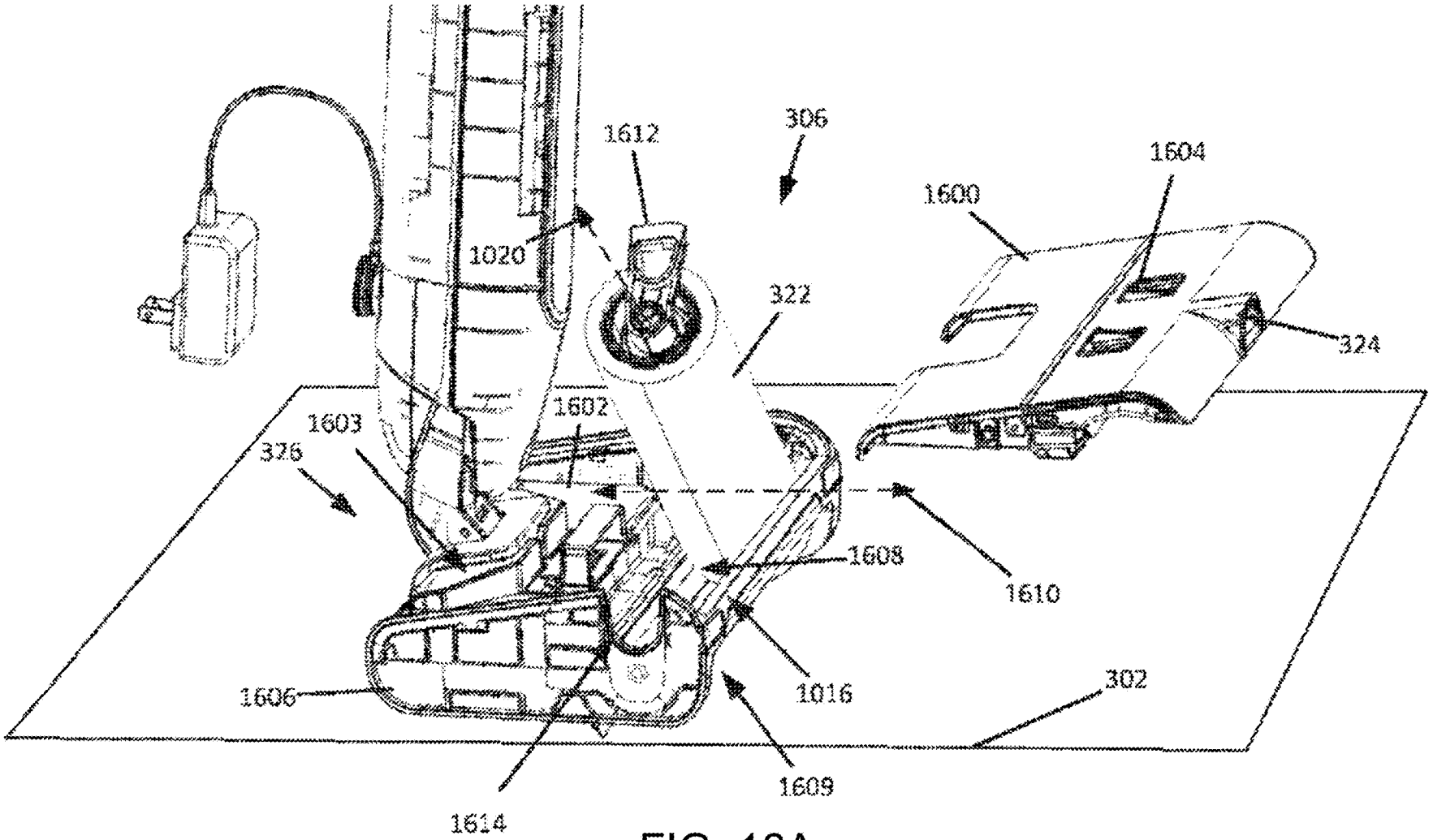
FIG. 16A shows a perspective view of a portion of the surface cleaning device of FIG. 3A having an agitator in a removal position, consistent with embodiments of the present disclosure.

FIG. 16A shows a perspective view of a portion of the surface cleaning device 300. As shown, the debris collection assembly 326 includes a removable cover 1600 that extends over at least a portion of a debris container 1602 and at least a portion of the agitator 322. The debris container 1602 may be at least partially received within a debris container cavity 1603 defined within the surface cleaning head 306 (e.g., a head body 1606 of the surface cleaning head 306). In some instances, the debris container cavity 1603 may be configured such that a tallest portion of the debris container 1602 is substantially flush with or below an upper most portion of the debris container cavity 1603.

The removable cover 1600 may define at least a portion of the agitation chamber 1016 and may include the spray nozzle 324. The spray nozzle 324 may be fluidly coupled to the fluid reservoir (FIG. 3A) through the removable cover 1600 (e.g., using one or more fluid tubes or fluid passages). The removable cover 1600 includes a cover latch 1604 configured to removably couple the removable cover 1600 to the surface cleaning head 306 (e.g., the head body 1606 of the surface cleaning head 306). The cover latch 1604 may be a pinch latch.

Figure 16B:
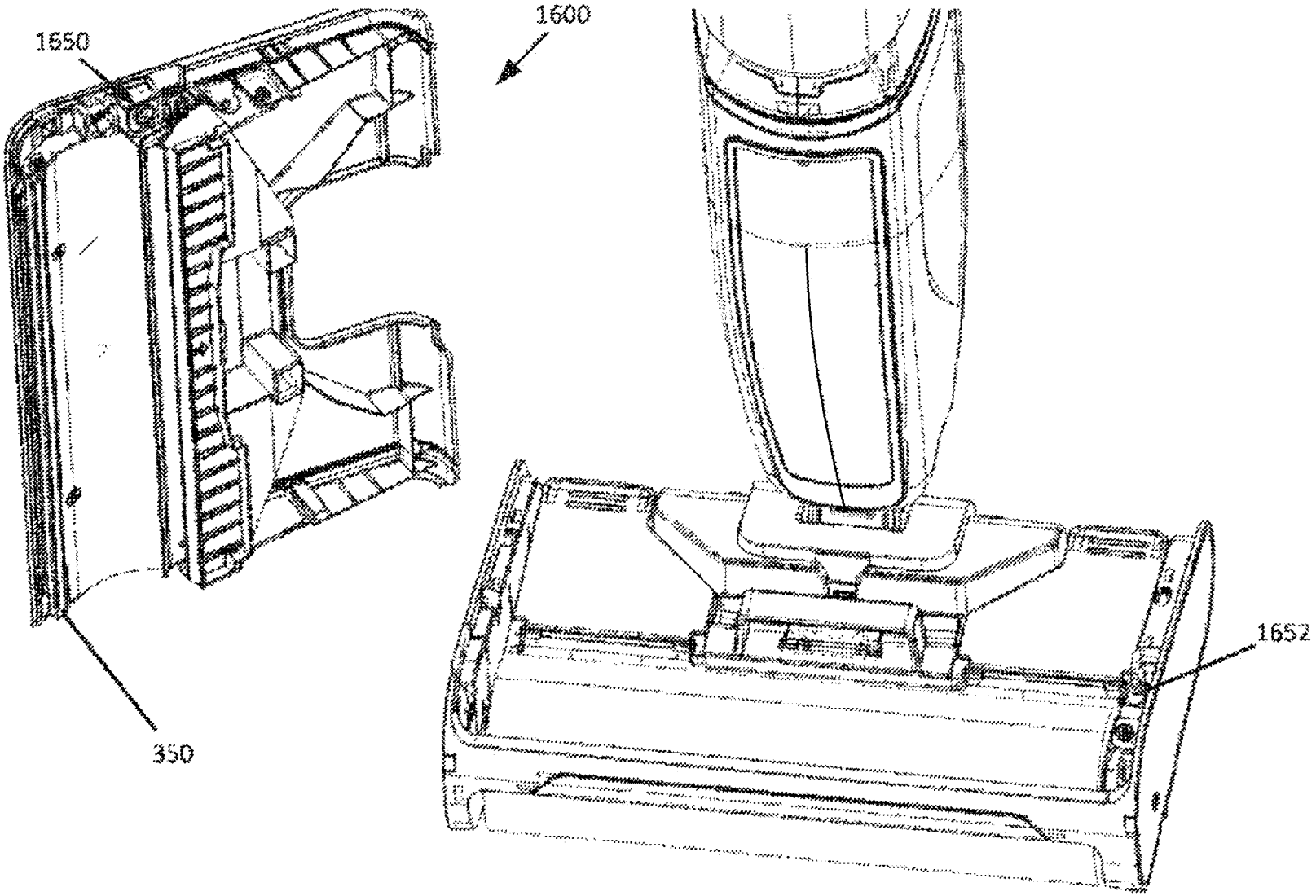
FIG. 16B shows a perspective view of the surface cleaning device of FIG. 3B having a removable cover in a removed position, consistent with embodiments of the present disclosure.

As shown in FIG. 16B, the removable cover 1600 may further include, in addition to, or in the alternative to, the spray nozzle 324 (FIG. 3A), the steam manifold 350. In these instances, the cover 1600 may include a stem receptacle 1650 configured to receive at least a portion of a steam stem 1652. The stem receptacle 1650 and the steam stem 1652 are configured to cooperate to fluidly couple the boiler 352 (FIG. 3B) with the steam manifold 350 when the removable cover 1600 is coupled with the surface cleaning head 306.

Figure 16C:
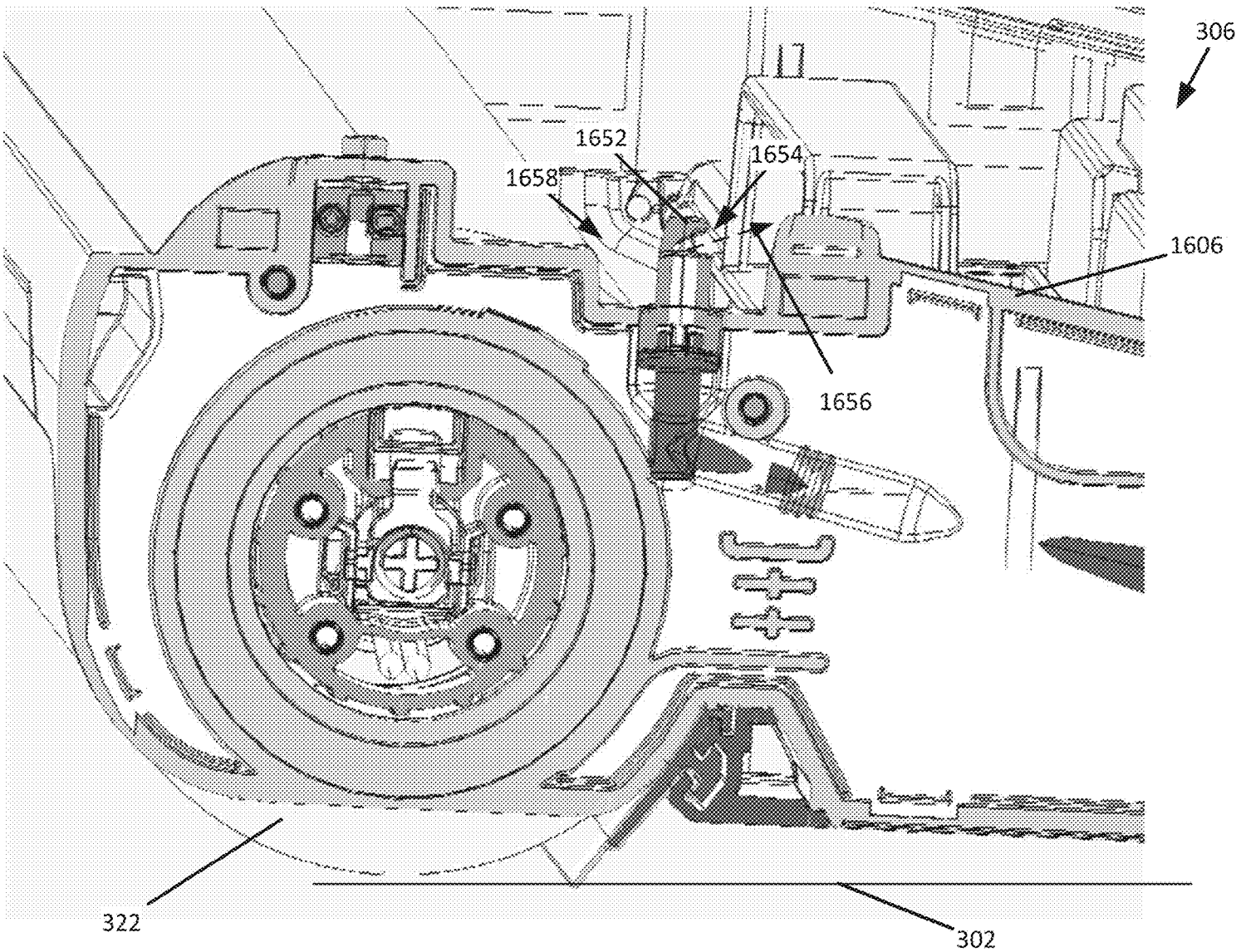
FIG. 16C shows a cross-sectional view of the surface cleaning device of FIG. 3B illustrating a steam stem, consistent with embodiments of the present disclosure.

As shown in FIG. 16C, the steam stem 1652 includes a steam outlet 1654. The steam outlet 1654 is configured to fluidly couple the steam stem 1652 to the steam manifold 350 via the stem receptacle 1650. The steam outlet 1654 is configured to direct steam along a steam outlet axis 1656. The steam outlet axis 1656 extends in a non-vertical direction (e.g., a direction extending transverse, at a non-perpendicular angle, to the surface to be cleaned 302). As such, steam emitted from the steam outlet 1654, when the removable cover 1600 is removed from the surface cleaning head 306, is emitted in a non-vertical direction (e.g., away from the user). Such a configuration, may reduce a risk of user harm (e.g., from residual steam within the boiler 352, FIG. 3B). For example, the steam outlet axis 1656 may extend in a direction away from the agitator 322. In some instances, when the removable cover 1600 is removed, at least a portion of steam emitted along the steam outlet axis 1656 may intersect with a portion of the head body 1606 (e.g., to encourage dissipation of emitted steam into a surrounding environment). For example, and as shown, the steam stem 1652 may be disposed within a stem cavity 1658 of the head body 1606 such that at least a portion steam emitted from the steam outlet 1654, when the removable cover 1600 is removed from the surface cleaning head 306, is incident on a sidewall of the stem cavity 1658.

Figure 16D:
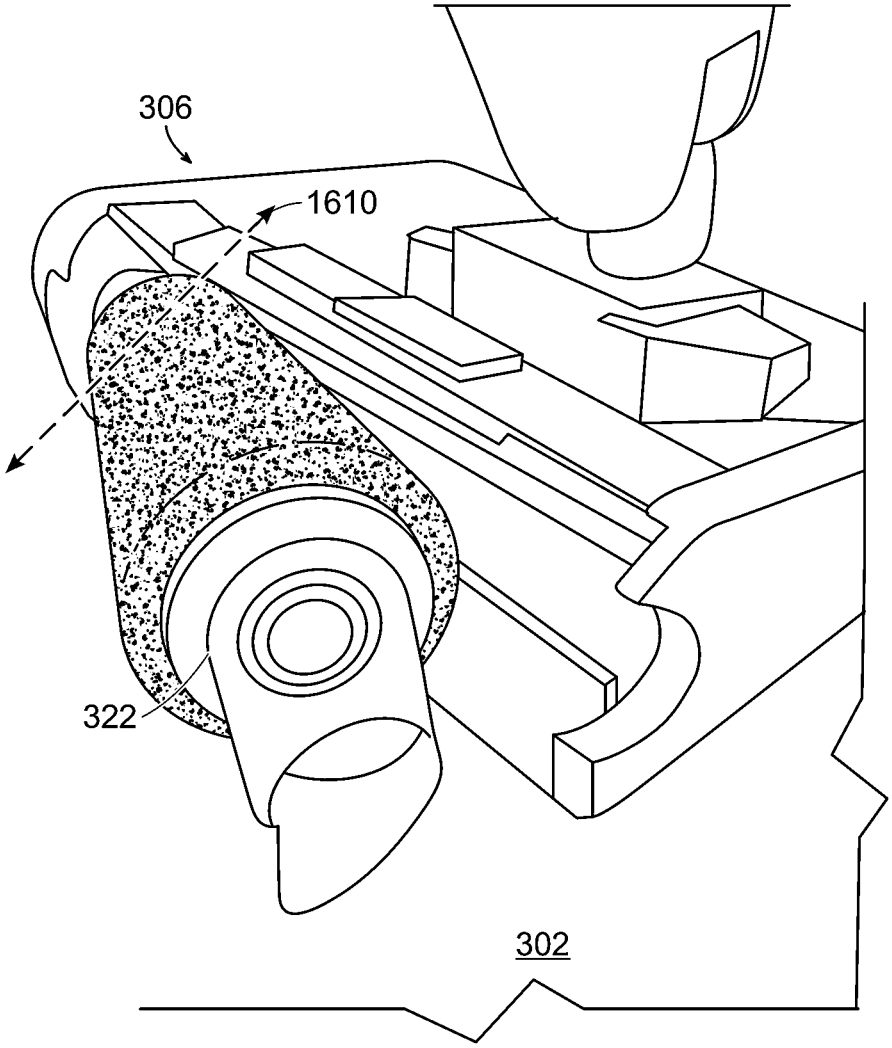
FIG. 16D shows a perspective view of an example of a surface cleaning head having an agitator configured to be removed from the surface cleaning head in response to pivoting the agitator forwardly and upwardly, consistent with embodiments of the present disclosure.

Returning to FIG. 16A, when the removable cover 1600 is removed from the surface cleaning head 306, an agitator opening 1608 is exposed, allowing the agitator 322 to be pivoted about an agitator pivot axis 1610 between an in-use position and a removal position. As shown, the pivot axis 1610 extends substantially parallel to the surface to be cleaned 302 and transverse to (e.g., at a perpendicular angle) the rotation axis 1020 of the agitator 322. Such a configuration allows the agitator 322 to, for example, be pivoted upwardly. In some instances, the pivot axis 1610 may extend transverse to (e.g., at a non-perpendicular angle) the surface to be cleaned 302. Such a configuration, as shown in FIG. 16D, allows the agitator 322 to, for example, be pivoted upwardly and forwardly such that at least a portion of the agitator 322 extends forward of the surface cleaning head 306. In some instances, having the agitator 322 pivot upwardly and forwardly, may allow at least a portion of the cover 1600 to be non-removable.

When the agitator is in the removal position (e.g., as shown in FIG. 16A), the agitator 322 extends through the agitator opening 1608. The agitator opening 1608 is positioned opposite at least a portion of an agitator chamber opening 1609. The removal position may correspond to, for example, about 35° to about 55° of rotational movement about the agitator pivot axis 1610 from the in-use position. By way of further example, the removal position may correspond to about 45° of rotational movement about the agitator pivot axis 1610 from the in-use position.

When the agitator 322 is in the in-use position, at least a portion of the agitator 322 extends from the agitator chamber opening 1609 to engage the surface to be cleaned 302. In other words, when in the removal position, the agitator 322 extends upwardly in a direction away from the surface to be cleaned 302. Such a configuration may result in the presentation of the agitator 322 to a user, which may result in easier removal and/or replacement of the agitator 322.

Transitioning the agitator 322 between the in-use position and the removal position may be accomplished by a user exerting a force on an agitator tab 1612 that causes the agitator 322 to pivot about the agitator pivot axis 1610. When in the in use position, the agitator tab 1612 may be received within a tab receptable 1614 of the head body 1606 of the surface cleaning head 306. In some instances, the agitator tab 1612 may define a portion of an outer surface of the surface cleaning head 306 when the agitator 322 is in the in-use position.

Figure 17:
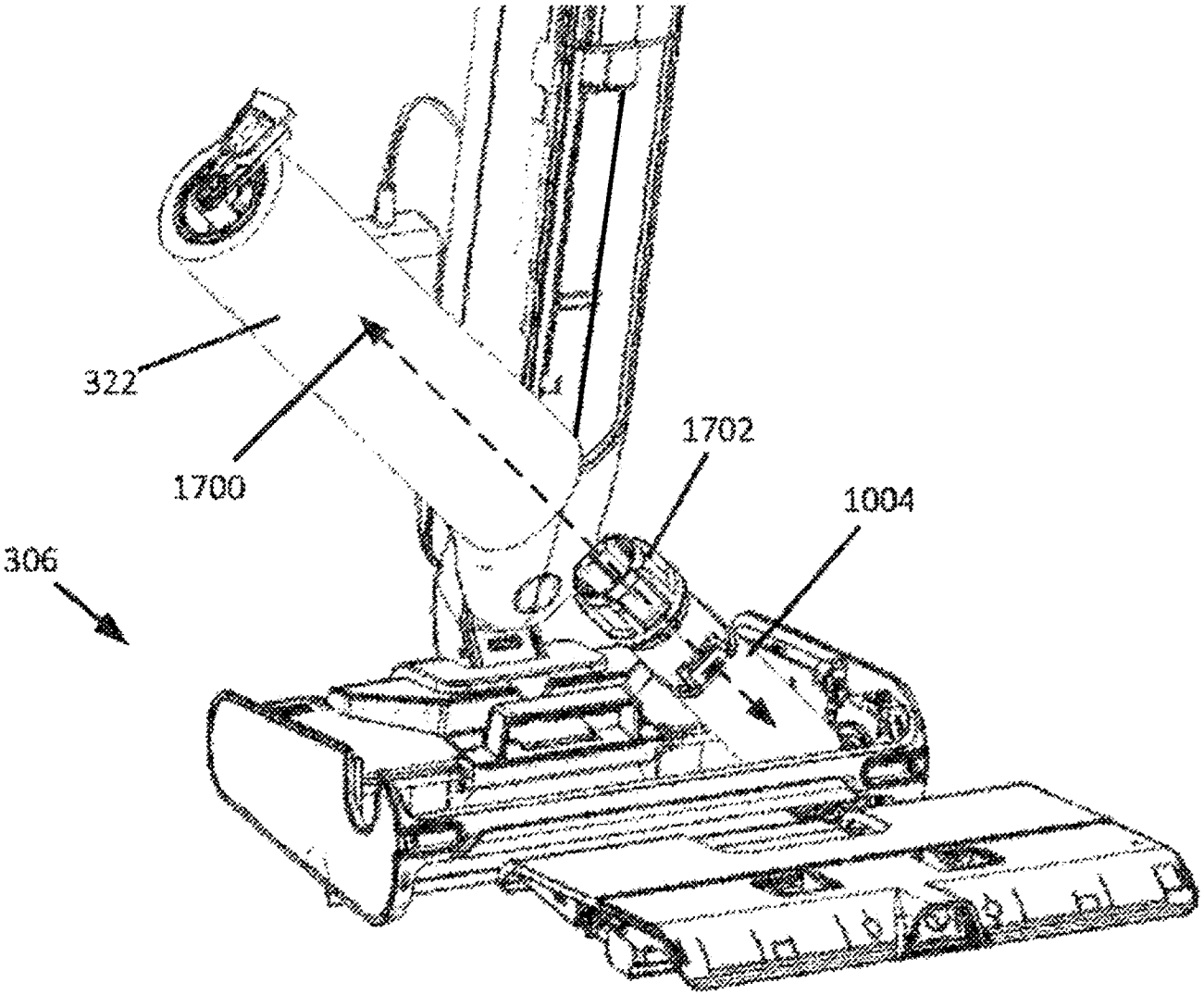
FIG. 17 shows another perspective view of a portion of the surface cleaning device of FIG. 16A having the agitator being removed therefrom, consistent with embodiments of the present disclosure.

As shown in FIG. 17, when in the removal position, the agitator 322 may be moved along a removal axis 1700 to remove the agitator 322 from the surface cleaning head 306, exposing the agitator motor 1004. In other words, the agitator 322 is slidably coupled with the agitator motor 1004. Such a configuration may allow for easier cleaning and/or replacement of the agitator 322. The removal axis 1700 may correspond to (e.g., be coincident with) the rotation axis 1020 (FIG. 10) of the agitator 322. As also shown, the agitator motor 1004 includes a drive dog 1702 configured to cooperate with a corresponding drive of the agitator 322 to cause the agitator 322 to rotate.

Figure 19:
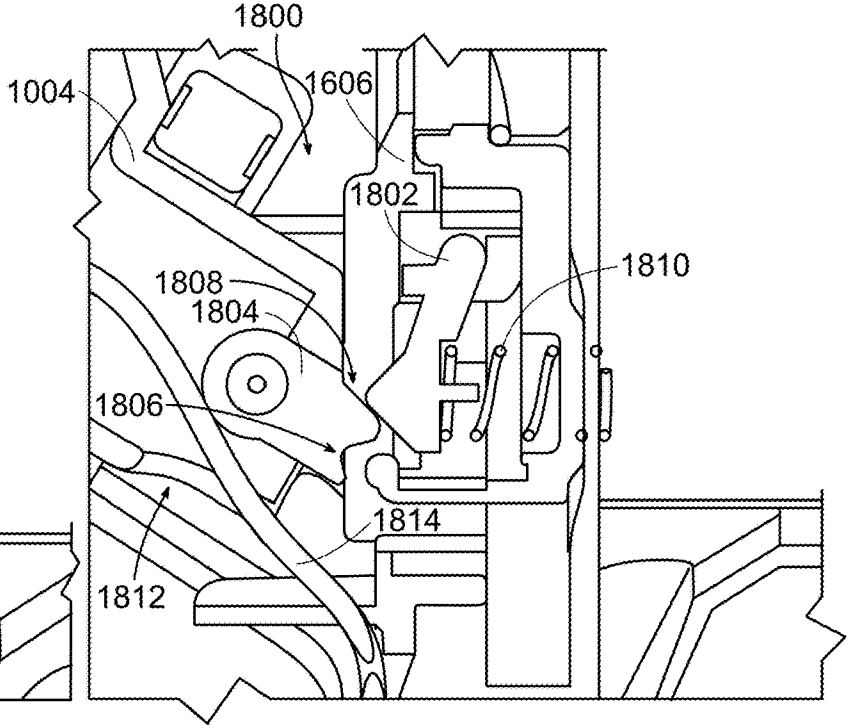
FIG. 19 shows a cross-section view of the motor retainer of FIG. 18 in a removal position, consistent with embodiments of the present disclosure.
Figure 18:
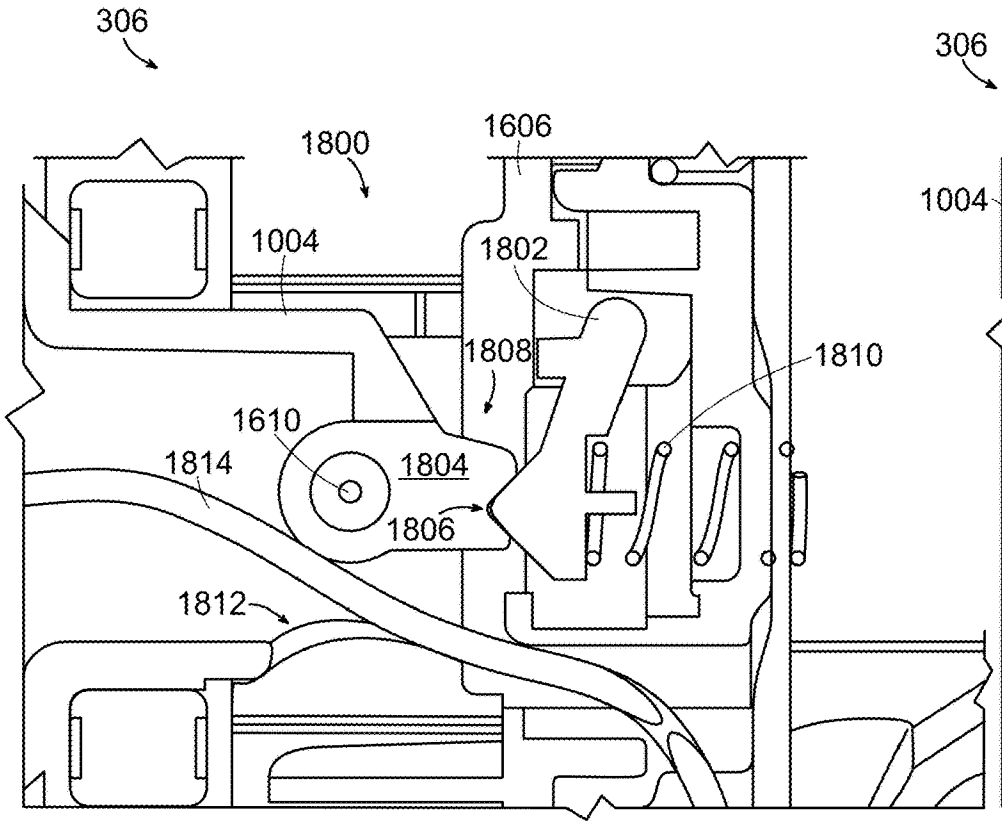
FIG. 18 shows a cross-sectional view of an example motor retainer for the surface cleaning device of FIG. 3A in an in-use position, consistent with embodiments of the present disclosure.

When the agitator 322 pivots between the in-use and removal positions, the agitator motor 1004 pivots concurrently with the agitator 322. The agitator motor 1004 may be configured to be selectively retained within the in-use and removal positions. For example, as shown in FIGS. 18 and 19, a motor retainer 1800 may selectively retain the agitator motor 1004 in the in-use position (FIG. 18) and the removal position (FIG. 19). The motor retainer 1800 may include a pawl 1802 pivotally coupled to the head body 1606 of the surface cleaning head 306. The pawl 1802 is configured to cooperate with a protrusion 1804 of the agitator motor 1004 to selectively retain the agitator motor 1004 in the in-use and removal positions. The protrusion 1804 includes a notch 1806 configured to selectively receive the pawl 1802 and an engagement surface 1808 spaced apart from the notch 1806 configured to selectively engage (e.g., contact) the pawl 1802. As shown, the notch 1806 and the pawl 1802 include corresponding angled surfaces such that, as the agitator motor 1004 pivots from the in-use position towards the removal position, the pawl 1802 is urged out of the notch 1806 and into engagement with the engagement surface 1808 of the protrusion 1804. The pawl 1802 is biased by a biasing mechanism 1810 (e.g., a spring, such as a compression spring) into engagement with the notch 1806 and the engagement surface 1808. The bias force exerted by the biasing mechanism 1810 may be configured such that the weight of the agitator 322 and the agitator motor 1004 are insufficient to cause the agitator motor 1004 to transition from the removal position towards the in-use position. In other words, the agitator motor 1004 is configured to remain in the removal position until a user exerts a force sufficient to transition to agitator motor 1004 to the in-use position.

While FIGS. 18 and 19 show the motor retainer 1800 as selectively retaining the agitator 322 in two positions (the in-use and removal positions), other configurations are possible. For example, the motor retainer 1800 may be configured to selectively retain the agitator 322 in three or more positions. In this example, the motor retainer 1800 may be configured to selectively retain the agitator 322 in an in-use position, an intermediary position (e.g., a rotational position corresponding to about 25° of rotational movement about the agitator pivot axis 1610 from the in-use position), and a removal position (e.g., a rotational position corresponding to about 45° of rotational movement about the agitator pivot axis 1610 from the in-use position). When in the intermediary position, the agitator 322 may or may not be removable from the surface cleaning head 306.

As shown in FIG. 19, when in the removal position, the agitator motor 1004 may be configured to engage a portion of the head body 1606. Such a configuration may prevent the over pivoting of the agitator motor 1004.

As also shown in FIGS. 18 and 19, the agitator motor 1004 may also include a wire passthrough 1812 through which one or more wires 1814 (e.g., power supply wires) pass. The wire passthrough 1812 may also be used to provide a cooling passage for providing cooling air to the agitator motor 1004.

Figure 20C:
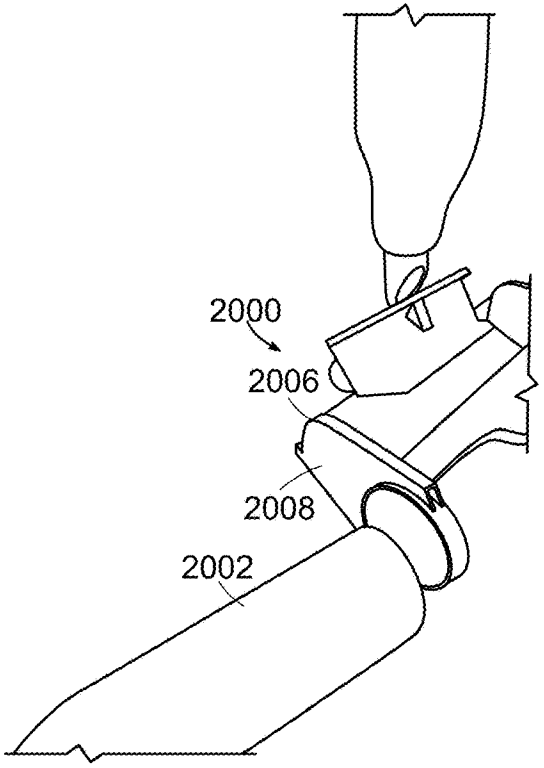
FIG. 20C shows the surface cleaning head of FIG. 20A having the agitator in a removed position, consistent with embodiments of the present disclosure.
Figure 20B:
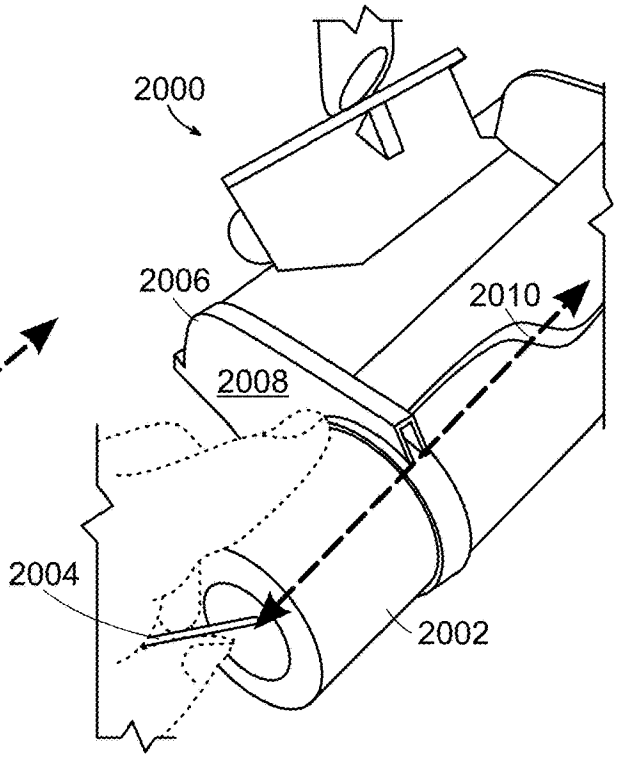
FIG. 20B shows the surface cleaning head of FIG. 20A having the agitator in an intermediary removal position, consistent with embodiments of the present disclosure.
Figure 20A:
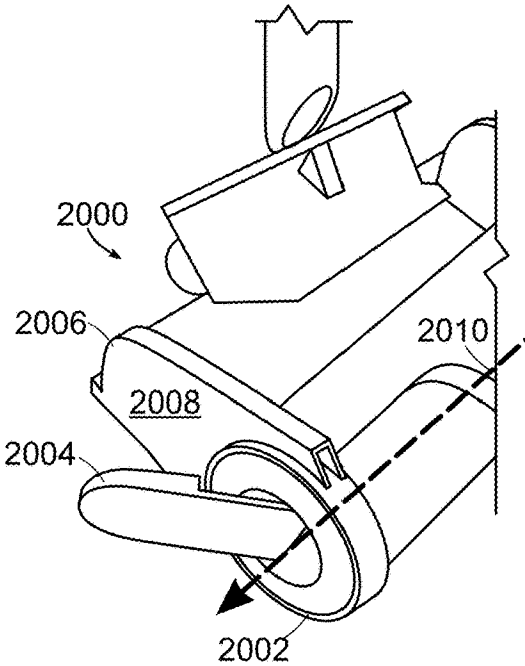
FIG. 20A shows an example surface cleaning head having an agitator configured to be removed from the surface cleaning head horizontally in a first removal position, consistent with embodiments of the present disclosure.

While FIGS. 16-19 describe pivoting the agitator 322 upwardly towards a removal position, other configurations for removing the agitator 322 are possible. For example, FIGS. 20A-20C, show a surface cleaning head 2000, which is an example of the surface cleaning head 306, having an agitator 2002, which is an example of the agitator 322, wherein the agitator 2002 is removable from the surface cleaning head 2000 without pivoting upwardly. As shown, the agitator 2002 includes an agitator latch 2004 configured to engage with a head body 2006 of the surface cleaning head 2000. In response to actuating the agitator latch 2004, the agitator 2002 may be removed through an opening in a sidewall 2008 of the head body 2006 by moving the agitator 2002 along a removal axis 2010. The removal axis 2010 may correspond to (e.g., be coincident with) a rotation axis of the agitator 2002.

Figure 21:
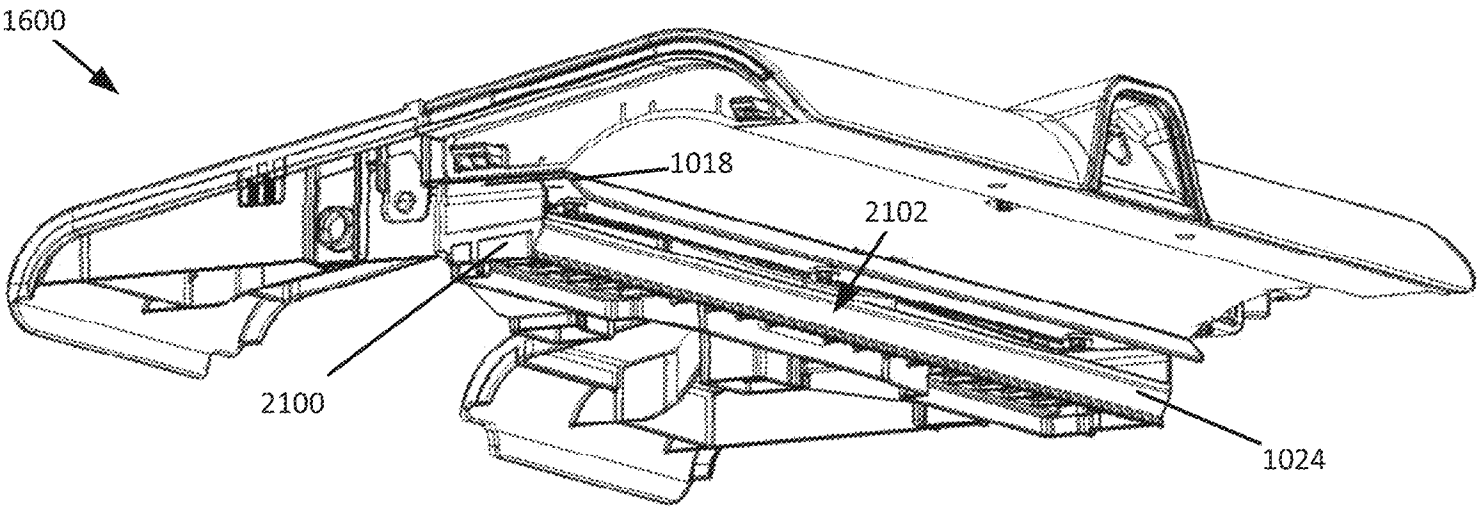
FIG. 21 shows a perspective bottom view of a removable cover of the surface cleaning head of FIG. 8, consistent with embodiments of the present disclosure.
Figure 22:
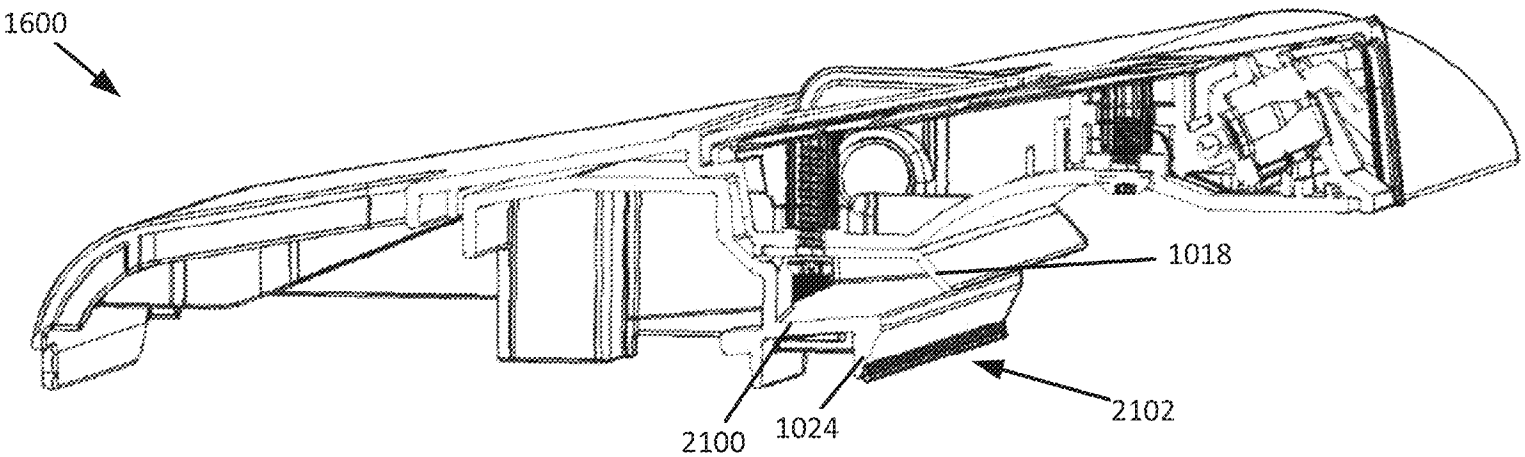
FIG. 22 shows a cross-sectional view of the removable cover of FIG. 21, consistent with embodiments of the present disclosure.

FIG. 21 shows a perspective bottom view of the removable cover 1600 and FIG. 22 shows a perspective cross-sectional view of the removable cover 1600. As shown, the removable cover 1600 includes a fluid catch plate 2100. The fluid catch plate 2100 is configured to collect fluid stripped from the agitator 322 (FIG. 3A) by the fluid stripper 1018. The fluid catch plate 2100 is configured to direct collected fluid toward at least one chamber defined within the debris container 1602 (FIG. 16A). As shown, the fluid catch plate 2100 may include one or more of the debris stripper 1024 and/or the fluid stripper 1018. The debris stripper 1024 may include a plurality of spaced apart ridges 2102 (e.g., forming a comb) configured to engage the agitator 322 (e.g., protrude into the agitation material 1006 of the agitator 322 by about 1 mm). Engagement between the plurality of ridges 2102 and the agitator 322 may mitigate (e.g., prevent) a quantity of solid debris (e.g., fibrous debris such as hair) from entering the fluid catch plate 2100.

Figure 23:
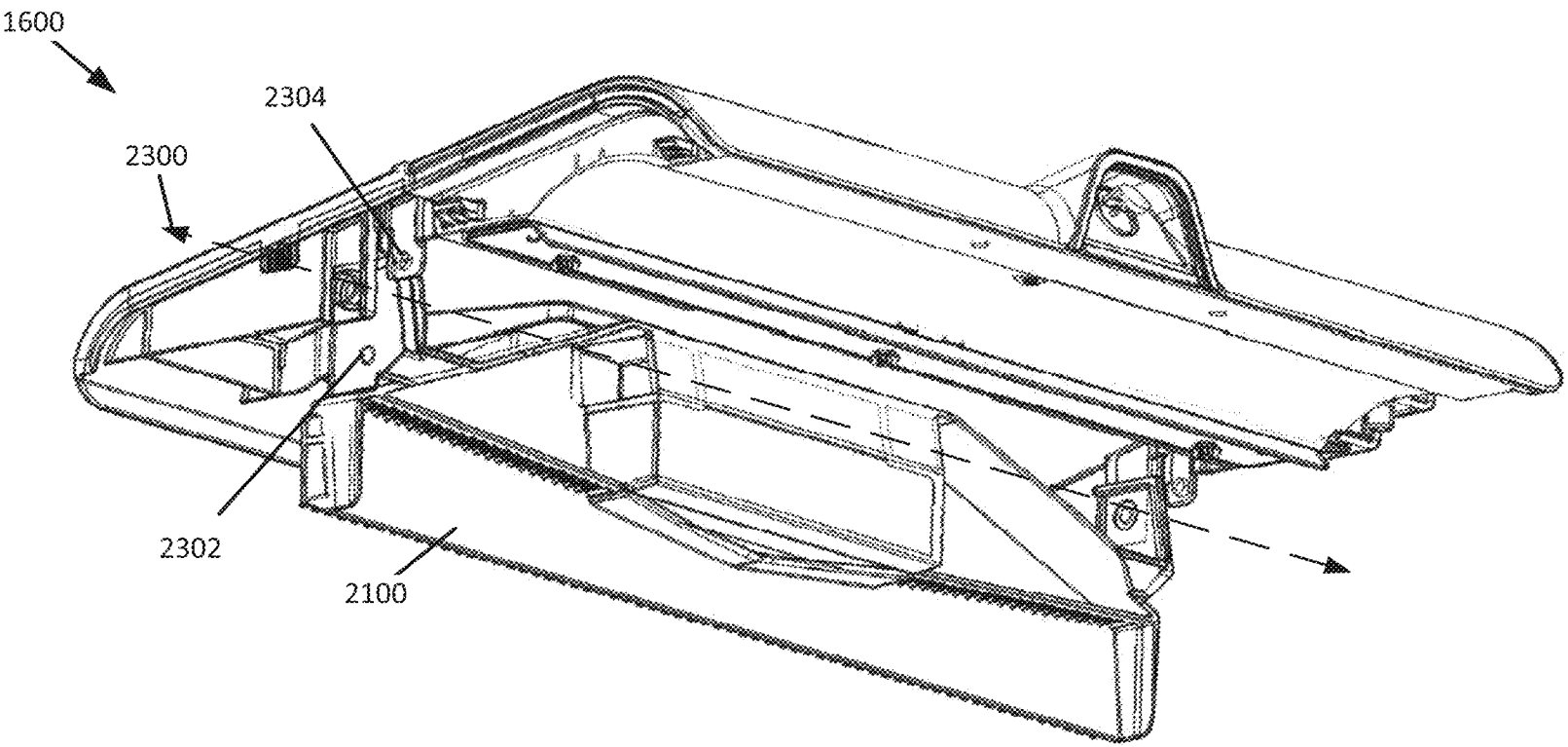
FIG. 23 shows a bottom perspective view of the removable cover of FIG. 21 having a fluid catch plate in a cleaning position, consistent with embodiments of the present disclosure.

As shown in FIG. 23, the fluid catch plate 2100 is configured to transition between an in-use position (FIG. 21) and a cleaning position (FIG. 23) when the removable cover 1600 is removed from the surface cleaning head 306 (FIG. 3A). For example, the fluid catch plate 2100 may be configured to pivot about a plate pivot axis 2300 between the in-use position and the cleaning position. The fluid catch plate 2100 is configured to be selectively retained in the in-use position such that the fluid catch plate 2100 transitions from the in-use position to the cleaning position in response to an application of a force by a user. For example, the fluid catch plate 2100 may include a detent 2302 configured to be selectively receivable within a detent receptacle 2304 of the removable cover 1600. In some instances, the fluid catch plate 2100 may be removably coupled with the removable cover 1600.

Figure 24A:
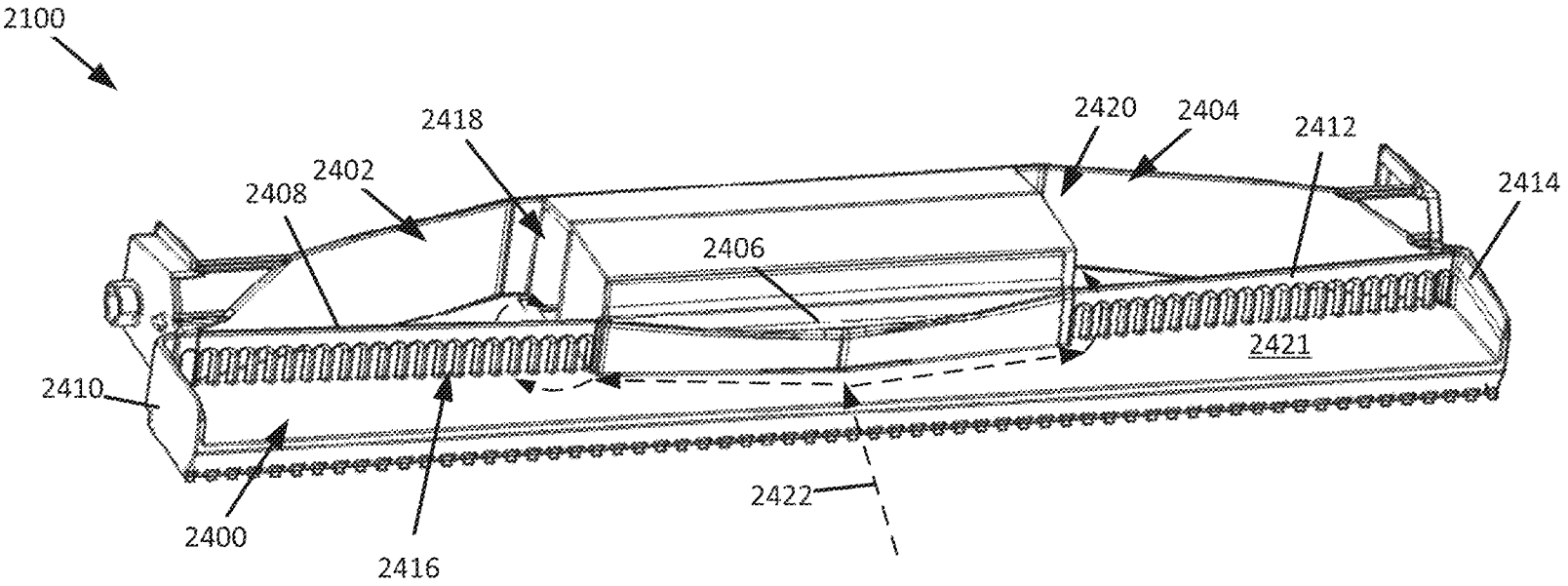
FIG. 24A shows a perspective view of the fluid catch plate of FIG. 23, consistent with embodiments of the present disclosure.

FIG. 24A shows a perspective view of the fluid catch plate 2100. As shown, the fluid catch plate 2100 has a collecting region 2400, a first channel 2402, and a second channel 2404, the collecting region 2400 being fluidly coupled with the first and second channels 2402 and 2404. The collecting region 2400 is disposed between the agitator 322 (FIG. 3A) and the first and second channels 2402 and 2404 when the fluid catch plate 2100 is in the in-use position and the removable cover 1600 (FIG. 16A) is coupled to the surface cleaning head 306 (FIG. 3A). In other words, the collecting region 2400 may generally be described as being disposed forwardly of the first and second channels 2402 and 2404. The collecting region 2400 is configured to receive fluid stripped from the agitator 322 and direct the received fluid to the first and second channels 2402 and 2404. The collecting region 2400 includes a fluid diverter 2406 extending between the first and second channels 2402 and 2404. The fluid diverter 2406 is configured to divert fluid incident thereon into a respective one of the first or the second channel 2402 or 2404. For example, the fluid diverter 2406 may have a generally triangular shape, wherein an apex of the triangular shape points towards the agitator 322.

Figure 24B:
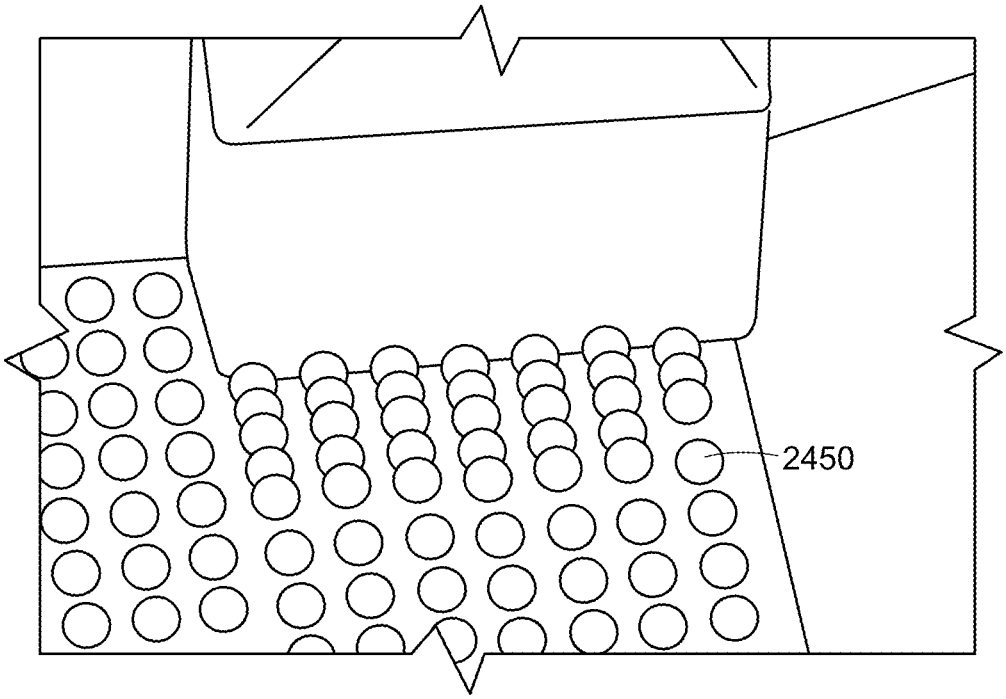
FIG. 24B shows an example of a textured surface for a fluid catch plate, consistent with embodiments of the present disclosure.

A first fluid grate 2408 may extend between the first channel 2402 and the collecting region 2400. The first fluid grate 2408 may extend from the fluid diverter 2406 to a first sidewall 2410 of the fluid catch plate 2100. As such, fluid passing from the collecting region 2400 into the first fluid channel 2402 passes through the first fluid grate 2408. A second fluid grate 2412 may extend between the second channel 2404 and the collecting region 2400. The second fluid grate 2412 may extend from the fluid diverter 2406 to a second sidewall 2414 of the fluid catch plate 2100, wherein the first and second sidewalls 2410 and 2414 are at opposing ends of the fluid catch plate 2100. As such, fluid passing from the collecting region 2400 into the second channel 2404 passes through the second fluid grate 2412. The first and second fluid grates 2408 and 2412 include a plurality of spaced apart fluid passthroughs 2416. The fluid passthroughs 2416 are configured to allow fluid having debris entrained therein to pass through the first and second fluid grates 2408 and 2412 while the first and second fluid grates 2408 and 2412 collect solid debris (e.g., fibrous debris such as hair) thereon. In some instances, in addition to, or in the alternative to, the first and second fluid grates 2408 and 2412, at least a portion of a fluid surface 2421 of the fluid catch plate 2100 may include a coarse texture (e.g., a plurality of raised protrusions) configured to capture solid debris (e.g., fibrous debris such as hair) while allowing fluid to pass therebetween. One example texture is shown in FIG. 24B. As shown in FIG. 24B, the texture may be formed using a plurality of raised protrusions 2450 (e.g., cylindrical protrusions, rectangular protrusions, spherical protrusions, and/or any other shape protrusion).

Figure 24C:
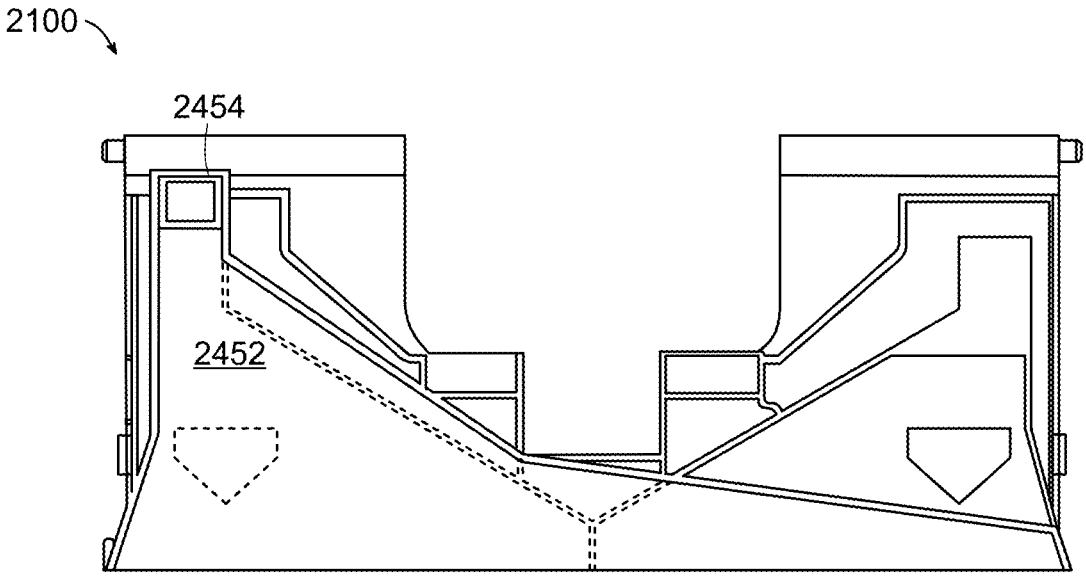
FIG. 24C shows an example of a fluid catch plate having a single fluid outlet, consistent with embodiments of the present disclosure.

The first and second channels 2402 and 2404 are fluidly coupled to a respective fluid outlet 2418 and 2420. The fluid outlets 2418 and 2420 are fluidly coupled with at least one chamber defined within the debris container 1602 (FIG. 16A). As such, in operation, fluid may flow along a catch plate flow path 2422 extending from the collecting region 2400 through a respective fluid grate 2408 or 2412 and into a respective fluid outlet 2418 or 2420. In some instances, and as shown in FIG. 24C, the fluid catch plate 2100 may have a single channel 2452 configured to direct fluid to a single fluid outlet 2454.

Figure 25A:
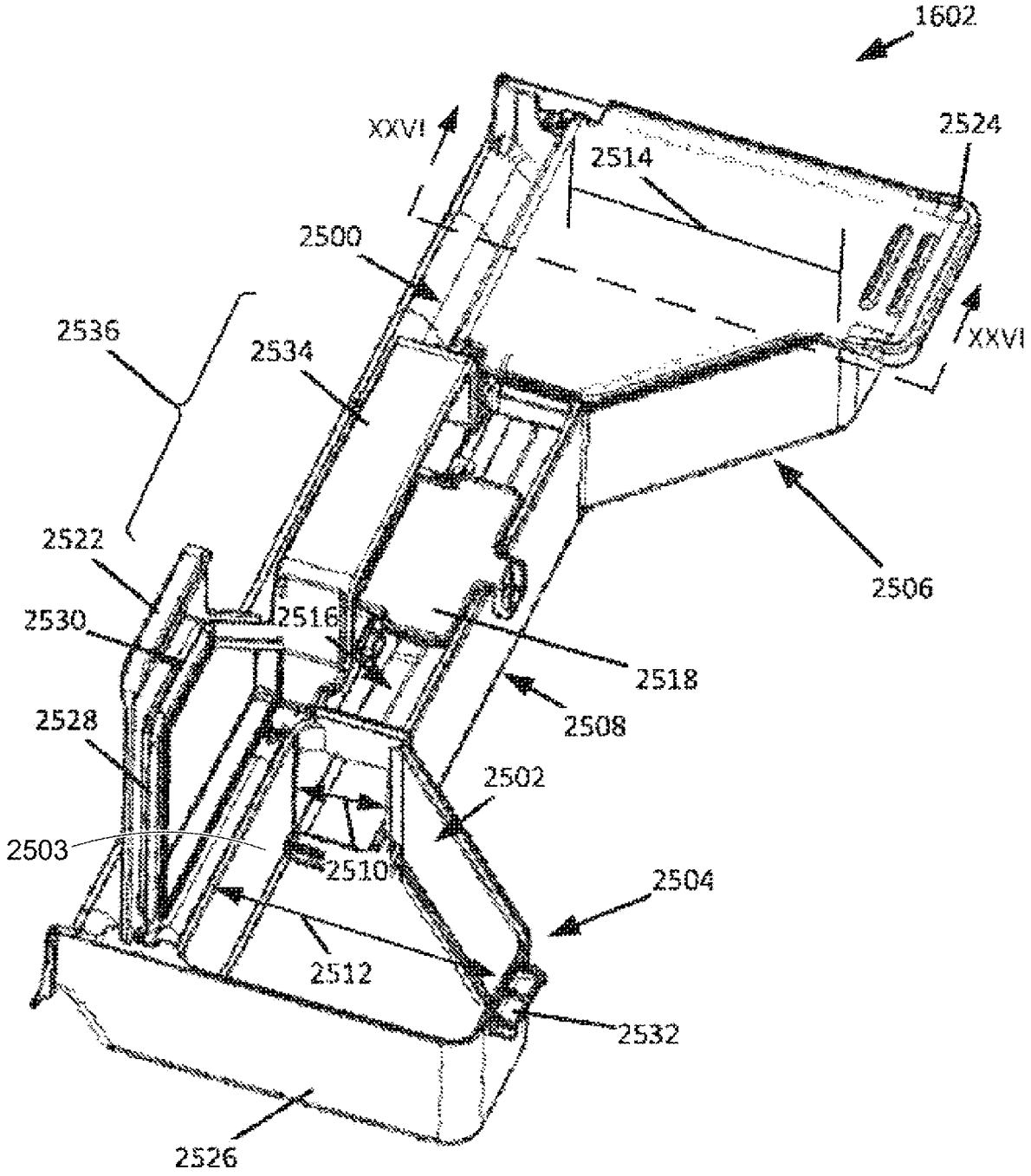
FIG. 25A shows a perspective view of a debris container of the surface cleaning head of FIG. 8, consistent with embodiments of the present disclosure.
Figure 26:
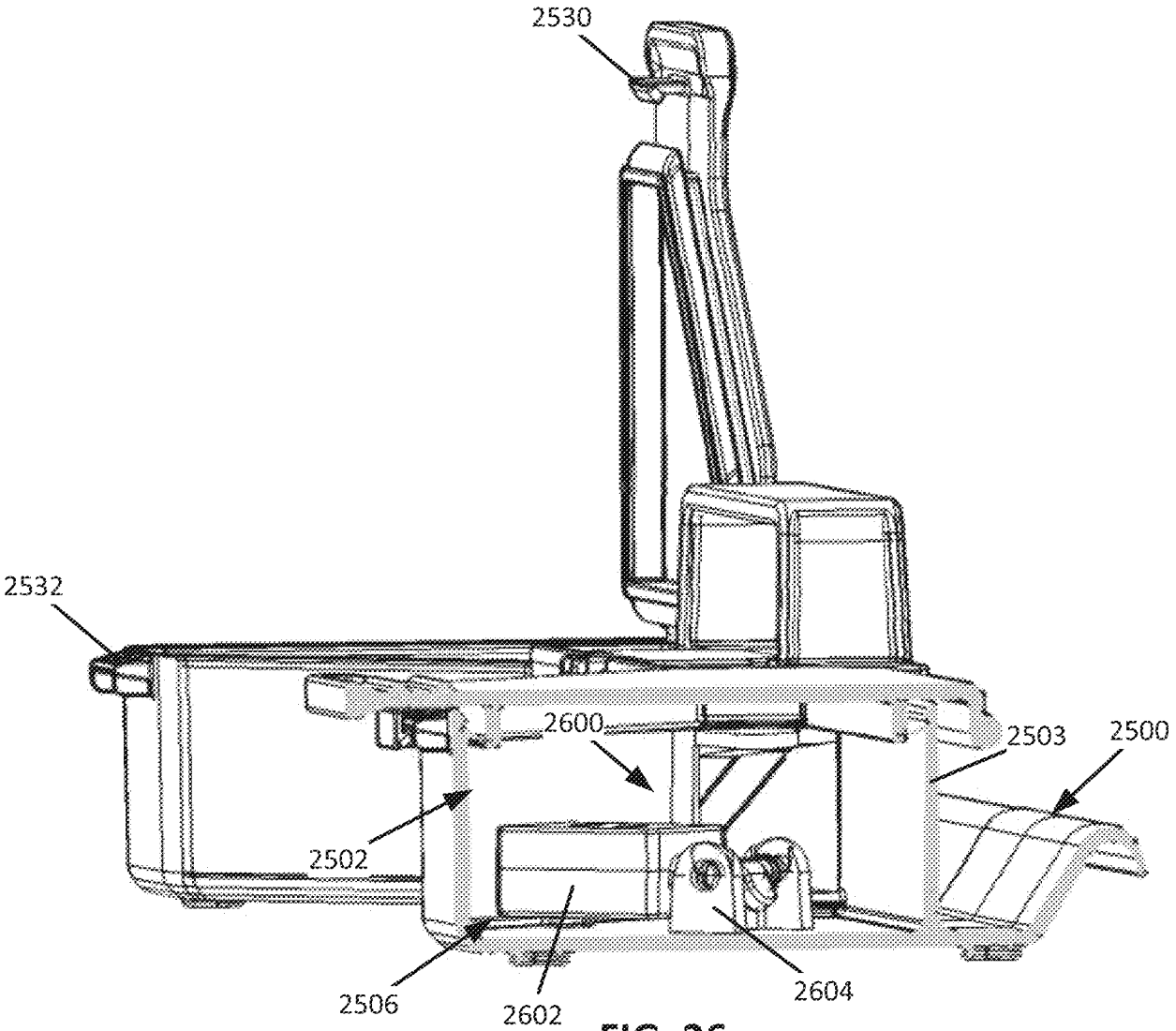
FIG. 26 shows a cross-sectional perspective view of the debris container of FIG. 25A taken along the line XXVI-XXVI of FIG. 25A, consistent with embodiments of the present disclosure.

FIG. 25A shows a perspective view of the debris container 1602 and FIG. 26 shows a cross-sectional view of the debris container 1602 taken along the line XXVI-XXVI. As shown, the debris container 1602 includes a solid debris chamber 2500 and a fluid debris chamber 2502, the solid debris chamber 2500 being fluidly separated from the fluid debris chamber 2502 by a separation wall 2503. The solid debris chamber 2500 is disposed between the agitator 322 (FIG. 3A) and the fluid debris chamber 2502. The fluid debris chamber 2502 includes a first collection region 2504, a second collection region 2506, and an interconnecting region 2508. The interconnecting region 2508 extends between the first and second collection regions 2504 and 2506. The interconnecting region 2508 fluidly couples the first collection region 2504 to the second collection region 2506. The interconnecting region 2508 has an interconnecting region largest width 2510, the first collection region 2504 has a first collection region largest width 2512, and the second collection region 2506 has a second collection region largest width 2514. The interconnecting region largest width 2510 may be less than the first and the second collection region largest widths 2512 and 2514. For example, the interconnecting region largest width 2510 may be less than half the first and second collection region largest widths 2512 and 2514.

The interconnecting region 2508 is selectively fluidly coupled to a fluid collection tray 2516 of the debris container 1602 via a container valve 2518 of the debris container 1602. The container valve 2518 is disposed within the fluid collection tray 2516. The fluid collection tray 2516 is spaced vertically above the interconnecting region and is fluidly coupled to the first and second fluid outlets 2418 and 2420 (FIG. 24A) of the fluid catch plate 2100 (FIG. 21). In other words, the fluid collection tray 2516 is fluidly coupled to the fluid catch plate 2100. As such, fluid flowing through the fluid catch plate 2100 passes through the first and second fluid outlets 2418 and 2420 to be received within the fluid collection tray 2516. Once within the fluid collection tray 2516, fluid passes through the container valve 2518 (when the container valve 2518 is in an open position) and into fluid debris chamber 2502. In other words, container valve 2518 is configured to selectively fluidly couple the fluid collection tray 2516 to the fluid debris chamber 2502.

A first access door 2522 (shown in an open position) is configured to selectively extend over the first collection region 2504 and a second access door 2524 (shown in a closed position) is configured to selectively extend over the second collection region 2506. For example, the first and second access doors 2522 and 2524 may be pivotally coupled to a container body 2526 of the debris container 1602 such that the first and second access doors 2522 and 2524 pivot between the open and closed positions. When in the open position, fluid debris within the fluid debris chamber 2502 may be emptied from the fluid debris chamber 2502. In some instances, each of the first and second access doors 2522 and 2524 may include a seal 2528 configured to sealingly engage with the container body 2526. As also shown, in some instances, each of the first and second access doors 2522 and 2524 may include a respective door latch 2530 configured to releasably engage a corresponding door catch 2532 on the container body 2526. While the first and second access doors 2522 and 2524 are shown as being separate doors, other configurations are possible. For example, the first and second access doors 2522 and 2524 may be coupled together, forming a single door.

As shown, the debris container 1602 may include a grip 2534 for carrying the debris container 1602. The grip 2534 may extend within a central portion 2536 of the debris container 1602. For example, the central portion 2536 may generally correspond to a central third of the debris container 1602 in a longitudinal direction.

Figure 25B:
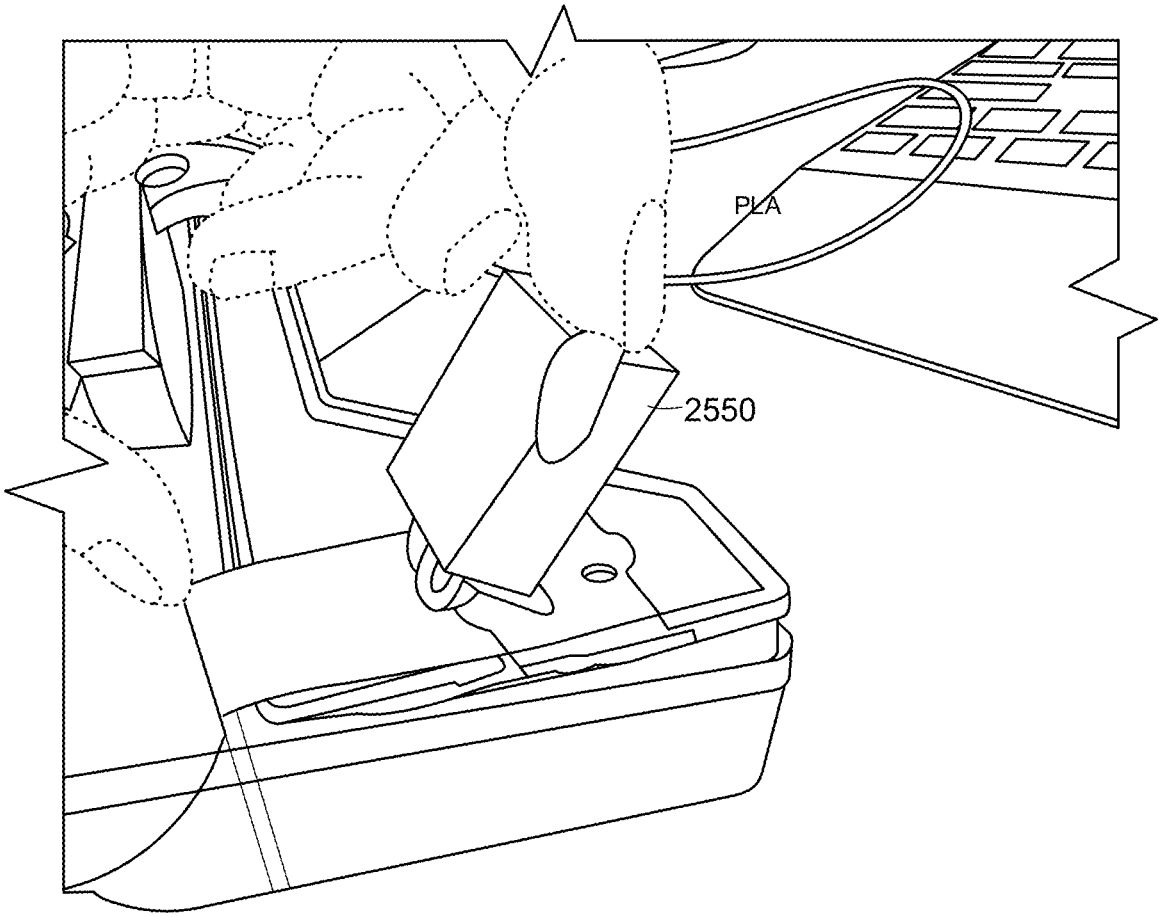
FIG. 25B shows a perspective view of an example of a vacuum valve for use with a debris container, consistent with embodiments of the present disclosure.

In some instances, one or more of the first and/or second access doors 2522 and/or 2524 may not include a door latch 2530 configured to engage the a corresponding door catch 2532. In these instances, the first and/or second access doors 2522 and/or 2524 may be retained in the closed position by creating a vacuum within the fluid debris chamber 2502. For example, removal of the removable cover 1600 (FIG. 16A) may cause a vacuum to be generated in the fluid debris chamber 2502 (e.g., by causing a piston configured to draw air from the fluid debris chamber 2502 to be actuated). By way of further example, removal of the debris container 1602 from the surface cleaning head 306 (FIG. 3A) may cause a vacuum to be generated in the fluid debris chamber 2502 (e.g., by causing a piston configured to draw air from the fluid debris chamber 2502 to be actuated). By way of still further example, a vacuum may be caused to be generated in the fluid debris chamber 2502 in response to a user grasping the grip 2534 (e.g., causing a piston configured to draw air from the fluid debris chamber 2502 to be actuated). To transition the first and/or second access doors 2522 and/or 2524 to the open position, the vacuum within the fluid debris chamber 2502 may be released through actuation of a vacuum valve 2550 (see, e.g., FIG. 25B). Actuation of the vacuum valve 2550 allows air to enter the fluid debris chamber 2502, releasing the vacuum. As shown in FIG. 25B, the vacuum valve 2550 may be used to transition the first and/or second access doors 2522 and/or 2524 to the open position. In other words, the vacuum valve 2550 may also be a grip point for a user to open the first and/or second access doors 2522 and/or 2524.

With reference to FIG. 26, the debris container 1602 may include a fluid level detector 2600 within the fluid debris chamber 2502. For example, the fluid level detector 2600 may be disposed within the second collection region 2506. The fluid level detector 2600 may include a float body 2602 pivotally connected to the debris container 1602 via a hinge 2604. The float body 2602 may be configured to actuate a switch (e.g., a hall-effect sensor) when a fluid level within the fluid debris chamber 2502 reaches a predetermined level (e.g., resulting in a generation of an alert to empty the fluid debris chamber 2502, disabling the agitator motor 1004, FIG. 10, disabling the pump 309, FIG. 3A, and/or the like). For example, when the switch is a hall-effect sensor, the fluid level detector 2600 may include a magnetic body capable of being detected by the hall-effect sensor when the fluid level reaches a predetermined level. Use of a hall-effect sensor may allow the debris container 1602 to electrically isolated from the surface cleaning device 300 (e.g., by including the hall-effect sensor in the surface cleaning head 306).

Figure 28:
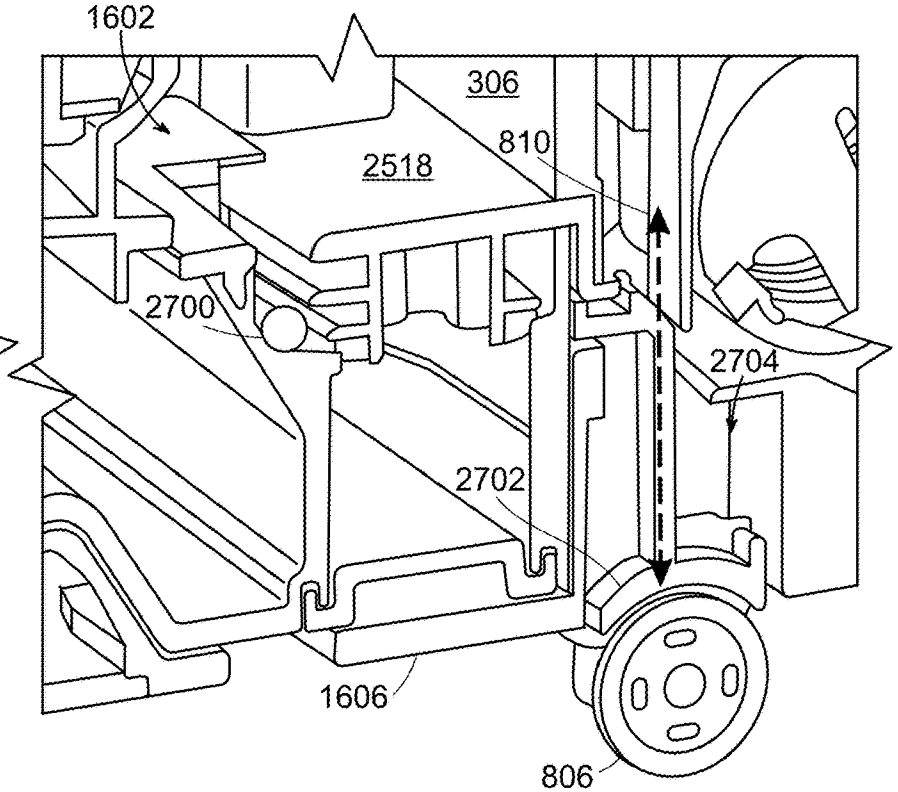
FIG. 28 shows a perspective cross-sectional view of the debris container of FIG. 25A received within the surface cleaning head of FIG. 8 when the surface cleaning head is at least partially lifted from the surface to be cleaned, consistent with embodiments of the present disclosure.
Figure 27:
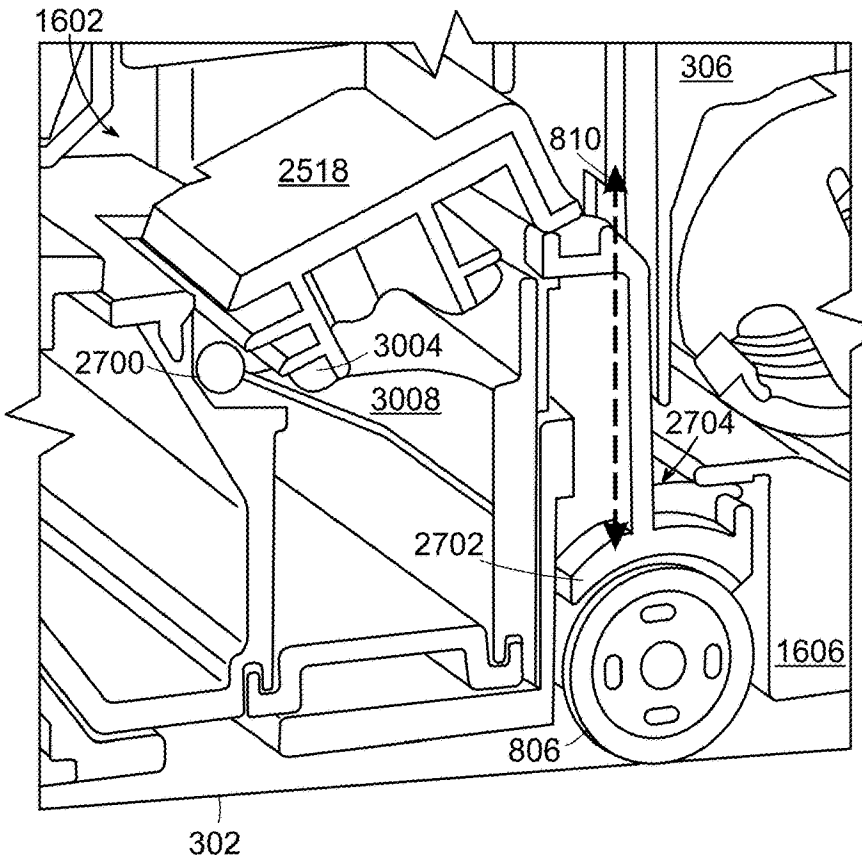
FIG. 27 shows a perspective cross-sectional view of the debris container of FIG. 25A received within the surface cleaning head of FIG. 8 when the surface cleaning head is resting on a surface to be cleaned, consistent with embodiments of the present disclosure.
Figure 29:
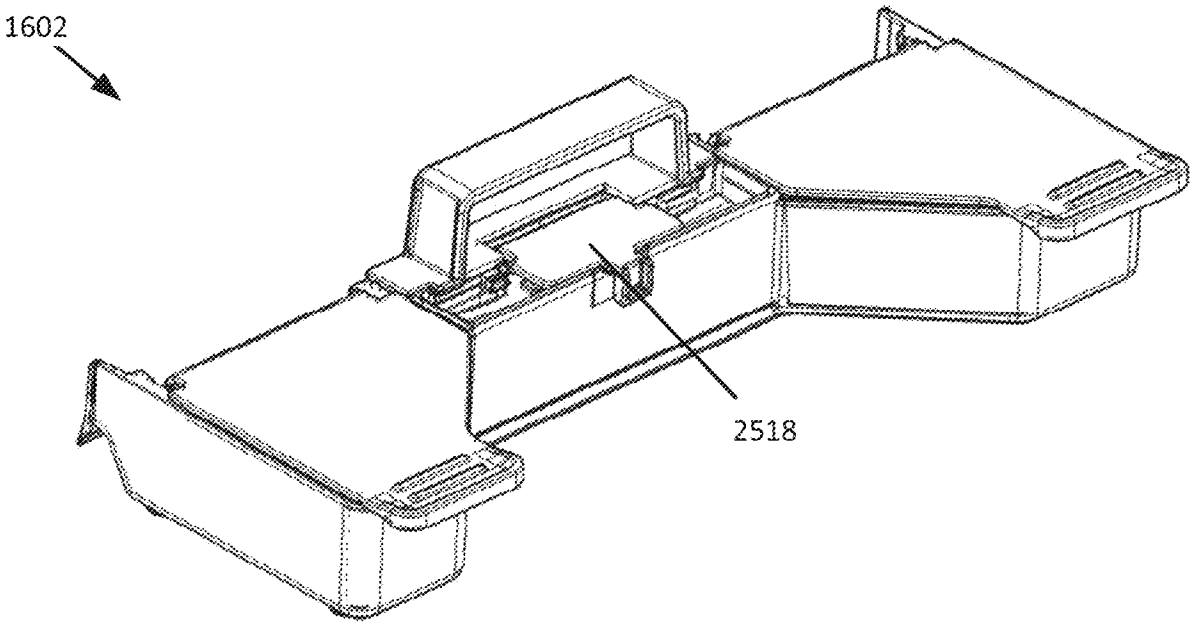
FIG. 29 shows another perspective view of the debris container of FIG. 25A, consistent with embodiments of the present disclosure.

FIG. 27 shows a cross-sectional view of a portion of the debris container 1602 received within the surface cleaning head 306 when the surface cleaning head 306 is resting on the surface to be cleaned 302. FIG. 28 shows a cross-sectional view of a portion of the debris container 1602 received within the surface cleaning head 306 when the surface cleaning head 306 is at least partially lifted from the surface to be cleaned 302. FIG. 29 shows a perspective view of the debris container 1602 when removed from the surface cleaning head 306.

As shown, the container valve 2518 is configured to transition between the open position (FIG. 27) and the closed position (FIG. 28) based on a state of engagement of the surface cleaning head 306 with the surface to be cleaned 302. The container valve 2518 is biased towards a closed position by a valve biasing mechanism 2700 (e.g., a spring such as a torsion spring) such that linear movement of a head plunger 2702 causes the container valve 2518 to transition between the open and closed positions.

For example, and as shown in FIG. 27, when the surface cleaning head 306 rests on the surface to be cleaned 302, the head plunger 2702 is urged in a direction of the container valve 2518 causing the container valve 2518 to move (e.g., pivot) towards the open position. In this example, the head plunger 2702 may be in a retracted position within a plunger receptacle 2704 of the surface cleaning head 306 (e.g., defined within the head body 1606 of the surface cleaning head 306).

By way of further example, and as shown in FIG. 28, when the surface cleaning head 306 is at least partially lifted from the surface to be cleaned 302, the head plunger 2702 is urged in a direction away from the container valve 2518 (e.g., by gravity and/or a biasing mechanism) such that the valve biasing mechanism 2700 urges the container valve 2518 towards the closed position. In this example, the head plunger 2702 may be in an extended position relative to the plunger receptacle 2704, wherein in the extended position, the head plunger 2702 extends from the plunger receptacle 2704 by a distance greater than in the retracted position. As also shown, the auxiliary wheel 806 may be rotatably coupled to the head plunger 2702 and configured to move linearly with the head plunger 2702 along the actuation axis 810. As such, engagement between the auxiliary wheel 806 and the surface to be cleaned 302 may result in the actuation of the container valve 2518.

By way of still further example, and as shown in FIG. 29, when the debris container 1602 is removed from the surface cleaning head 306 (e.g., for purposes of emptying the debris container 1602), the container valve 2518 is urged towards the closed position by the valve biasing mechanism 2700.

Such a configuration may mitigate (e.g., prevent) inadvertent spilling from the fluid debris chamber 2502 when emptying the debris container 1602.

In other words, in view of the above examples, the container valve 2518 may generally be described as being configured to mitigate (e.g., prevent) spilling of fluid from fluid debris chamber 2502 when the surface cleaning head 306 is at least partially lifted from the surface to be cleaned 302 or when the debris container 1602 is removed from the surface cleaning head 306.

Figure 30:
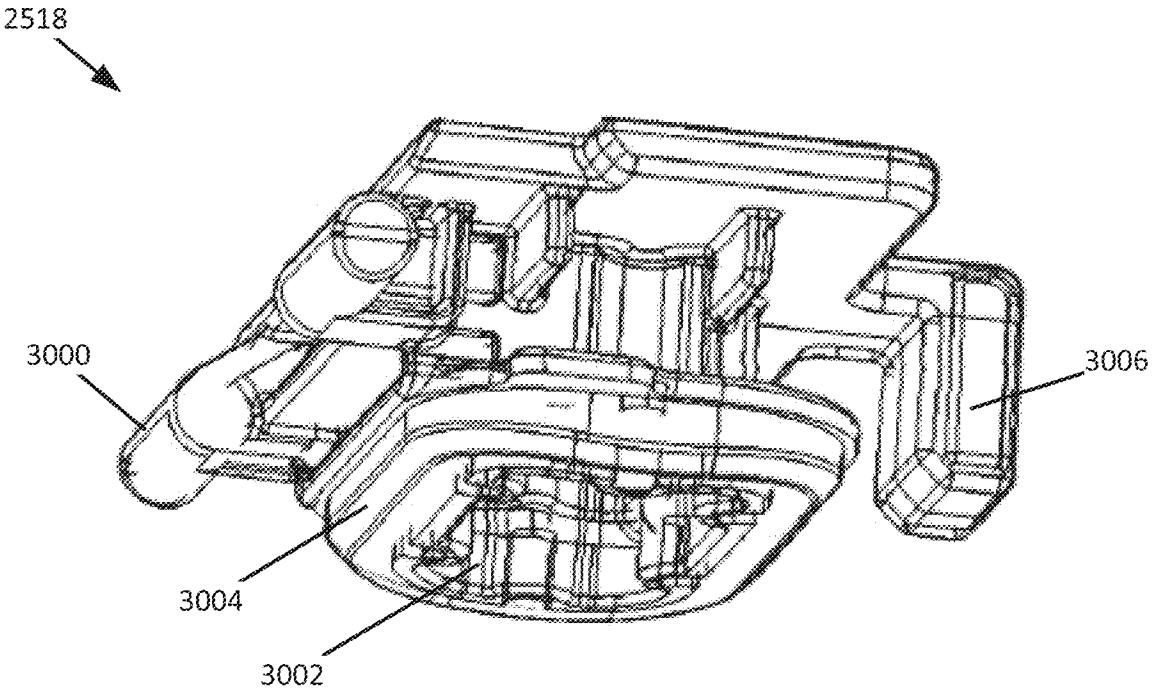
FIG. 30 shows a perspective view of a container valve of the debris container of FIG. 25A, consistent with embodiments of the present disclosure.

FIG. 30 is a perspective view of the container valve 2518 decoupled from the debris container 1602. As shown, the container valve 2518 includes a hinge portion 3000 configured to be pivotally coupled with the debris container 1602, a valve body 3002 having a scal 3004 extending therearound, and an actuation portion 3006 configured to engage (e.g., contact) the head plunger 2702. The valve body 3002 is configured to be at least partially received within a tray opening 3008 (see, FIG. 27) of the fluid collection tray 2516 (FIG. 25A) such that at least a portion of the seal 3004 sealingly engages with at least a portion of the tray opening 3008. The hinge portion 3000 and the actuation portion 3006 are disposed on opposing sides of the valve body 3002.

Figure 31:
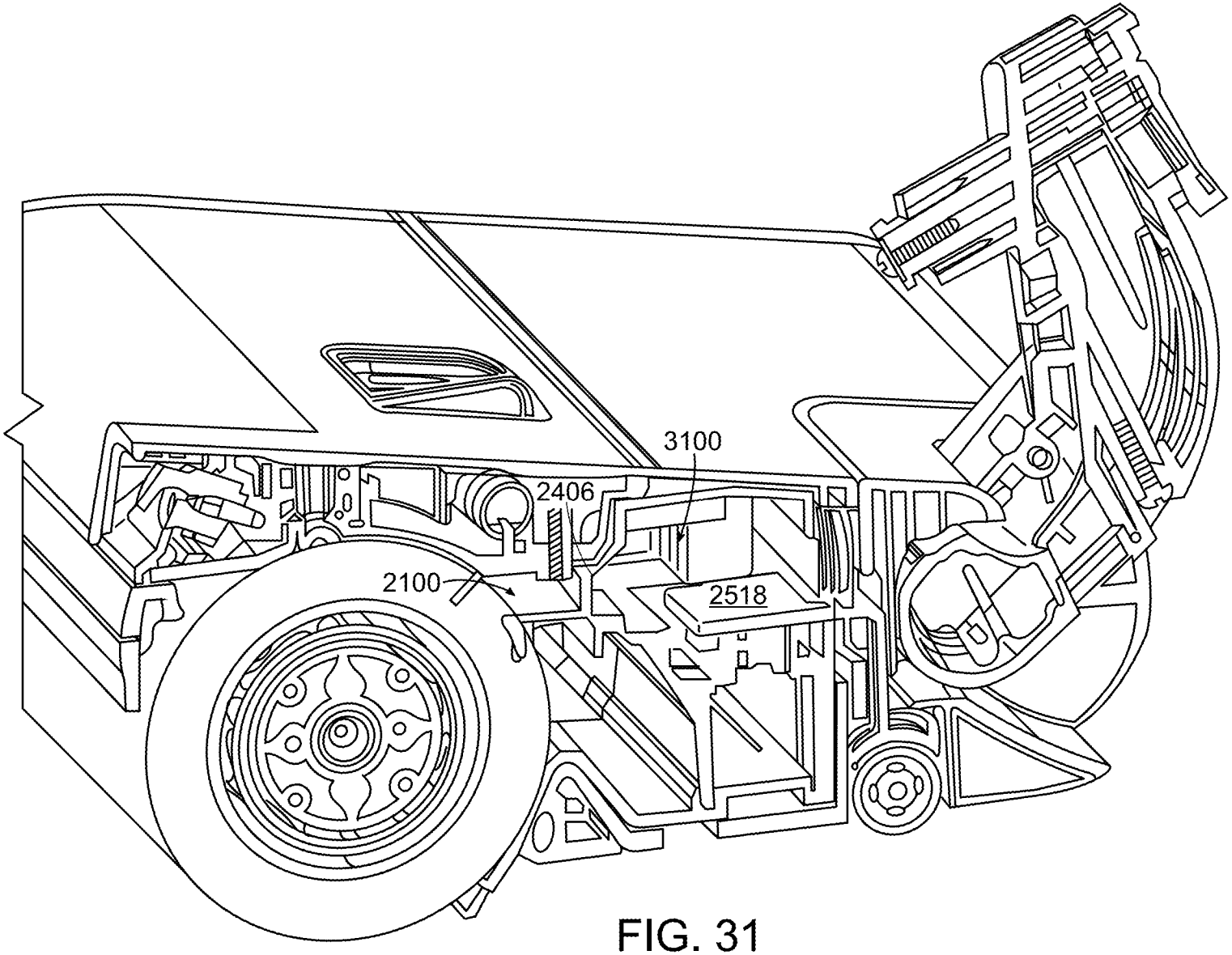
FIG. 31 shows another perspective cross-sectional view of the surface cleaning head of FIG. 8, consistent with embodiments of the present disclosure.

As shown in FIG. 31, the fluid catch plate 2100 defines a pivot cavity 3100 within which the container valve 2518 pivots when transitioning between the open and closed positions. The pivot cavity 3100 may generally correspond to a region disposed rearward of the fluid diverter 2406.

Figure 32A:
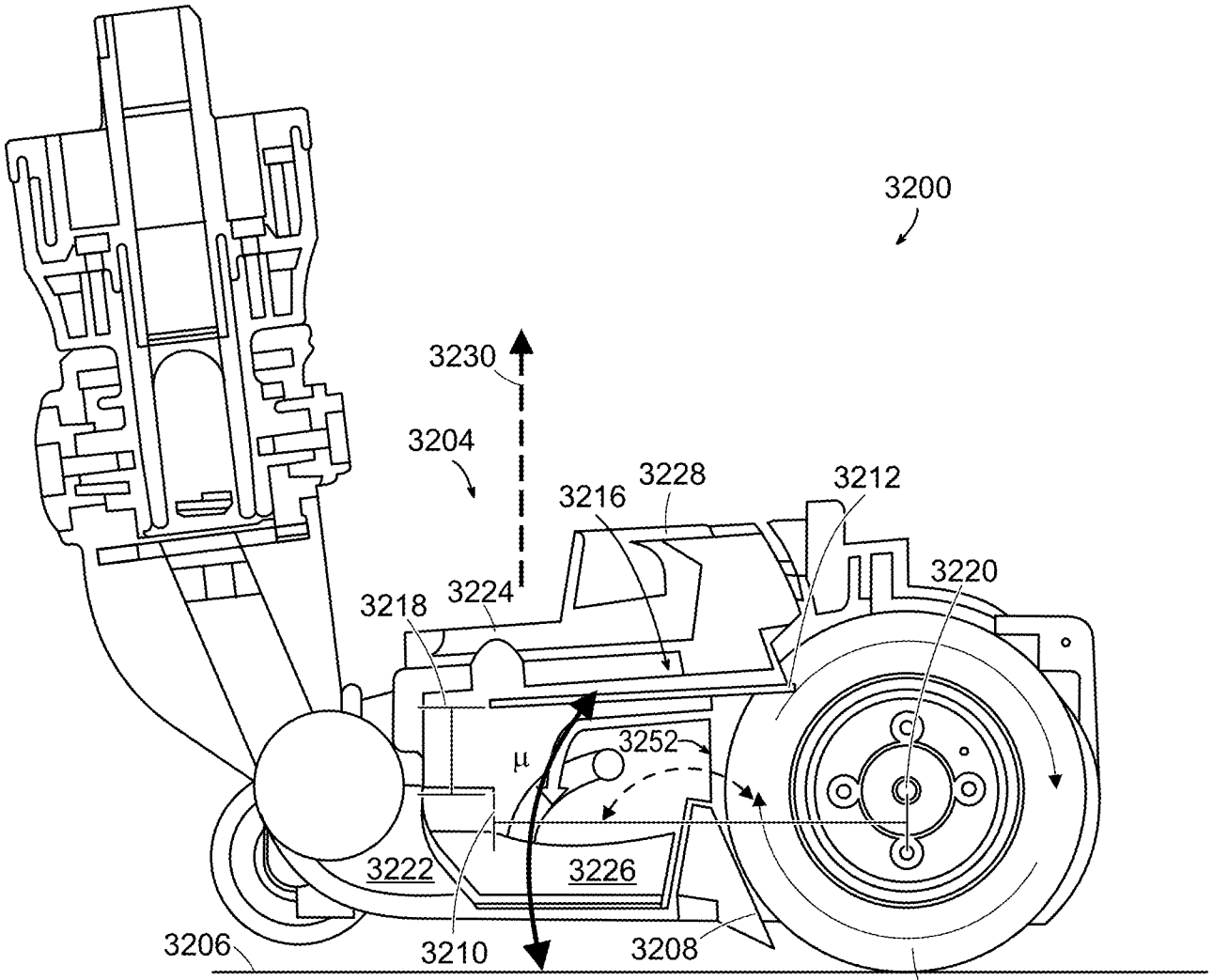
FIG. 32A shows a cross-sectional view of an example of a surface cleaning head, consistent with embodiments of the present disclosure.

FIG. 32A shows a cross-sectional view of a surface cleaning head 3200, which is an example of the surface cleaning head 104 of FIG. 1. As shown, the surface cleaning head 3200 includes an agitator 3202, a debris container 3204 configured to cooperate with the agitator 3202 to collect debris from a surface to be cleaned 3206, and a squeegee 3208 configured to cooperate with the agitator 3202 to guide debris from the surface to be cleaned 3206 into the debris container 3204. The squeegee 3208 may be coupled to a head body 3210 of the surface cleaning head 3200 or to the debris container 3204. The squeegee 3208 may engage one or more of the agitator 3202 and/or the surface to be cleaned 3206.

As shown, the debris container 3204 includes a fluid stripper 3212 which engages with (e.g., protrudes into) at least a portion of the agitator 3202 such that at least a portion of any fluid absorbed within the agitator 3202 is stripped from the agitator 3202 as a result of the engagement. The fluid stripper 3212 may be positioned above at least a portion of a container inlet 3252 of the debris container 3204. The fluid stripper 3212 may be formed, at least partially of, a plastic (e.g., Acrylonitrile Butadiene Styrene, "ABS"), a metal (e.g., a stainless steel alloy, an aluminum alloy, and/or any other metal), and/or any other suitable material.

The stripped fluid may flow along at least a portion of a run-off surface 3216 and drip into the debris container 3204. As such, the run-off surface 3216 may be angled such that a vertical separation distance 3218 between the run-off surface 3216 and a rotation axis 3220 of the agitator 3202 decreases within an increasing horizontal separation distance 3222 from the rotation axis 3220. For example, the run-off surface 3216 may form a run-off angle μ with the surface to be cleaned 3206 that is greater than 0° and less than 90°. Such a configuration may encourage stripped fluid to flow along the run-off surface 3216. One or more of the fluid stripper 3212 and/or the run-off surface 3216 may be coupled to or integrally formed from a portion of the debris container 3204 (e.g., a lid 3224 of the debris container 3204).

As shown, the debris container 3204 includes a single collection chamber 3226 configured to collect solid and fluid debris. The debris container 3204 may further include a grip 3228 (e.g., a handle). The grip 3228 may be coupled to or integrally formed from the lid 3224. The grip 3228 and lid 3224 may be exposed during use (e.g., define at least a portion of a top surface of the surface cleaning head 3200). Such a configuration may enable removal along a substantially vertical removal axis 3230.

Figure 32C:
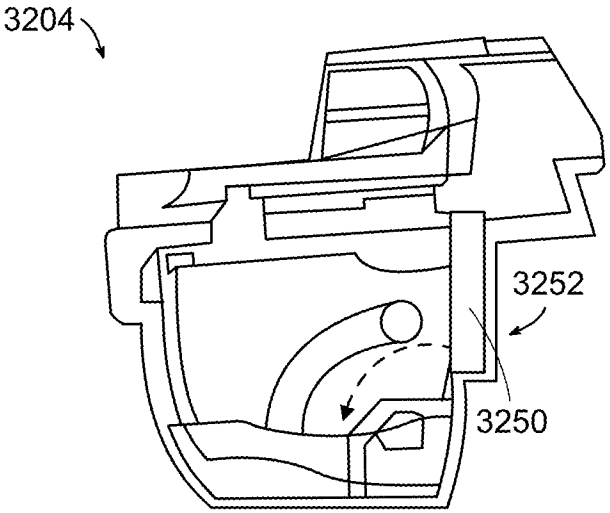
FIG. 32C is a cross-sectional view of the debris container of FIG. 32B with the pivoting door in a closed position, consistent with embodiments of the present disclosure.
Figure 32B:
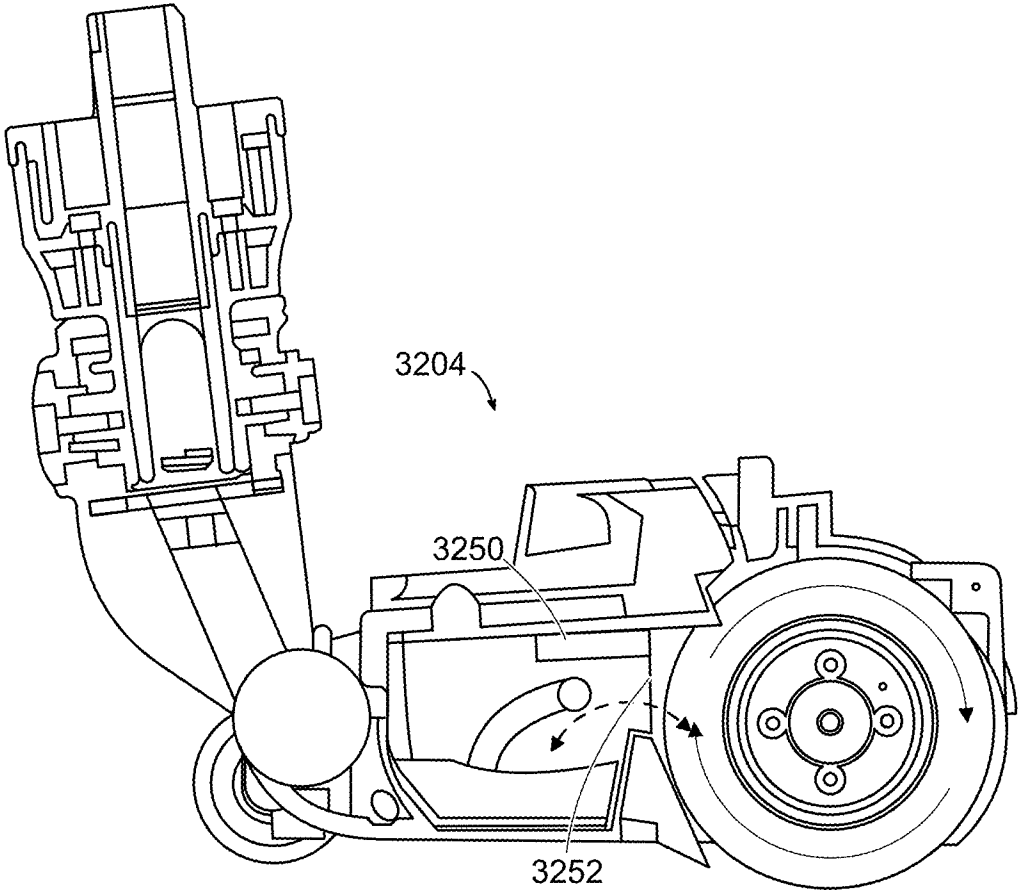
FIG. 32B shows a cross-sectional view of an example of the surface cleaning head of FIG. 32A having a debris container with a pivoting door in an open position, consistent with embodiments of the present disclosure.

In some instances, and with reference to FIG. 32B, the debris container 3204 may include a pivoting door 3250 configured to selectively open and close the container inlet 3252. For example, the pivoting door 3250 may be configured to pivot from an open position to a closed position (FIG. 32C) in response to the debris container 3204 being removed from the surface cleaning head 3200. By way of further example, the pivoting door 3250 may be configured to pivot from the closed position to the open position in response to the debris container 3204 being inserted into the surface cleaning head 3200 (e.g., after emptying). The pivoting door 3250 may be biased towards the closed position, which may result in an automatic closing of the pivoting door 3250 when the debris container 3204 is removed from the surface cleaning head 3200. When in the closed position, the pivoting door 3250 may completely close or substantially close the container inlet 3252 to mitigate (e.g., prevent) debris from exiting from the container inlet 3252.

Figure 34:
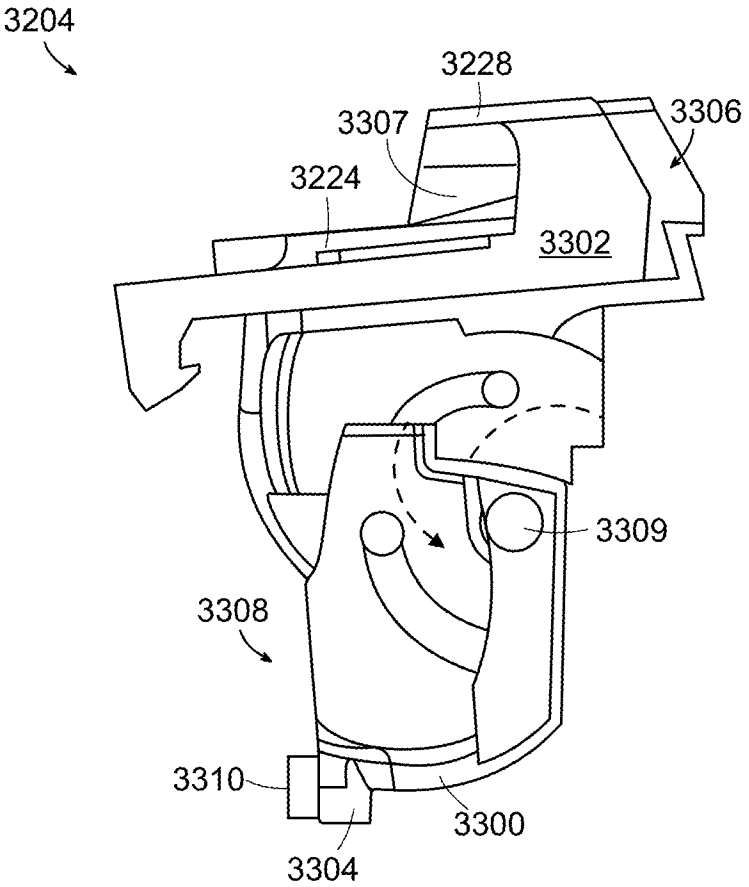
FIG. 34 shows another cross-sectional view of the debris container in FIG. 33 in an emptying position, consistent with embodiments of the present disclosure.
Figure 33:
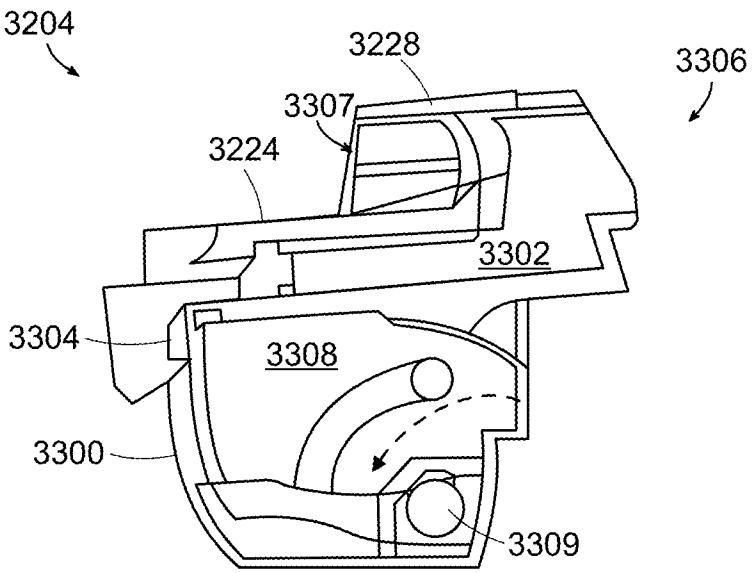
FIG. 33 shows a cross-sectional view of a debris container in a transport position, consistent with embodiments of the present disclosure.

FIG. 33 shows the debris container 3204 removed from surface cleaning head 3200 (FIG. 32A) in a transport position (the transport position generally corresponds to an in-use position when the debris container 3204 is disposed within the surface cleaning head 3200) and FIG. 34 shows the debris container 3204 removed from surface cleaning head 3200 in an emptying position.

As shown, a collection body 3300 of the debris container 3204 is pivotally coupled to the lid 3224 (e.g., forming a "clam-shell" configuration). The lid 3224 includes a latch 3302 configured to releasably engage a catch 3304 on the debris container 3204. The latch 3302 is configured to transition (e.g., in response to a sliding motion) between a retaining position (FIG. 33) and a releasing position (FIG. 34). When in the releasing position, the collection body 3300 is capable of pivoting relative to the lid 3224, transitioning the debris container 3204 from the transport position to the emptying position. As such, the latch 3302 may generally be described as being configured to selectively retain the debris container 3204 is in the transport position. As shown, an actuation end 3306 of the latch 3302 may be disposed within the grip 3228. In some instances, the actuation end 3306 of the latch 3302 may be at least partially obscured by a portion of the surface cleaning head 3200 when the debris container 3204 is coupled to the surface cleaning head 3200. For example, a finger cavity 3307 of the grip 3228 may be opposite the actuation end 3306 of the latch 3302 (e.g., such that the actuation end 3306 may be actuated by a thumb of a user after the debris container 3204 is removed from the surface cleaning head 3200). Such a configuration, may prevent the accidental actuation of the latch 3302 during removal of the debris container 3204 from the surface cleaning head 3200.

When transitioning between the transport and emptying positions, the collection body 3300 may pivot through a pivot angle of about 90°. In some instances, a biasing mechanism 3309 (e.g., a spring) may urge the collection body 3300 to pivot (e.g., in a direction away from the lid 3224, transitioning the debris container 3204 towards the emptying position). Use of the biasing mechanism 3309 to urge the collection body 3300 to pivot away from the lid 3224 may encourage debris to exit the collection body 3300 via an emptying opening 3308 of the collection body 3300. In some instances, a seal 3310 may extend around at least a portion of the emptying opening 3308, wherein the seal 3310 is configured to sealingly engage with at least a portion of the lid 3224 when the debris container 3204 is in the transport position. Such a configuration may mitigate (e.g., prevent) leakage of dirty fluid at the interface between the lid 3224 and the collection body 3300.

Figure 35:
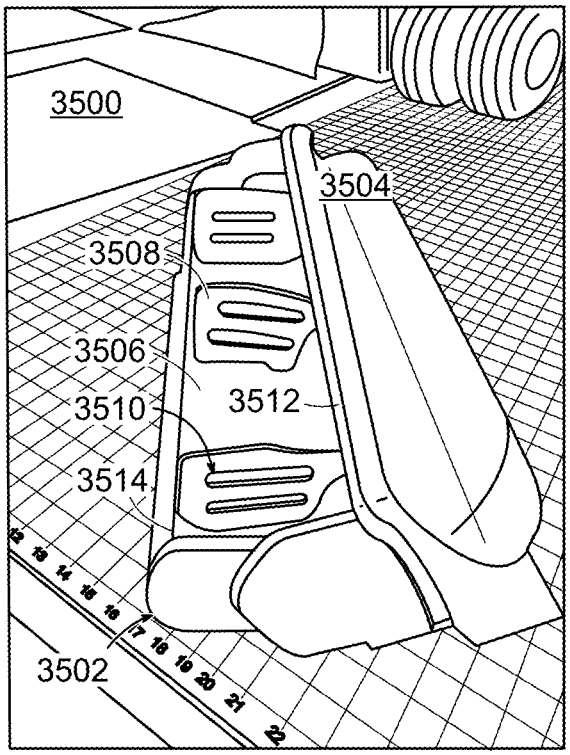
FIG. 35 shows a perspective view of an example of a debris container, consistent with embodiments of the present disclosure.
Figure 36:
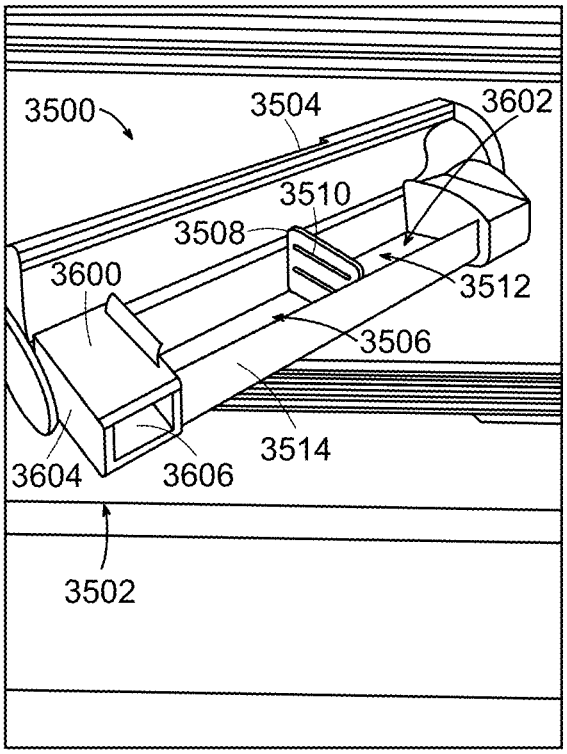
FIG. 36 shows a perspective view of an example of a debris container, consistent with embodiments of the present disclosure.

FIG. 35 shows a perspective view of a debris container 3500, which is an example of the debris container 3204 of FIG. 32. As shown, the debris container 3500 includes a collection body 3502 and a lid 3504 pivotally coupled to the collection body 3502. The collection body 3502 defines at least a portion of a collection chamber 3506. The collection chamber 3506 may include one or more spaced apart baffles 3508 extending therein. Each of the spaced apart baffles 3508 may include at least one fluid passthrough 3510 and extend from a container inlet 3512 of the debris container 3204 towards a rear end wall 3514 of the debris container 3204. In operation, the one or more spaced apart baffles 3508 may mitigate (e.g., prevent) an amount of fluid sloshing within the debris container 3204 (which may reduce a quantity of fluid that exits from the container inlet 3512). In some instances, and as shown in FIG. 36, one or more of the one or more baffles 3508 may include a top wall 3600, wherein the top wall 3600 is spaced apart from a bottom wall 3602 of the collection body 3502. In some instances, for example, the top wall 3600 may extend from a respective baffle 3508 towards a longitudinal sidewall 3604 (e.g., a closest longitudinal sidewall 3604) of the collection body 3502, forming a baffle chamber 3606.

Figure 37:
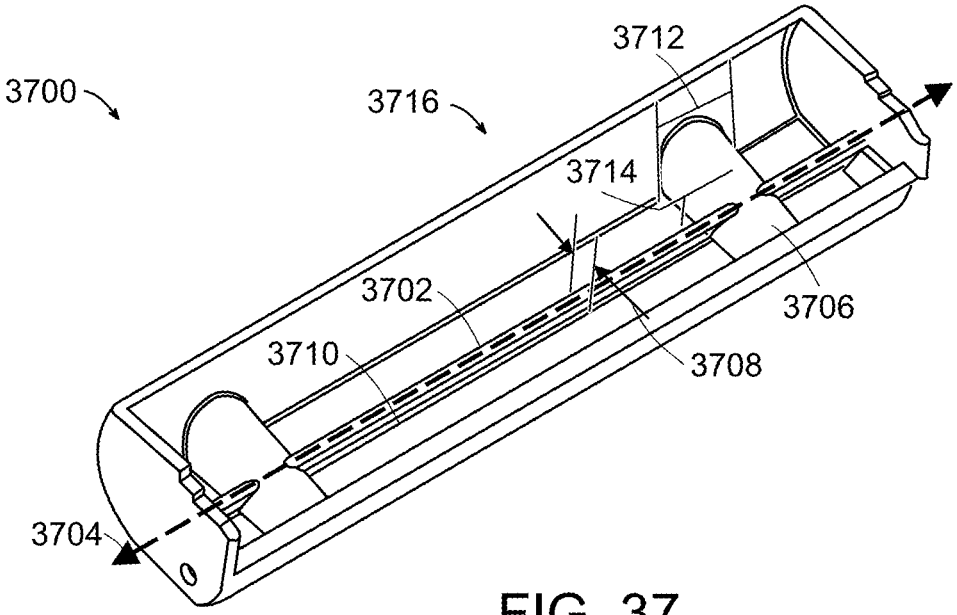
FIG. 37 shows a perspective view of an example of a collection body of a debris container, consistent with embodiments of the present disclosure.

FIG. 37 shows a perspective view of a collection body 3700, which may be an example of the collection body 3300 of FIG. 33. As shown, the collection body 3700 includes a first rib 3702 extending longitudinally along a collection body longitudinal axis 3704 and at least one second rib 3706 extending transverse to (e.g., perpendicular to) the first rib 3702. The first rib 3702 has a first rib width 3708 and a first rib height 3710 and the second rib 3706 has a second rib width 3712 and a second rib height 3714. The first rib width 3708 may be less than the second rib width 3712 and the first rib height 3710 may be less than the second rib height 3714. The first and second ribs 3702 and 3706 may be configured to cooperate to mitigate (e.g., prevent) sloshing of fluid within the collection body 3700. In some instances, the first rib 3702 may be centrally disposed within the collection body 3700 and the second rib 3706 may be disposed within an end region 3716 (e.g., an end third) of the collection body 3700.

Figure 38:
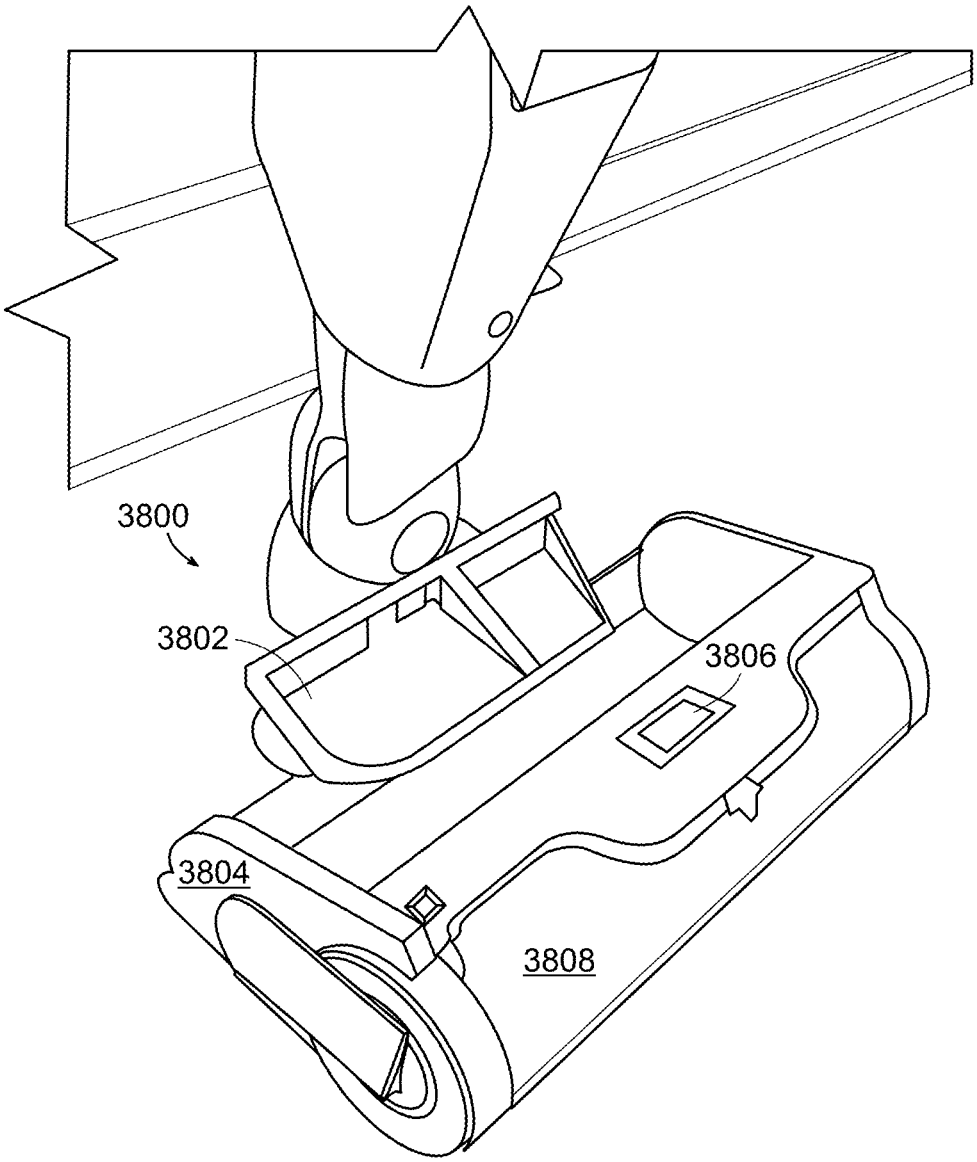
FIG. 38 shows a perspective view of an example of a surface cleaning head, consistent with embodiments of the present disclosure.

FIG. 38 shows a perspective view of a surface cleaning head 3800, which is an example of the surface cleaning head 104 of FIG. 1. As shown, the surface cleaning head 3800 includes a debris container lift 3802 pivotally coupled to a head body 3804 of the surface cleaning head 3800. The debris container lift 3802 is configured to selectively receive a debris container (e.g., the debris container 116 of FIG. 1). The debris container lift 3802 is configured to transition between an in-use position and a removal position (e.g., such that the debris container can be removed to be emptied). The debris container lift 3802 may be biased to pivot towards the removal position. As such, a lift latch 3806 may be provided to retain the debris container lift 3802 in the in-use position. Additionally, or alternatively, the lift latch 3806 may be configured to encourage a consistent engagement between a portion of the debris container (e.g., a fluid stripper) and an agitator 3808.

Figure 39:
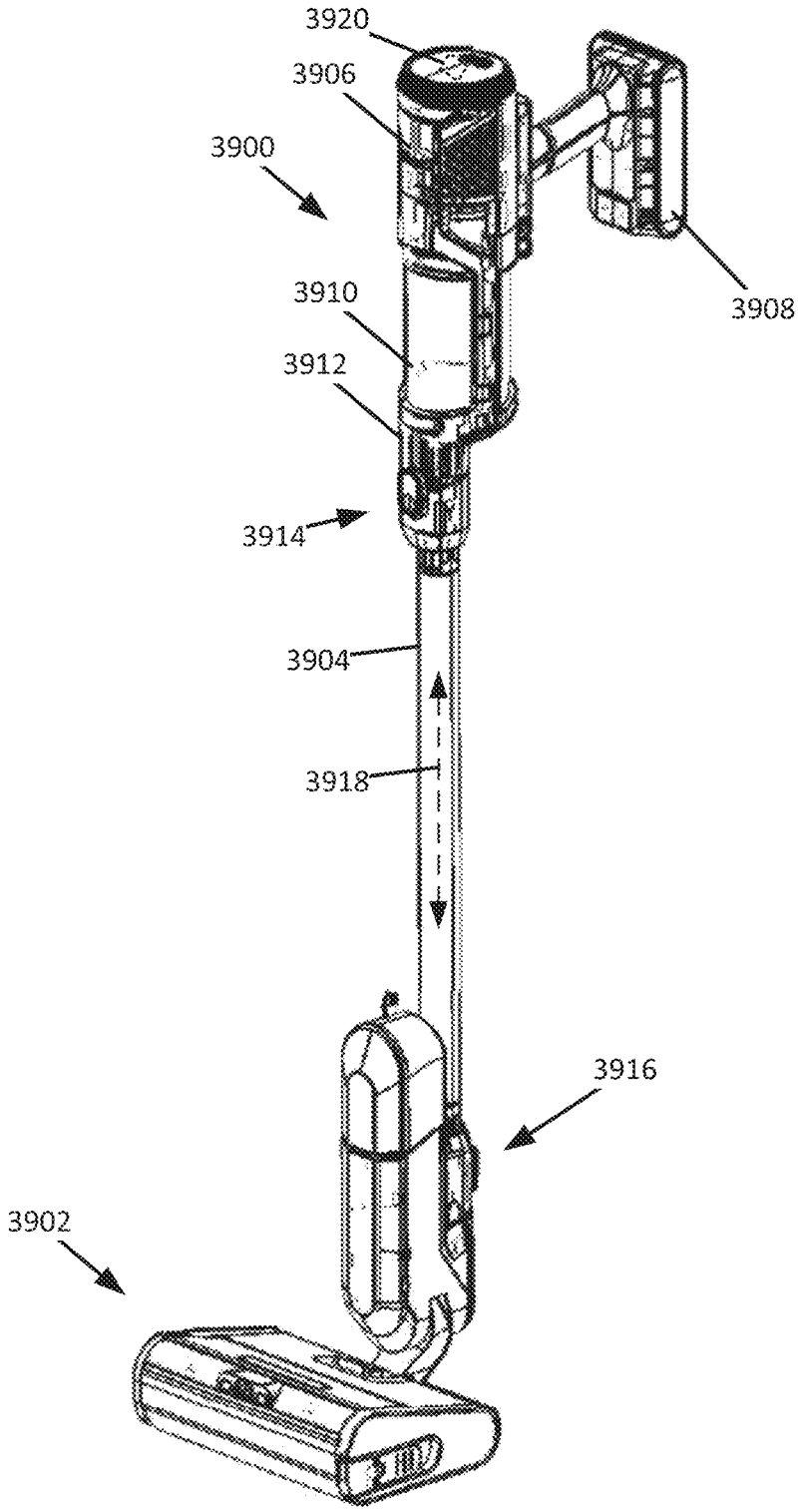
FIG. 39 shows a perspective view of an example a hand-held vacuum cleaner coupled to a surface cleaning head, consistent with embodiments of the present disclosure.

FIG. 39 shows a perspective view of a hand-held vacuum cleaner 3900 coupled to a surface cleaning head 3902 (e.g., any one of the surface cleaning heads disclosed herein, such as, for example, surface cleaning head 104 of FIG. 1) via a wand 3904. The hand-held vacuum cleaner 3900 includes a suction motor 3906, a power supply 3908, a dust cup 3910, and an inlet 3912. A first end 3914 of the wand 3904 is configured to selectively couple to the inlet 3912 and a second end 3916 of the wand 3904 to selectively couple to the surface cleaning head 3902, the first end 3914 being opposite the second end 3916 along a longitudinal axis 3918 of the wand 3904. The wand 3904 is further configured to electrically couple the power supply 3908 to the surface cleaning head 3902 such that one or more electrical components of the surface cleaning head 3902 may be powered by the power supply 3908. The suction motor 3906 is fluidly coupled to the dust cup 3910, the inlet 3912, and the wand 3904. However, the suction motor 3906 may not be fluidly coupled to the surface cleaning head 3902 (e.g., suction is not generated within the surface cleaning head 3902). Additionally, or alternatively, the suction motor 3906 may be disabled when the surface cleaning head 3902 is electrically coupled with the power supply 3908.

Figure 40:
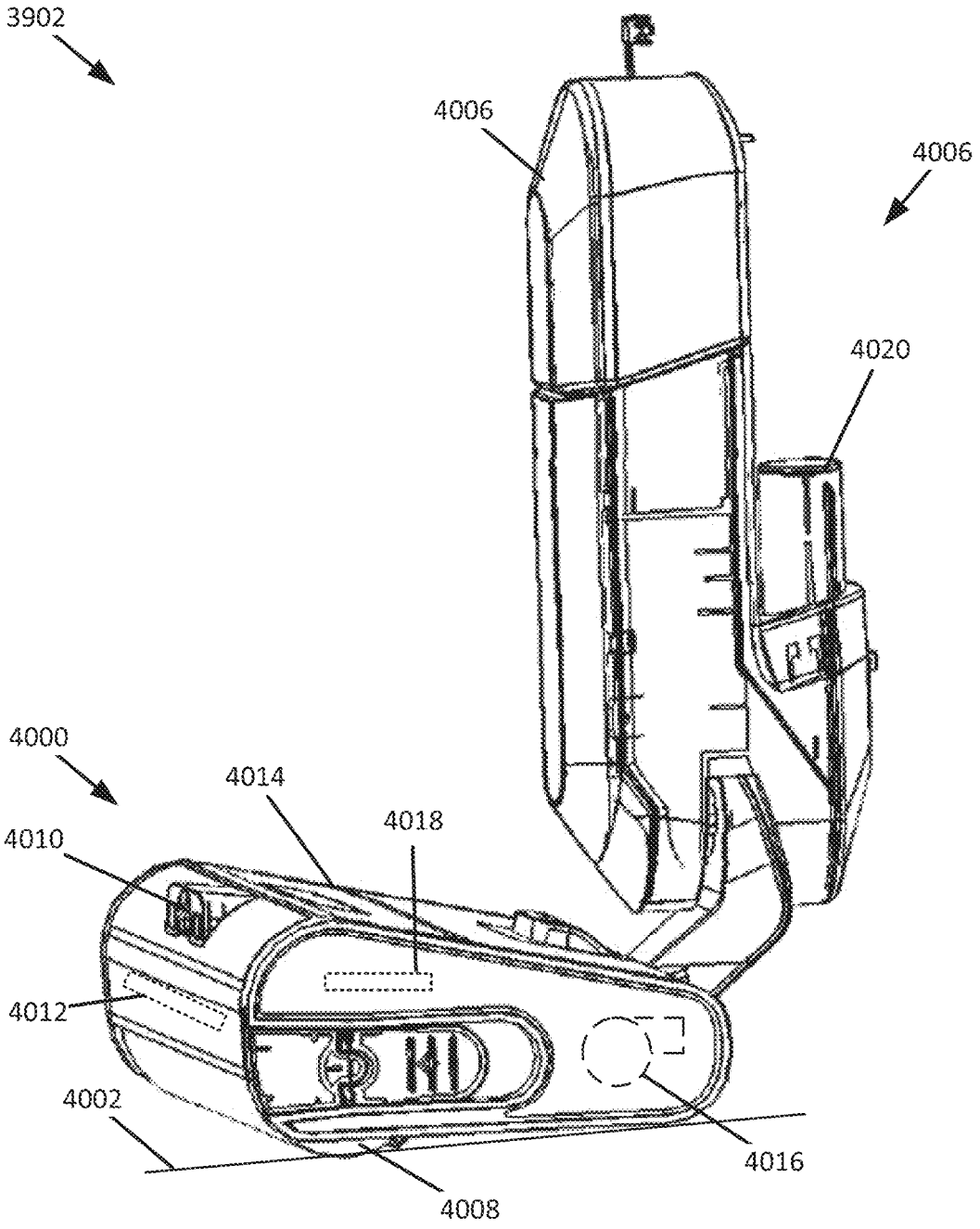
FIG. 40 shows a perspective view of the surface cleaning head of FIG. 39, consistent with embodiments of the present disclosure.
Figure 41:
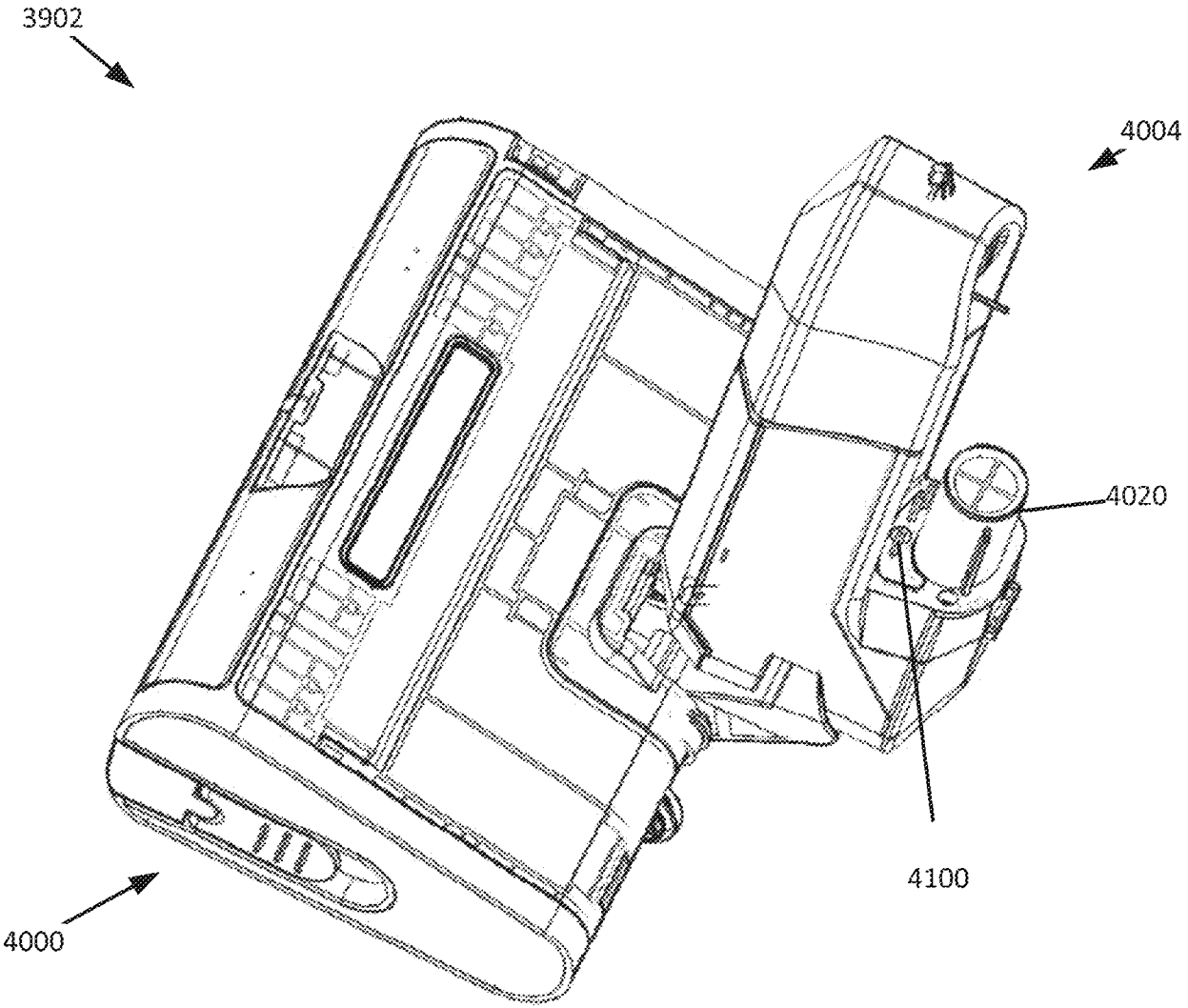
FIG. 41 shows another perspective view of the surface cleaning head of FIG. 40, consistent with embodiments of the present disclosure.

FIGS. 40 and 41 show a perspective view of the surface cleaning head 3902. As shown, the surface cleaning head 3902 includes a head body 4000 for movement along a surface to be cleaned 4002 (e.g., a floor), a neck 4004 pivotally coupled to the head body 4000, and a fluid reservoir 4006. The head body 4000 includes an agitator 4008 (e.g., a brush roll) configured to engage the surface to be cleaned 4002 and one or more of a spray nozzle 4010 for spraying liquid or steam on to the surface to be cleaned 4002 and/or a manifold 4012 (shown schematically in hidden lines) for distributing liquid or steam to the agitator 4008 and/or the surface to be cleaned 4002. The head body 4000 may further include a debris container 4014 configured to receive wet and/or dry debris. In some instances, the debris container 4014 may be separated into a first compartment (e.g., a solid debris chamber) and a second compartment (e.g., a fluid debris chamber). In operation, the agitator 4008 is configured to urge debris into the debris container 4014 without the use of suction.

The fluid reservoir 4006 is fluidly coupled to the spray nozzle 4010 and/or the manifold 4012. For example, a supply pump 4016 may be configured to urge liquid from the fluid reservoir 4006 to the spray nozzle 4010 and/or the manifold 4012. When steam is generated, the supply pump 4016 may be configured to urge fluid through a boiler 4018, wherein steam exiting the boiler 4018 passes through to the spray nozzle 4010 and/or the manifold 4012. As shown, the fluid reservoir 4006 is coupled (e.g., removably coupled) to the neck 4004. However, in some instances, the fluid reservoir 4006 may be coupled to the head body 4000.

The neck 4004 may include one or more neck electrical connectors 4100 for electrically coupling to the power supply 3908 such the power supply 3908 may provide power to one or more components of the surface cleaning head 3902 (e.g., sensors, the supply pump 4016, and/or a drive motor of the agitator 4008). In some instances, the one or more neck electrical connectors 4100 may be configured to communicatively couple the hand-held vacuum cleaner 3900 (e.g., a controller 3920 of the hand-held vacuum cleaner 3900) to one or more components of the surface cleaning head 3902 (e.g., sensors, the supply pump 4016, and/or a drive motor of the agitator 4008).

The neck 4004 may further include a suction plug 4020 configured to be received within the second end 3916 of the wand 3904. In other words, the suction plug 4020 may be configured to obstruct (or block) a suction path extending within the wand 3904.

Figure 42:
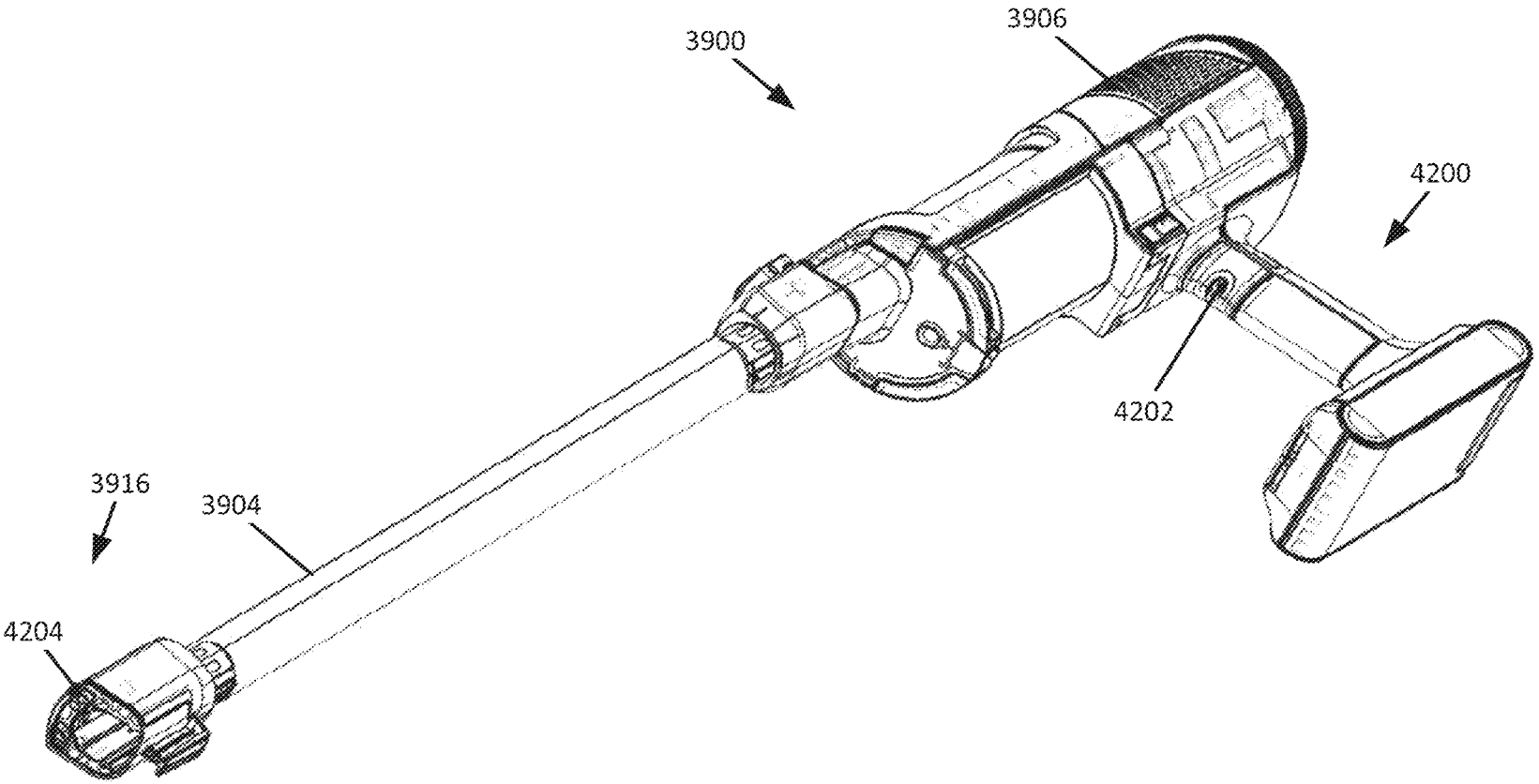
FIG. 42 shows a perspective view of the hand-held vacuum cleaner of FIG. 39 coupled to a wand, consistent with embodiments of the present disclosure.

FIG. 42 is a perspective view of the hand-held vacuum cleaner 3900 coupled with the wand 3904. As shown, the hand-held vacuum cleaner 3900 further includes a handle 4200 having an actuator 4202 (e.g., a tactile switch) configured to receive an input from a user. The function of the actuator 4202 may be based, at least in part, on whether the surface cleaning head 3902 is electrically coupled to the hand-held vacuum cleaner 3900. For example, when the surface cleaning head 3902 is electrically coupled to the hand-held vacuum cleaner 3900, the actuator 4202 may control the supply pump 4016 (e.g., to control a rate at which and/or an amount of liquid passing through the spray nozzle 4010 and/or the manifold 4012). By way of further example, when the surface cleaning head 3902 is not electrically coupled to the hand-held vacuum cleaner 3900, the actuator 4202 may control the suction motor 3906 (e.g., to control a quantity of suction generated). By way of still further example, when a secondary nozzle (e.g., a suction nozzle having an agitator) is electrically coupled with the hand-held vacuum cleaner 3900, the actuator 4202 may control one or more cleaning features of the secondary nozzle (e.g., an agitator speed and/or an illumination source). In these examples, the hand-held vacuum cleaner 3900 is configured to determine whether a cleaning accessory (e.g., the surface cleaning head 3902 or a secondary nozzle) is electrically coupled to the hand-held vacuum cleaner 3900, if a cleaning accessory is detected, the hand-held vacuum cleaner 3900 further determines what type of cleaning accessory is electrically coupled to the hand-held vacuum cleaner 3900, and adjusts a function of the actuator 4202 based, at least in part, on one or more of the determinations.

As also shown, the second end 3916 of the wand 3904 includes one or more wand electrical connectors 4204 configured to cooperate with the neck electrical connectors 4100 (FIG. 41). The wand electrical connectors 4204 are configured to be electrically and/or communicatively coupled with the hand-held vacuum cleaner 3900.

An example of a surface cleaning device, consistent with the present disclosure, may include an upright section and a surface cleaning head pivotally coupled to the upright section. The surface cleaning head may include a fluid distributor configured to distribute a cleaning fluid, an agitator configured to absorb at least a portion of the distributed cleaning fluid and to agitate debris on the surface to be cleaned, a fluid stripper configured to remove, from the agitator, at least a portion of the distributed cleaning fluid absorbed by the agitator, a debris container, and a removable cover extending over at least a portion of the debris container and at least a portion of the agitator. The debris container may include a solid debris chamber configured to collect at least a portion of the debris agitated from the surface to be cleaned and a fluid debris chamber configured to collect at least a portion of the fluid removed from the agitator by the fluid stripper. The removable cover may include a fluid catch plate configured to transfer at least a portion of the cleaning fluid removed from the agitator by the fluid stripper to the fluid debris chamber, the fluid catch plate being configured to selectively transition between an in-use position and a cleaning position when the removable cover is removed from the surface cleaning head.

In some instances, the fluid catch plate may be pivotally coupled to the removable cover and may be configured to pivot between the in-use position and the cleaning position when the removable cover is removed from the surface cleaning head. In some instances, the fluid catch plate may include a collecting region, a first channel, and a second channel, the collecting region being disposed forwardly of the first channel and the second channel. In some instances, the fluid catch plate may include a fluid diverter extending between the first channel and the second channel. In some instances, the fluid catch plate may include a first fluid grate extending between the first channel and the collecting region and a second fluid grate extending between the second channel and the collecting region. In some instances, the debris container may include a fluid collection tray fluidly coupled to the fluid catch plate and a container valve disposed within the fluid collection tray, the container valve configured to selectively fluidly couple the fluid collection tray with the fluid debris chamber. In some instances, the container valve may be configured to transition between an open position and a closed position based on a state of engagement of the surface cleaning head with the surface to be cleaned. In some instances, the container valve may be biased towards the closed position. In some instances, the surface cleaning device may further include a multi-axis pivot joint pivotally coupling the upright section to the surface cleaning head, wherein the multi-axis pivot joint is configured such that the upright section is pivotable about at least a recline axis and a side-to-side pivot axis. In some instances, the multi-axis pivot joint may include a pivot body and a paddle pivotally coupled to the pivot body, the paddle being configured to pivot between a locked position and an unlocked position, the paddle pivoting between the locked position and the unlocked position based on a rotational position of the upright section about the recline axis. In some instances, in the locked position, the paddle may be configured to substantially prevent the upright section from pivoting about the side-to-side pivot axis and, in the unlocked position, the paddle does not substantially interfere with movement of the upright section about the side-to-side pivot axis. In some instances, the paddle may include a retaining portion and a triggering portion, the retaining portion being configured to selectively engage a portion of the upright section to substantially prevent the upright section from pivoting about the side-to-side pivot axis and the triggering portion being configured to engage with a portion of the surface cleaning head. In some instances, the fluid distributor may include at least one of a spray nozzle or a steam manifold.

An example of a surface cleaning head, consistent with the present disclosure, may include a fluid distributor configured to distribute a cleaning fluid, an agitator configured to absorb at least a portion of the distributed cleaning fluid and to agitate debris on the surface to be cleaned, a fluid stripper configured to remove, from the agitator, at least a portion of the distributed cleaning fluid absorbed by the agitator, a debris container, and a removable cover extending over at least a portion of the debris container and at least a portion of the agitator. The debris container may include a solid debris chamber configured to collect at least a portion of the debris agitated from the surface to be cleaned and a fluid debris chamber configured to collect at least a portion of the fluid removed from the agitator by the fluid stripper. The removable cover may include a fluid catch plate configured to transfer at least a portion of the cleaning fluid removed from the agitator by the fluid stripper to the fluid debris chamber, the fluid catch plate being configured to selectively transition between an in-use position and a cleaning position when the removable cover is removed from the surface cleaning head.

In some instances, the fluid catch plate may be pivotally coupled to the removable cover and may be configured to pivot between the in-use position and the cleaning position when the removable cover is removed from the surface cleaning head. In some instances, the fluid catch plate may include a collecting region, a first channel, a second channel, and a fluid diverter extending between the first channel and the second channel, the collecting region being disposed forwardly of the first channel and the second channel. In some instances, the fluid catch plate may include a first fluid grate extending between the first channel and the collecting region and a second fluid grate extending between the second channel and the collecting region. In some instances, the debris container may include a fluid collection tray fluidly coupled to the fluid catch plate and a container valve disposed within the fluid collection tray, the container valve configured to selectively fluidly couple the fluid collection tray with the fluid debris chamber. In some instances, the container valve may be configured to transition between an open position and a closed position based on a state of engagement of the surface cleaning head with the surface to be cleaned, the container valve being biased towards the closed position. In some instances, the fluid distributor may include at least one of a spray nozzle or a steam manifold.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A surface cleaning device comprising:

an upright section; and a surface cleaning head pivotally coupled to the upright section, the surface cleaning head including:

a fluid distributor configured to distribute a cleaning fluid;

an agitator configured to absorb at least a portion of the cleaning fluid distributed by the fluid distributor and to agitate debris on the surface to be cleaned;

a fluid stripper configured to remove, from the agitator, at least a portion of the distributed cleaning fluid absorbed by the agitator;

a debris container including:

a solid debris chamber configured to collect at least a portion of the debris agitated from the surface to be cleaned; and a fluid debris chamber configured to collect at least a portion of the fluid removed from the agitator by the fluid stripper; and a removable cover extending over at least a portion of the debris container and at least a portion of the agitator, the removable cover including a fluid catch plate pivotably coupled thereto and configured to transfer at least a portion of the cleaning fluid removed from the agitator by the fluid stripper to the fluid debris chamber, the fluid catch plate being configured to selectively and pivotably transition between an in-use position and a cleaning position when the removable cover is removed from the surface cleaning head.

2. The surface cleaning device of claim 1, wherein the fluid catch plate includes a collecting region, a first channel, and a second channel, the collecting region being disposed forwardly of the first channel and the second channel.

3. The surface cleaning device of claim 2, wherein the fluid catch plate includes a fluid diverter extending between the first channel and the second channel.

4. The surface cleaning device of claim 3, wherein the fluid catch plate includes a first fluid grate extending between the first channel and the collecting region and a second fluid grate extending between the second channel and the collecting region.

5. The surface cleaning device of claim 1, wherein the debris container includes a fluid collection tray fluidly coupled to the fluid catch plate and a container valve disposed within the fluid collection tray, the container valve configured to selectively fluidly couple the fluid collection tray with the fluid debris chamber.

6. The surface cleaning device of claim 5, wherein the container valve is configured to transition between an open position and a closed position based on a state of engagement of the surface cleaning head with the surface to be cleaned.

7. The surface cleaning device of claim 6, wherein the container valve is biased towards the closed position.

8. The surface cleaning device of claim 1 further comprising a multi-axis pivot joint pivotally coupling the upright section to the surface cleaning head, wherein the multi-axis pivot joint is configured such that the upright section is pivotable about at least a recline axis and a side-to-side pivot axis.

9. The surface cleaning device of claim 8, wherein the multi-axis pivot joint includes a pivot body and a paddle pivotally coupled to the pivot body, the paddle being configured to pivot between a locked position and an unlocked position, the paddle pivoting between the locked position and the unlocked position based on a rotational position of the upright section about the recline axis.

10. The surface cleaning device of claim 9, wherein, in the locked position, the paddle is configured to substantially prevent the upright section from pivoting about the side-to-side pivot axis and, in the unlocked position, the paddle does not substantially interfere with movement of the upright section about the side-to-side pivot axis.

11. The surface cleaning device of claim 10, wherein the paddle includes a retaining portion and a triggering portion, the retaining portion being configured to selectively engage a portion of the upright section to substantially prevent the upright section from pivoting about the side-to-side pivot axis and the triggering portion being configured to engage with a portion of the surface cleaning head.

12. The surface cleaning device of claim 1, wherein the fluid distributor includes at least one of a spray nozzle or a steam manifold.

13. A surface cleaning head comprising:

a fluid distributor configured to distribute a cleaning fluid;

an agitator configured to absorb at least a portion of the cleaning fluid distributed by the fluid distributor and to agitate debris on the surface to be cleaned;

a fluid stripper configured to remove, from the agitator, at least a portion of the distributed cleaning fluid absorbed by the agitator;

a debris container including:

a solid debris chamber configured to collect at least a portion of the debris agitated from the surface to be cleaned; and a fluid debris chamber configured to collect at least a portion of the fluid removed from the agitator by the fluid stripper; and a removable cover extending over at least a portion of the debris container and at least a portion of the agitator, the removable cover including a fluid catch plate pivotably coupled thereto and configured to transfer at least a portion of the cleaning fluid removed from the agitator by the fluid stripper to the fluid debris chamber, the fluid catch plate being configured to selectively and pivotably transition between an in-use position and a cleaning position when the removable cover is removed from the surface cleaning head.

14. The surface cleaning head of claim 13, wherein the fluid catch plate includes a collecting region, a first channel, a second channel, and a fluid diverter extending between the first channel and the second channel, the collecting region being disposed forwardly of the first channel and the second channel.

15. The surface cleaning head of claim 14, wherein the fluid catch plate includes a first fluid grate extending between the first channel and the collecting region and a second fluid grate extending between the second channel and the collecting region.

16. The surface cleaning head of claim 13, wherein the debris container includes a fluid collection tray fluidly coupled to the fluid catch plate and a container valve disposed within the fluid collection tray, the container valve configured to selectively fluidly couple the fluid collection tray with the fluid debris chamber.

17. The surface cleaning head of claim 16, wherein the container valve is configured to transition between an open position and a closed position based on a state of engagement of the surface cleaning head with the surface to be cleaned, the container valve being biased towards the closed position.

18. The surface cleaning head of claim 13, wherein the fluid distributor includes at least one of a spray nozzle or a steam manifold.

19. A surface cleaning device comprising:

an upright section; and a surface cleaning head pivotally coupled to the upright section, the surface cleaning head including:

a fluid distributor configured to distribute a cleaning fluid;

an agitator configured to absorb at least a portion of the cleaning fluid distributed by the fluid distributor and to agitate debris on the surface to be cleaned;

a fluid stripper configured to remove, from the agitator, at least a portion of the distributed cleaning fluid absorbed by the agitator;

a debris container including:

a solid debris chamber configured to collect at least a portion of the debris agitated from the surface to be cleaned; and a fluid debris chamber configured to collect at least a portion of the fluid removed from the agitator by the fluid stripper; and a removable cover extending over at least a portion of the debris container and at least a portion of the agitator, the removable cover including a fluid catch plate configured to transfer at least a portion of the cleaning fluid removed from the agitator by the fluid stripper to the fluid debris chamber, the fluid catch plate being configured to selectively transition between an in-use position and a cleaning position when the removable cover is removed from the surface cleaning head, wherein the fluid catch plate includes a collecting region, a first channel, and a second channel, the collecting region being disposed forwardly of the first channel and the second channel.

20. A surface cleaning head comprising:

a fluid distributor configured to distribute a cleaning fluid;

an agitator configured to absorb at least a portion of the cleaning fluid distributed by the fluid distributor and to agitate debris on the surface to be cleaned;

a fluid stripper configured to remove, from the agitator, at least a portion of the distributed cleaning fluid absorbed by the agitator;

a debris container including:

a solid debris chamber configured to collect at least a portion of the debris agitated from the surface to be cleaned; and a fluid debris chamber configured to collect at least a portion of the fluid removed from the agitator by the fluid stripper; and a removable cover extending over at least a portion of the debris container and at least a portion of the agitator, the removable cover including a fluid catch plate configured to transfer at least a portion of the cleaning fluid removed from the agitator by the fluid stripper to the fluid debris chamber, the fluid catch plate being configured to selectively transition between an in-use position and a cleaning position when the removable cover is removed from the surface cleaning head, wherein the fluid catch plate includes a collecting region, a first channel, a second channel, and a fluid diverter extending between the first channel and the second channel, the collecting region being disposed forwardly of the first channel and the second channel.

* * * * *